US010890365B2

(12) United States Patent
Neema et al.

(10) Patent No.: US 10,890,365 B2
(45) Date of Patent: Jan. 12, 2021

(54) SOFTWARE LOGIC IN A SOLID-PRODUCTION SYSTEM

(71) Applicant: Electrolux Home Products, Inc., Charlotte, NC (US)

(72) Inventors: Priyanka Monil Neema, Fort Mill, SC (US); George Marshall Horne, Kannapolis, NC (US); Stephen Smith, Concord, NC (US); Thomas Josefsson, Concord, NC (US); Vasantha K. Chitta, Huntersville, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 36 days.

(21) Appl. No.: 16/401,785

(22) Filed: May 2, 2019

(65) Prior Publication Data

US 2020/0103157 A1 Apr. 2, 2020

Related U.S. Application Data

(60) Provisional application No. 62/738,143, filed on Sep. 28, 2018, provisional application No. 62/738,277,
(Continued)

(51) Int. Cl.
*F25C 1/10* (2006.01)
*F25C 1/25* (2018.01)
(Continued)

(52) U.S. Cl.
CPC ..... *F25C 1/10* (2013.01); *F25C 1/04* (2013.01); *F25C 1/24* (2013.01); *F25C 1/246* (2013.01);
(Continued)

(58) Field of Classification Search
CPC ..... F25C 1/10; F25C 5/22; F25C 1/24; F25C 1/04; F25C 1/246; F25C 5/182;
(Continued)

(56) References Cited

U.S. PATENT DOCUMENTS 2,385,539 A 9/1945 Pownall
2,432,597 A * 12/1947 Toulmin, Jr. ..... F25C 1/10 62/344
(Continued)

FOREIGN PATENT DOCUMENTS

CN 106440596 2/2017
FR 2437590 4/1980
(Continued)

*Primary Examiner* — Emmanuel E Duke
(74) *Attorney, Agent, or Firm* — Womble Bond Dickinson (US) LLP

(57) ABSTRACT

A solid-production system for producing a solid on demand is provided herein. In some aspects, the solid-production system includes a conveying mechanism; a fluid-dispensing mechanism; a pressure plate arranged to urge the fluid mold into interaction with a cooling block to form a solid; a solid-dispensing mechanism arranged to dispense the solid loosened by a solid ejector to a user; and processing circuitry configured to implement a master state machine, and slave state machines for respective ones of the fluid-dispensing mechanism, conveying mechanism, pressure plate and solid-dispensing mechanism, wherein the master state machine is configured to send commands to the slave state machines based on states of the slave state machines, and the slave state machines are configured to execute the commands to control the respective ones of the conveying mechanism, fluid-dispensing mechanism, pressure plate, and solid-dispensing mechanism.

14 Claims, 43 Drawing Sheets

Related U.S. Application Data filed on Sep. 28, 2018, provisional application No. 62/738,207, filed on Sep. 28, 2018, provisional application No. 62/738,283, filed on Sep. 28, 2018, provisional application No. 62/738,231, filed on Sep. 28, 2018.

(51) Int. Cl.

| | |
|---|---|
| ***F25C 5/20*** | (2018.01) |
| ***F25C 1/24*** | (2018.01) |
| ***F25C 1/04*** | (2018.01) |
| ***F25C 1/246*** | (2018.01) |
| ***F25C 5/182*** | (2018.01) |

(52) U.S. Cl.

CPC ..... *F25C 1/25* (2018.01); *F25C 5/182* (2013.01); *F25C 5/22* (2018.01); *F25C 2305/022* (2013.01); *F25C 2400/04* (2013.01); *F25C 2400/06* (2013.01); *F25C 2400/10* (2013.01); *F25C 2600/04* (2013.01); *F25C 2700/00* (2013.01)

(58) Field of Classification Search

CPC .. F25C 1/25; F25C 2305/022; F25C 2400/10; F25C 2600/04; F25C 2400/04; F25C 2700/00; F25C 2400/06; F25C 1/12; F25C 1/22

See application file for complete search history.

(56) References Cited

U.S. PATENT DOCUMENTS

| | | | | |
|---|---|---|---|---|
| 2,460,341 | A | 2/1949 | Erickson et al. | |
| 2,510,400 | A * | 6/1950 | Hurley | F25C 1/10 62/137 |
| 3,192,726 | A * | 7/1965 | Newton | F25C 1/04 62/3.63 |
| 3,199,309 | A | 8/1965 | Brubuker | |
| 3,253,425 | A | 5/1966 | McKissick | |
| 3,299,656 | A | 1/1967 | Linstromberg et al. | |
| 3,580,007 | A | 5/1971 | Bauerlein | |
| 3,664,149 | A | 5/1972 | Garland et al. | |
| 3,779,032 | A | 12/1973 | Nichols | |
| 3,969,909 | A | 7/1976 | Barto et al. | |
| 4,206,614 | A | 6/1980 | Allbritton | |
| 4,274,263 | A | 6/1981 | Goushaw | |
| 4,614,088 | A | 9/1986 | Brooks | |
| 5,014,553 | A | 5/1991 | Hori et al. | |
| 5,140,831 | A | 8/1992 | Kohl et al. | |
| 5,163,300 | A | 11/1992 | Kato et al. | |
| 5,690,849 | A | 11/1997 | DeVilbiss et al. | |
| 5,761,919 | A | 6/1998 | Wilson et al. | |
| 5,941,091 | A | 8/1999 | Broadbent | |
| 6,012,293 | A | 1/2000 | Andersson | |
| 6,067,806 | A | 5/2000 | Park | |
| 6,092,374 | A | 7/2000 | Kang et al. | |
| 6,311,503 | B1 | 11/2001 | Shapiro et al. | |
| 6,339,930 | B2 | 1/2002 | Horey | |
| 6,349,550 | B1 | 2/2002 | Shapiro et al. | |
| 6,357,720 | B1 * | 3/2002 | Shapiro | F25C 1/10 249/119 |
| 6,401,467 | B1 | 6/2002 | Horey et al. | |
| 6,414,301 | B1 | 7/2002 | Borg, Jr. et al. | |
| 6,581,391 | B2 | 6/2003 | Horey et al. | |
| 6,581,392 | B1 | 6/2003 | Gist et al. | |
| 6,820,433 | B2 * | 11/2004 | Hwang | F25C 1/10 62/237 |
| 7,082,782 | B2 | 8/2006 | Schlosser et al. | |
| 7,129,490 | B2 | 10/2006 | Olson et al. | |
| 7,216,491 | B2 | 5/2007 | Cole et al. | |
| 7,426,838 | B1 | 9/2008 | Shapiro et al. | |
| 7,475,555 | B2 | 1/2009 | Janardhanam et al. | |
| 7,533,682 | B2 | 5/2009 | Gheorghe et al. | |
| 7,841,198 | B2 | 11/2010 | Bippus et al. | |
| 8,353,171 | B2 | 1/2013 | Feinauer et al. | |
| 8,820,100 | B2 | 9/2014 | Culley et al. | |
| 8,904,816 | B2 | 12/2014 | Bergqvist et al. | |
| 9,568,228 | B2 | 2/2017 | Joung et al. | |
| 9,733,004 | B2 | 8/2017 | Mitchell et al. | |
| 9,803,908 | B2 | 10/2017 | Estrada Amo | |
| 9,841,217 | B2 | 12/2017 | Lee et al. | |
| 2008/0072610 | A1 | 3/2008 | Venkatakrishnan et al. | |
| 2008/0250796 | A1 | 10/2008 | Clugston et al. | |
| 2009/0255279 | A1 | 10/2009 | Kim et al. | |
| 2009/0308085 | A1 | 12/2009 | DeVos | |
| 2010/0089075 | A1 | 4/2010 | Park | |
| 2011/0296863 | A1 * | 12/2011 | Bergqvist | F25C 1/10 62/340 |

FOREIGN PATENT DOCUMENTS

| | | |
|---|---|---|
| JP | 2002-295931 | 10/2002 |
| JP | 2004-271046 | 9/2004 |
| JP | 2006-308504 | 11/2006 |
| WO | WO 01/27544 | 4/2001 |
| WO | WO 2017/071071 | 5/2017 |
| WO | WO 2017/194660 | 11/2017 |

* cited by examiner

SOFTWARE LOGIC IN A SOLID-PRODUCTION SYSTEM

CROSS-REFERENCE TO RELATED APPLICATIONS

This application claims priority to U.S. Provisional Application No. 62/738,143, filed Sep. 28, 2018 and entitled, "Utilizing Thermal Mass in a Solid-Production System", U.S. Provisional Application No. 62/738,277, filed Sep. 28, 2018 and entitled "Design of Fluid Molds in a Solid-Production System", U.S. Provisional Application No. 62/738,207, filed Sep. 28, 2018 and entitled "Fluid Dispense System for a Solid-Production System", U.S. Provisional Application No. 62/738,283, filed Sep. 28, 2018 and entitled "Software Logic in a Solid-Production System", and U.S. Provisional Application No. 62/738,231, filed Sep. 28, 2018 and entitled, "Solid Detection System for a Solid-Production System", each of these applications being incorporated by reference herein.

TECHNOLOGICAL FIELD

The present disclosure relates generally to solid production such as ice production and, in particular, to software logic to control a solid-production system for producing a solid on demand.

BACKGROUND

Conventional refrigeration appliances, such as domestic refrigerators, typically have both a fresh food compartment and a freezer compartment or section. Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, e.g., by circulating cold air over water in an ice tray to freeze the water into ice pieces or by conduction e.g., transfer thermal energy through a thin conductive material when the temperature of the water is hotter than the thin conductive material. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

However, conventional ice making units that employ conduction using a thin conductive material, convection, or another similar ice making modality tend to be inefficient at reducing a temperature of water to form ice pieces. This is because, in part, compressors utilized in conventional ice making units are generally inefficient due to the economic limitations of compressor sizing. For example, a very large compressor may increase the rate of ice production by reducing a temperature of water for form ice pieces quicker than a smaller compressor, but may be extremely cost and energy inefficient as a whole. As such, the ice production rate in conventional ice making units may be inefficient due to at least compressor sizing limitations as well as the heat transfer delivery method (e.g., conduction or convection).

Therefore, a need exists for a system for producing ice pieces that utilizes a heat transfer coefficient that is higher than heat transfer coefficients used in typical ice making modalities, so as to be more efficient and adaptable to demands of users.

SUMMARY

Example implementations of the present disclosure are directed to software logic in a solid-production system for producing a formed solid, for example, ice. The present disclosure includes, without limitation, the following example implementations.

Some example implementations provide a solid-production system, comprising a conveying mechanism arranged to engage and move a fluid mold through the solid-production system; a fluid-dispensing mechanism arranged to dispense fluid to the fluid mold; a cooling block arranged to interact with the fluid mold moved through the cooling block via the conveying mechanism so as to cool the fluid therein to form a solid; a pressure plate arranged to urge the fluid mold into interaction with the cooling block; a solid-dispensing mechanism arranged to dispense the solid loosened by a solid ejector to a user through an exit port; and processing circuitry configured to implement a master state machine, and slave state machines for respective ones of the fluid-dispensing mechanism, conveying mechanism, pressure plate and solid-dispensing mechanism, wherein the master state machine is configured to send commands to the slave state machines based on states of the slave state machines, and the slave state machines are configured to execute the commands to control the respective ones of the conveying mechanism, fluid-dispensing mechanism, pressure plate, and solid-dispensing mechanism.

In some example implementations of the solid-production system of any preceding example implementation, or any combination of any preceding example implementations, the slave state machines include a conveying mechanism slave state machine and other slave state machines for the fluid-dispensing mechanism, pressure plate, and solid-dispensing mechanism, wherein the master state machine being configured to send commands to the slave state machines includes being configured to send first and second commands to the conveying mechanism slave state machine based on respectively first and second states of the conveying mechanism slave state machine, and wherein the first state is defined by the conveying mechanism not moving the fluid mold through the solid-production system, and the second state is defined by the conveying mechanism moving the fluid mold through the solid-production system.

In some example implementations of the solid-production system of any preceding example implementation, or any combination of any preceding example implementations, the conveying mechanism slave state machine is configured to: execute the first command and cause the conveying mechanism to move the fluid mold through the solid-production system; and execute the second command and cause the conveying mechanism to stop movement of the fluid mold through the solid-production system.

In some example implementations of the solid-production system of any preceding example implementation, or any combination of any preceding example implementations, the slave state machines include a fluid-dispensing mechanism slave state machine and other slave state machines for the conveying mechanism, pressure plate, and solid-dispensing mechanism, wherein the master state machine being configured to send commands to the slave state machines includes being configured to send first and second commands to the fluid-dispensing mechanism slave state machine based on respectively first and second states of the fluid-dispensing mechanism slave state machine, and wherein the first state is defined by the fluid-dispensing mechanism dispensing the fluid to the fluid mold, and the second state is defined by the fluid-dispensing mechanism not dispensing the fluid to the fluid mold.

In some example implementations of the solid-production system of any preceding example implementation, or any combination of any preceding example implementations, the fluid-dispensing mechanism slave state machine is configured to: execute the first command to cause the fluid-dispensing mechanism to stop dispensing the fluid to the fluid mold; and execute the second command to cause the fluid-dispensing mechanism to initiate dispensing the fluid to the fluid mold.

In some example implementations of the solid-production system of any preceding example implementation, or any combination of any preceding example implementations, the slave state machines include a pressure plate slave state machine and other slave state machines for the conveying mechanism, fluid-dispensing mechanism, and solid-dispensing mechanism, wherein the master state machine being configured to send commands to the slave state machines includes being configured to send first and second commands to the pressure plate slave state machine based on respectively first and second states of the pressure plate slave state machine, and wherein the first state is defined by the pressure plate being arranged adjacent to a top surface of the fluid in the fluid mold so as to urge the fluid mold into interaction with the cooling block, and the second state is defined by the pressure plate being arranged in a spaced apart relation from the top surface of the fluid in the fluid mold so as not to urge the fluid mold into interaction with the cooling block.

In some example implementations of the solid-production system of any preceding example implementation, or any combination of any preceding example implementations, the pressure plate slave state machine is configured to: execute the first command to cause arrangement of the pressure plate into the spaced apart relation from the top surface of the fluid in the fluid mold so as not to urge the fluid mold into interaction with the cooling block; and execute the second command to cause arrangement of the pressure plate to be adjacent to the top surface of the fluid in the fluid mold so as to urge the fluid mold into interaction with the cooling block.

In some example implementations of the solid-production system of any preceding example implementation, or any combination of any preceding example implementations, the slave state machines include a solid-dispensing mechanism slave state machine and other slave state machines for the conveying mechanism, fluid-dispensing mechanism, and pressure plate, wherein the master state machine being configured to send commands to the slave state machines includes being configured to send first and second commands to the solid-dispensing mechanism slave state machine based on respectively first and second states of the solid-dispensing mechanism slave state machine, and wherein the first state is defined by the solid-dispensing mechanism being arranged to dispense the solid loosened by the solid ejector to the user through the exit port, and the second state is defined by the solid-dispensing mechanism being arranged so as to not dispense the loosened solid.

In some example implementations of the solid-production system of any preceding example implementation, or any combination of any preceding example implementations, the solid-dispensing mechanism slave state machine is configured to: execute the first command to cause arrangement of the solid-dispensing mechanism so as not to cause the solid-dispensing mechanism to dispense the loosened solid; and execute the second command to cause arrangement of the solid-dispensing mechanism so as to cause the solid-dispensing mechanism to dispense the solid loosened by the solid ejector to the user through the exit port.

In some example implementations of the solid-production system of any preceding example implementation, or any combination of any preceding example implementations, the master state machine is configured to detect variables associated with respective ones of the states of the slave state machines, and send the commands to the slave state machines based thereon.

In some example implementations of the solid-production system of any preceding example implementation, or any combination of any preceding example implementations, the variables associated with the states of the conveying mechanism slave state machine include a volume of the fluid or the solid in the fluid mold, a time period associated with a fluid or a solid in the fluid mold, sub-states of the conveying mechanism, a track error state, a number of cycles that the conveying mechanism moves through the solid-production system, an expiration of a time period associated with a cycle of the number of cycles, detection and update of a position of the fluid mold in the cycle, a temperature of the fluid or the solid in the fluid mold, an emptiness of the fluid mold, and an expiration of a time period associated with cooling the fluid in the fluid mold to form the solid.

In some example implementations of the solid-production system of any preceding example implementation, or any combination of any preceding example implementations, the variables associated with the states of the fluid-dispensing mechanism slave state machine include a fill level and a fill time of the fluid dispensed to the fluid mold, an emptiness of the fluid mold, detection of the fluid mold in a fluid-dispensing position aligned with the fluid-dispensing mechanism, a volume of the solid in the fluid mold, and a temperature of the fluid or the solid in the fluid mold and an expiration of a time period associated with dispensing the fluid to the fluid mold.

In some example implementations of the solid-production system of any preceding example implementation, or any combination of any preceding example implementations, the variables associated with the states of the pressure plate slave state machine include an arrangement of the pressure plate from a top surface of the fluid in the fluid mold, detection of the fluid mold in an ejection position aligned with the solid ejector, an emptiness of the fluid mold, a temperature of the fluid or the solid in the fluid mold, and an arrangement of the solid ejector relative to the fluid mold in the ejection position.

In some example implementations of the solid-production system of any preceding example implementation, or any combination of any preceding example implementations, the variables associated with the states of the solid-dispensing mechanism slave state machine include detection of the fluid mold in a solid-dispensing position aligned with the solid-dispensing mechanism, an emptiness of the fluid mold, a temperature of the fluid or the solid in the fluid mold, a status of the exit port, expiration of a time period associated with dispensing the solid from the fluid mold, and a volume of the solid in the fluid mold.

It will therefore be appreciated that the above Summary is provided merely for purposes of summarizing some example implementations so as to provide a basic understanding of some aspects of the disclosure. As such, it will be appreciated that the above described example implementations are merely examples of some implementations and should not be construed to narrow the scope or spirit of the disclosure in any way. It will be appreciated that the scope of the disclosure encompasses many potential implementations, some of which will be further described below, in addition to those here summarized. Further, other aspects and advantages of implementations disclosed herein will become apparent from the following detailed description taken in conjunction with the accompanying drawings which illustrate, by way of example, the principles of the described implementations.

BRIEF DESCRIPTION OF THE DRAWING(S)

Having thus described the disclosure in general terms, reference will now be made to the accompanying drawings, which are not necessarily drawn to scale, and wherein:

FIGS. 4A-4K illustrate different states and sub-states of a conveying mechanism slave state machine according to example implementations of the present disclosure;

DETAILED DESCRIPTION

Figure 1:
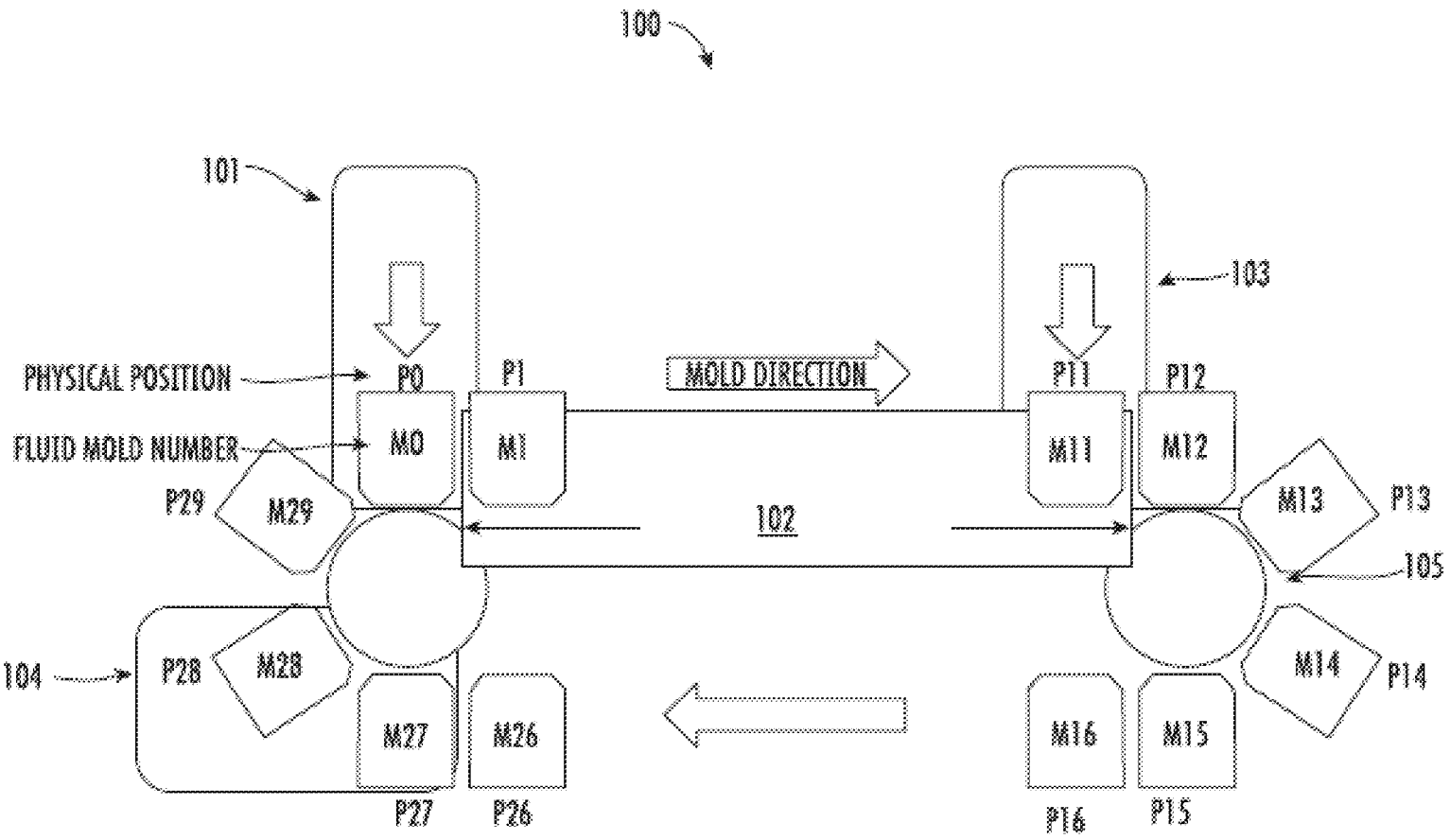
FIG. 1 illustrates a schematic of a solid-production system according to example implementations of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. For example, unless otherwise indicated, reference to something as being a first, second or the like should not be construed to imply a particular order. Also, something may be described as being above something else (unless otherwise indicated) may instead be below, and vice versa; and similarly, something described as being to the left of something else may instead be to the right, and vice versa. Further, for example, reference may be made herein to quantitative measures, values, relationships or the like. Unless otherwise stated, any one or more if not all of these may be absolute or approximate to account for acceptable variations that may occur, such as those due to engineering tolerances or the like. Like reference numerals refer to like elements throughout.

Example implementations of the present disclosure are generally directed to solid production, such as ice production, and may be utilized in any of a number of different types of applications. Some example applications include commercial food storage and processing, chemical manufacturing, concrete mixing and curing, packaged ice production, and the like. Other example applications include household appliances such as refrigerators, freezers, or the like. As such, some example implementations of the present disclosure may be suitable for use in a household refrigeration system, where ice is produced on demand by the system upon a request for ice by a user.

More particularly, an appliance, such as for example, a household refrigeration system, may include the appropriate hardware and/or software to allow a user to interact with the appliance either directly on the appliance or remotely by way of network-connectivity between the appliance and a user device. Examples of appliances provisioned with network-connectivity are provided in U.S. Patent Application Pub. No. 2016/0315810 to Francescangeli, which is incorporated by reference herein in its entirety. For example, the user may be able to control the appliance, monitor operation of the appliance, initiate a service request for the appliance, and/or perform other management tasks via a service platform integrated with the appliance or on the user device.

In some example implementations, the user may be able to interact with the service platform in order to control, monitor, initiate a service request, and/or perform other management tasks with regard to a solid-production system of the appliance. For example, the user may be able to request dispense of one or more solids (e.g., ice pieces), which may be produced and dispensed based on this request. The service platform may also provide the user with the capability to tailor the solid production to his/her needs. For example, the user may be able to monitor a rate of solid production to determine how many solids are available for dispense (e.g., number of ice pieces formed) and/or when more solids will be available for dispense. If the user wishes to increase the speed of solid production, the service platform may further allow the user to modify or choose a volume of the solid (i.e., size of the solid) produced, and thus, modify the speed of solid production; where a solidification time of the solid is dependent on the desired volume of the solid. Therefore, the solid-production system disclosed herein advantageously allows a user to control a solid-production rate to increase the rate of solid production as desired.

According to some example implementations, FIG. 1 illustrates a solid-production system 100, which may be used to produce a solid, such as ice, from a fluid, such as water. Other solids produced from other fluids may also be produced using the solid-production system as described herein. As shown in FIG. 1, the solid-production system may include a fluid-dispensing mechanism 101(otherwise referred to herein as "a fluid dispenser"), a cooling block and pressure plate arrangement 102 including a cooling block associated with a pressure plate, a solid ejector 103, and a solid-dispensing mechanism 104 (otherwise referredto herein as "a solid dispenser"). The solid-production system illustrated in FIG. 1 also may include a plurality of fluid molds M0-M29 that can move in a machine direction through a conveying mechanism 105 (otherwise referred to as "a conveyor"). The fluid molds may comprise a geometry (e.g., size, shape, dimensions, material, etc.) that advantageously promotes a rate of solid formation in a manner that may be over an order of magnitude larger than conventional solid-production systems. The generated solid is dispensable or provided to a user at the solid-dispensing mechanism 104. An example operation of the solid-production system 100 is described in further detail below.

The conveying mechanism 105 may be configured to individually index a fluid mold of the plurality of fluid molds M0-M29 into an initial physical position P0 aligned with the fluid-dispensing mechanism 101. The fluid-dispensing apparatus may be configured to dispense a quantity of fluid, such as water, into the fluid mold M0 upon detection of the fluid mold in the fluid-dispensing position. The fluid-dispensing mechanism may be configured with a sensor to determine a fill level of the fluid dispensed from the fluid-dispensing apparatus into the fluid mold so as to determine whether the fluid mold is filled with a pre-determined threshold quantity of fluid.

After the fluid-dispensing mechanism 101 determines that a fluid mold, such as the fluid mold M0, is filled with the pre-determined threshold quantity of fluid, the conveying mechanism 105 may be configured to index the fluid mold out of the fluid-dispensing position P0 and index a subsequent fluid mold, such as fluid mold M29, into the fluid-dispensing position for receipt of the fluid by the fluid-dispensing mechanism. The fluid mold that is filled with the pre-determined threshold quantity of fluid may then be moved by the conveying mechanism in the machine direction from the fluid-dispensing mechanism to the cooling block of the cooling block and pressure plate arrangement 102. For example, the fluid mold M0 can be indexed from the fluid-dispensing position P0 to a subsequent physical position P1 in the cooling block by the conveying mechanism.

In one example implementation, the solid-production system 100 includes a pressure plate. The pressure plate may be arranged relative to a top surface of the fluid in the fluid molds in a cooling region (i.e., P1-P10). The pressure plate may be arrangeable into an initial position adjacent to a top surface of the fluid in the fluid molds so as to urge the fluid molds into interaction with the cooling block. The pressure plate may also be arrangeable in a second position in spaced apart relation relative to a top surface of the fluid in the fluid molds so as not to urge the fluid molds into interaction with the cooling block. When the pressure plate is in the initial position and the fluid molds are urged into interaction with the cooling block, the cooling block may reduce a first temperature of the fluid in the fluid molds to a second temperature so as to solidify the fluid in the fluid molds and form a solid.

The cooling block of the cooling block and pressure plate arrangement 102 may be configured to cool the quantity of fluid dispensed in the fluid molds as they are indexed or are moved therethrough by the conveying mechanism 105 in order to form a solid in the fluid molds. In some example implementations, the solid-production system includes one or more tracks that may be received through the fluid mold, such that the cooling block may simultaneously or substantially simultaneously solidify fluid in fluid molds on multiple tracks. For example, there may be a single track with 30 fluid molds, with a cooling region in the cooling block being sized to accommodate ten fluid molds therein (e.g., fluid molds M1-M10 as shown in FIG. 1. The solidification time, which is a time it takes a fluid mold to reduce in temperature from the first temperature to the second temperature and thereby solidify may be determined by several characteristics including, but not limited to, a geometry of the fluid molds, a threshold fill level of the fluid in the fluid molds, a length of the cooling block, a temperature of a material of the cooling block, a thermal conductivity of a material of the fluid molds, a first or initial temperature of the fluid in the fluid mold, etc.

A fluid mold, such as the fluid mold M11, may be indexed or transmitted through the cooling region of the cooling block and arrive at a position P11 at the solid ejector 103. At position P11, the solid ejector may include a sensor that may be configured to detect whether a solid, such as ice, has formed in the fluid mold. For example, the sensor at the solid ejector may be configured to detect whether or not an entirety or a substantial entirety of a volume of fluid in the fluid mold has been cooled to a temperature at which it has formed a solid. After the sensor at the solid ejector determines that fluid in the fluid mold has formed a solid, the fluid mold can be loosened by the solid ejector. The solid ejector may be configured to loosen the solid in the fluid mold such that the bond between the solid and the fluid mold may be broken. Optionally, the solid ejector or a secondary solid ejector may be located at the solid-dispensing mechanism 104, proximate to position P27 to loosen a solid in the fluid mold.

After the solid ejector 103 loosens the solid in the fluid mold, the fluid mold with the loosened solid may be indexed using the conveying mechanism 105 from the position P11 to subsequent positions, such as, for example, positions P12-P28. When being indexed by the conveying mechanism through positions P12-P28, each fluid mold may include a housing or a cap so that the solid will not be disturbed and potentially removed from an interior of the fluid mold. In this way, when a fluid mold moves from the position P11 to the position P28, although the fluid mold may be upside down as shown in FIG. 1, the loosened solid may not fall out from the interior of the fluid mold.

The solid-dispensing mechanism 104 may be configured to dispense the solid from an interior of the fluid mold once the fluid mold arrives at the position P28. The solid-dispensing mechanism 104 may have an exit port positioned proximate to the position P28. When a fluid mold, such as the fluid mold M28, arrives at the position P28, the exit port may allow dispense of the loosened and dispensed solid from the fluid mold. In some example implementations, a sensor may be located proximate to the position P28 to detect whether the solid is dispensed or provided to the user through the exit port. After the solid in the fluid mold is dispensed at the solid-dispensing mechanism, the empty fluid mold may then be indexed from the position P28 to the position P29 by the conveying mechanism 105.

In some example implementations, operation of the solid-production system 100 is initiated when a user requests one or more solids from a user interface. Upon receiving the user's request, the exit port positioned proximate to the position P28 may open to allow dispense of the requested number of solids from the fluid mold to the user. As the requested number of solids is dispensed by the solid-dispensing mechanism, the empty fluid molds may be indexed from the position P28 to the position P29 by the conveying mechanism 105, as described above.

Figure 2:
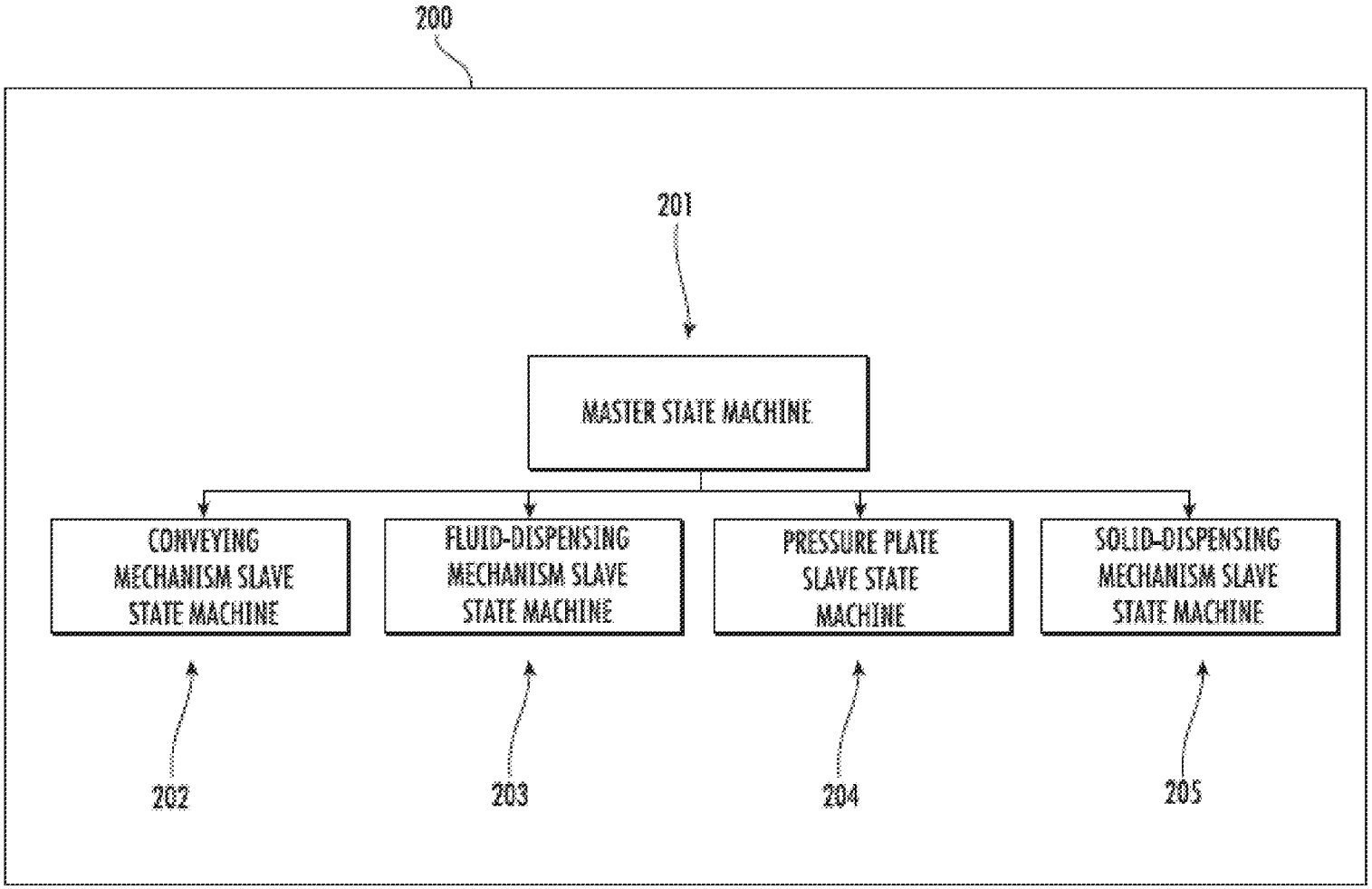
FIG. 2 illustrates a schematic of processing circuitry configured to implement a master state machine and slave state machines for controlling a solid-production system according to example implementations of the present disclosure.

FIG. 2 illustrates a schematic of processing circuitry 200 for a solid-production system configured to implement a master state machine 201 and slave state machines 202, 203, 204, 205 for respective ones of a conveying mechanism, a fluid-dispensing mechanism, a pressure plate, and a solid-dispensing mechanism such as the ones described above in FIG. 1. As shown, the master state machine may control the operation of the solid-production system by being configured to send commands to the slave state machines based on states of the slave state machines. Likewise, the slave state machines may control operation of the conveying mechanism, the fluid-dispensing mechanism, the pressure plate, and the solid-dispensing mechanism by being configured to execute the commands to control respective ones of the conveying mechanism, the fluid-dispensing mechanism, the pressure plate, and the solid-dispensing mechanism.

In one example implementation, the master state machine 201 is configured to send first and second commands to the conveying mechanism slave state machine 202 based on respectively first and second states of the conveying mechanism slave state machine. The conveying mechanism slave state machine may be arranged to control the conveying mechanism (e.g., 105 in FIG. 1) including at least one track arranged to engage and move a fluid mold through the solid-production system, which includes at least a fluid-dispensing mechanism, a pressure plate, a solid ejector, and a solid-dispensing mechanism.

In this example implementation, the first state of the conveying mechanism slave state machine 202 may be defined by the conveying mechanism not moving the fluid mold through the solid-production system, and the second state may be defined by the conveying mechanism moving the fluid mold through the solid-production system. As described herein, the first and second states defined by the conveying mechanism are example states thereof, and other states may be defined by the conveying mechanism.

In some example implementations, the conveying mechanism slave state machine 202 may receive the commands from the master state machine 201 and may be configured to execute the first command and cause the conveying mechanism to move the fluid mold through the solid-production system; and execute the second command and cause the conveying mechanism to stop movement of the fluid mold through the solid-production system. As described herein, the first and second commands defined by the conveying mechanism are example commands, and other commands may be defined by the conveying mechanism.

In some other example implementations, the master state machine 201 may be configured to send first and second commands to a fluid-dispensing mechanism slave state machine 203 based on respectively first and second states of the fluid-dispensing mechanism slave state machine. The fluid-dispensing mechanism slave state machine may be arranged to control a fluid-dispensing mechanism (e.g., 101 in FIG. 1) arranged to dispense the fluid to the fluid mold. In this example implementation, the first state of the fluid-dispensing mechanism slave state machine may be defined by the fluid-dispensing mechanism dispensing the fluid to the fluid mold. The second state of the fluid-dispensing mechanism slave state machine may be defined by the fluid-dispensing mechanism not dispensing the fluid to the fluid mold. As described herein, the first and second states defined by the fluid-dispensing mechanism are example states thereof, and other states may be defined by the fluid-dispensing mechanism.

In some example implementations, the fluid-dispensing mechanism slave state machine 203 may receive the commands from the master state machine 201 and may be configured to execute the first command to cause the fluid-dispensing mechanism to stop dispensing the fluid to the fluid mold; and execute the second command to cause the fluid-dispensing mechanism to initiate dispensing the fluid to the fluid mold. As described herein, the first and second commands defined by the fluid-dispensing mechanism are example commands, and other commands may be defined by the fluid-dispensing mechanism.

In some other example implementations, the master state machine 201 may be configured to send first and second commands to a pressure plate slave state machine 204 based on respectively first and second states of the pressure plate slave state machine. The pressure plate slave state machine may be arranged to control interaction of the fluid molds with a cooling block (e.g., the cooling block of the cooling block and pressure plate arrangement 102 in FIG. 1). In this example implementation, the first state may be defined by the pressure plate being arranged adjacent to a top surface of the fluid in the fluid mold so as to urge the fluid mold into interaction with the cooling block, and the second state may be defined by the pressure plate being arranged in a spaced apart relation from the top surface of the fluid mold so as not to urge the fluid mold into interaction with the cooling block. As described herein, the first and second states defined by the pressure plate mechanism are example states thereof, and other states may be defined by the pressure plate mechanism. For example, a third state of the pressure plate slave state machine may define the pressure plate being arranged in spaced apart relation from the top surface of the fluid in the fluid molds, where the pressure plate in the third state is spaced apart from the top surface of the fluid molds a greater distance than the in the second state. As described in further detail, the first state may correspond to an initial or default position of the pressure plate, the second state may correspond to a second position of the pressure plate, and the third state may correspond to an ejection position of the pressure plate.

In some example implementations, the pressure plate slave state machine 204 may receive the commands from the master state machine 201 and may be configured to execute the first command to cause arrangement of the pressure plate into the spaced apart relation from the top surface of the fluid in the fluid mold so as not to urge the fluid mold into interaction with the cooling block; and execute the second command to cause arrangement of the pressure plate to be adjacent to the top surface of the fluid in the fluid mold so as to urge the fluid mold into interaction with the cooling block. As described herein, the first and second commands defined by the pressure plate mechanism are example commands, and other commands may be defined by the pressure plate mechanism. For example, a third command, upon execution by the pressure plate state slave machine, may cause arrangement of the pressure plate to be in spaced apart relation from the top surface of the fluid in the fluid mold, where the pressure plate upon execution of the third command, is spaced apart from the top surface of the fluid molds a greater distance than upon execution of the first command.

In some other example implementations, the master state machine 201 is configured to send first and second commands to a solid-dispensing mechanism slave state machine 205 based on respectively first and second states of the solid-dispensing mechanism slave state machine. The solid-dispensing mechanism slave state machine may be arranged to control a solid-dispensing mechanism (e.g., 104 in FIG. 1) arranged to dispense the solid previously loosened by a solid ejector (e.g., 103 in FIG. 1) to a user through an exit port. In this example implementation, the first state of the solid-dispensing mechanism slave state machine may be defined by the solid-dispensing mechanism being arranged to dispense the solid loosened by the solid ejector to the user through the exit port. The second state of the fluid-dispensing mechanism slave state machine may be defined by the solid-dispensing mechanism being arranged so as to not dispense the loosened solid. As described herein, the first and second states defined by the solid-dispensing mechanism are example states thereof, and other states may be defined by the solid-dispensing mechanism.

In some example implementations, the solid-dispensing mechanism slave state machine 205 may receive the commands from the master state machine 201 and may be configured to execute the first command to cause arrangement of the solid-dispensing mechanism so as not to cause the solid-dispensing mechanism to dispense the loosened solid, and execute the second command to cause arrangement of the solid-dispensing mechanism so as to cause the solid-dispensing mechanism to dispense the solid loosened by the solid-dispensing mechanism to the user through the exit port. As described herein, the first and second commands defined by the solid-dispensing mechanism are example commands, and other commands may be defined by the solid-dispensing mechanism.

In some example implementations, the master state machine 201 may be configured to detect variables associated with respective ones of the states of the slave state machines (e.g., the conveying mechanism slave state machine 202, the fluid-dispensing mechanism slave state machine 203, the pressure plate slave state machine 204, and the solid-dispensing mechanism slave state machine 205), and send the commands to the slave state machines based thereon.

For example, the variables associated with the states of the conveying mechanism slave state machine may include a number of cycles that the conveying mechanism moves through the solid-production system, an expiration of a time period associated with a cycle of the number of cycles, detection and update of a position of the fluid mold in the cycle, a temperature of the fluid or the solid in the fluid mold, an emptiness of the fluid mold, and an expiration of a time period associated with cooling the fluid in the fluid mold to form the solid. Other variables associated with the states of the conveying mechanism slave state machine are also contemplated herein.

In another example, the variables associated with the states of the fluid-dispensing mechanism slave state machine 203 may include a fill level and a fill time of the fluid dispensed to the fluid mold, an emptiness of the fluid mold, a detection of the fluid mold in a fill or fluid-dispensing position aligned with the fluid-dispensing mechanism, a volume of the solid in the fluid mold, and a temperature of the fluid or the solid in the fluid mold and an expiration of a time period associated with dispensing the fluid to the fluid mold. Other variables associated with the states of the fluid-dispensing slave state machine are further contemplated.

In still another example, the variables associated with the states of the pressure plate slave state machine 204 may include an arrangement of the pressure plate from a top surface of the fluid in the fluid mold, detection of the fluid mold in an ejection position aligned with the solid ejector, an emptiness of the fluid mold, a temperature of the fluid or the solid in the fluid mold, and an arrangement of the solid ejector relative to the fluid mold in the ejection position. Other variables associated with the states of the pressure plate slave state machine are further contemplated.

In a still further example, the variables associated with the states of the solid-dispensing mechanism slave state machine 205 may include detection of the fluid mold in a solid-dispensing position aligned with the solid-dispensing mechanism, an emptiness of the fluid mold, a temperature of the fluid or the solid in the fluid mold, a status of the exit port, expiration of a time period associated with dispensing the solid from the fluid mold, and a volume of the solid in the fluid mold. Other variables associated with the states of the solid-dispensing slave state machine are further contemplated.

With regard to the conveying mechanism slave state machine 202, the conveying mechanism slave state machine may receive commands from the master state machine 201 for controlling one or more tracks. Each of the tracks may be controlled in parallel so that fluid molds on each of the tracks are incrementally moved or indexed one position at a time. For example, in some implementations, the conveying mechanism may comprise three tracks having a single motor or three designated motors (i.e., one motor per track). In some example implementations, the conveying mechanism slave state machine may execute commands received from the master state machine by actuating a main processor that may be configured to control the track(s) via control of the associated motors. For example, the main processor may be configured to actuate the associated motors for controlling track speed by implementing closed loop speed control.

In other example implementations, the conveying mechanism slave state machine 202 may execute commands and/or subcommands received from the master state machine 201 by actuating one or more co-processors that may supplement the capabilities of the main processor. For example, each co-processor may be associated with a motor, so that each co-processor may be configured to actuate the motor associated with each track in order to control track directional movement upon receiving a pulse that may be generated by pulse-width modulation (PWM) output from a general purpose input output (GPIO) or another similar mechanism. In this example, each motor may move the respective track only in one direction (e.g., the machine direction) and the associated co-processor may send a feedback of one pulse when the track is moved successfully. The co-processor may send two pulses as a negative acknowledgement (NACK) if the tracks are not moved successfully by its respective motor. Otherwise, each track may be jointly controlled by a single motor actuated by the co-processor.

Figure 3:
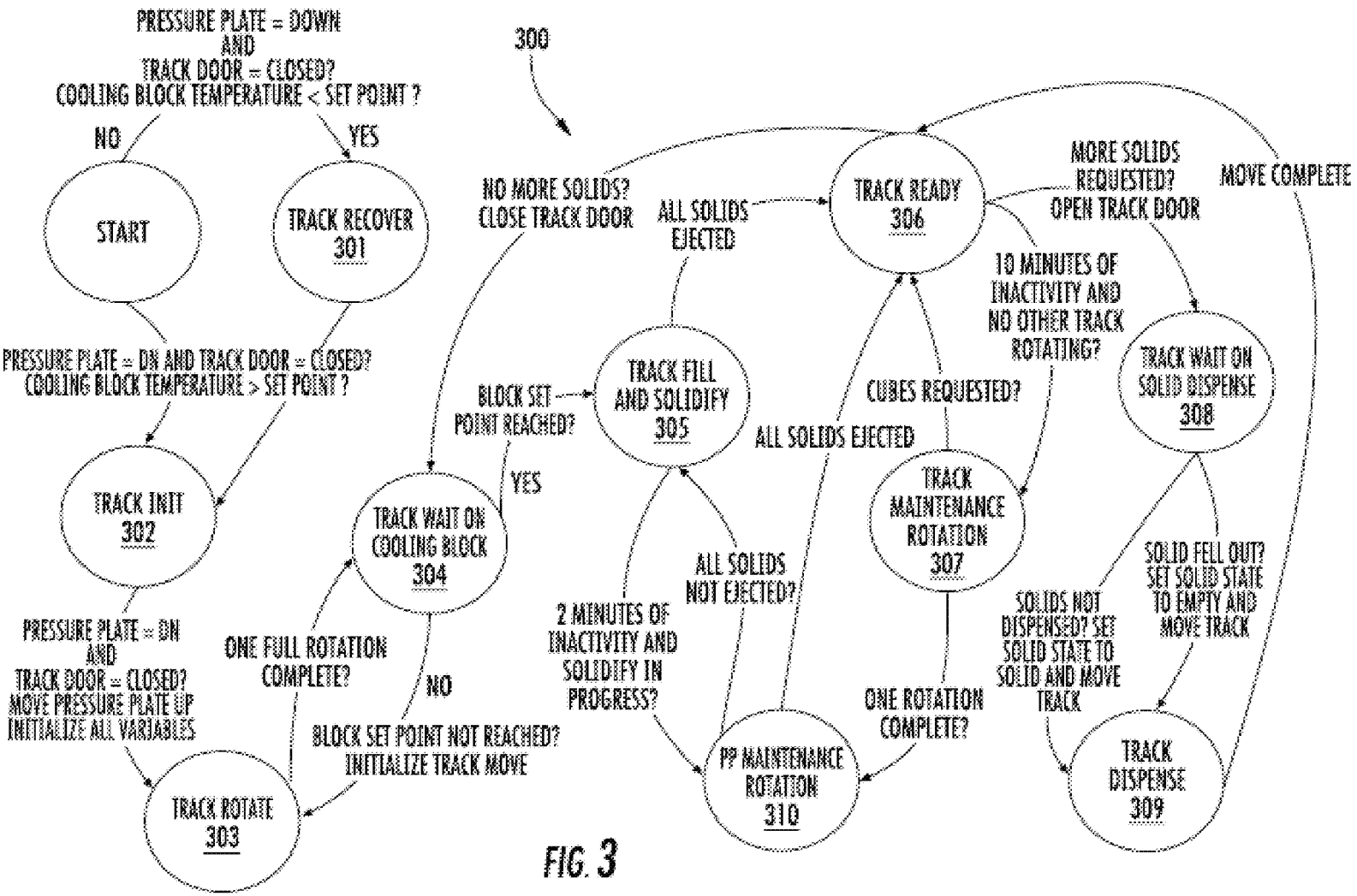
FIG. 3 illustrates a schematic of a conveying mechanism slave state machine according to example implementations of the present disclosure.

FIG. 3 illustrates a schematic of a conveying mechanism slave state machine 300, which may be the same as or similar to the conveying mechanism slave state machine 202 in FIG. 2, according to example implementations of the present disclosure. The conveying mechanism slave state machine in FIG. 3 may illustrate one example implementation of the conveying mechanism slave state machine described in FIG. 2, which receives commands and/or subcommands from the master state machine based on respective states of the conveying mechanism slave state machine. Execution of the commands by the conveying mechanism slave state machine may be initiated by the conveying mechanism slave state machine after receipt of the commands from the master slave state machine.

For example, as shown in FIG. 3, when the pressure plate is arranged in an initial position, i.e., arranged adjacent to a top surface of a fluid mold as a result of a normal biasing force exerted on a top surface of the pressure plate by a biasing mechanism, such as a spring, a track door associated with a solid-dispensing mechanism (e.g., 104 in FIG. 1) is closed, and a temperature of a cooling block (e.g., the cooling block of the cooling block and pressure plate arrangement 102 in FIG. 1) is less than a temperature set point, then the conveying mechanism slave state machine may be in a first state, where the track associated with the conveying mechanism may not be moving through the solid-production system. In the first state, the conveying mechanism slave state machine may receive a first command that initiates a series of subcommands from a master state machine, such as master state machine 201 in FIG. 2, to cause the conveying mechanism slave state machine to transition to a second state or another state or sub-state. Likewise, where the conveying mechanism slave state machine is in the second state, the conveying mechanism slave state machine may receive a second command that initiates a series of subcommands from a master state machine to cause the conveying mechanism slave state machine to transition back to the first state or another state or sub-state.

In some example implementations, subcommands may define parameters of the first or second command sent by the master state machine to the conveying mechanism slave state machine 300, such that execution of the subcommands may be initiated by the conveying mechanism slave state machine after receipt of the first or second command from the master state machine. Completion of the first or second command and/or subcommands may then result in the transition of the conveying mechanism slave state machine between the various states through a series of sub-states.

In particular, for example, the conveying mechanism slave state machine 300 in the first state may receive the first command, which may then initiate execution of a subcommand to measure and read a temperature of the cooling block relative to a temperature set point. For example, there may be one or more sensors located proximate to the cooling block to measure the temperature of the cooling block and transmit the measured temperature to the conveying mechanism slave state machine. The temperature set point may be a temperature that the cooling block has reached in order to solidify the fluid in the fluid molds, i.e., reduce the first temperature of the fluid to a second temperature.

Figure 4A:
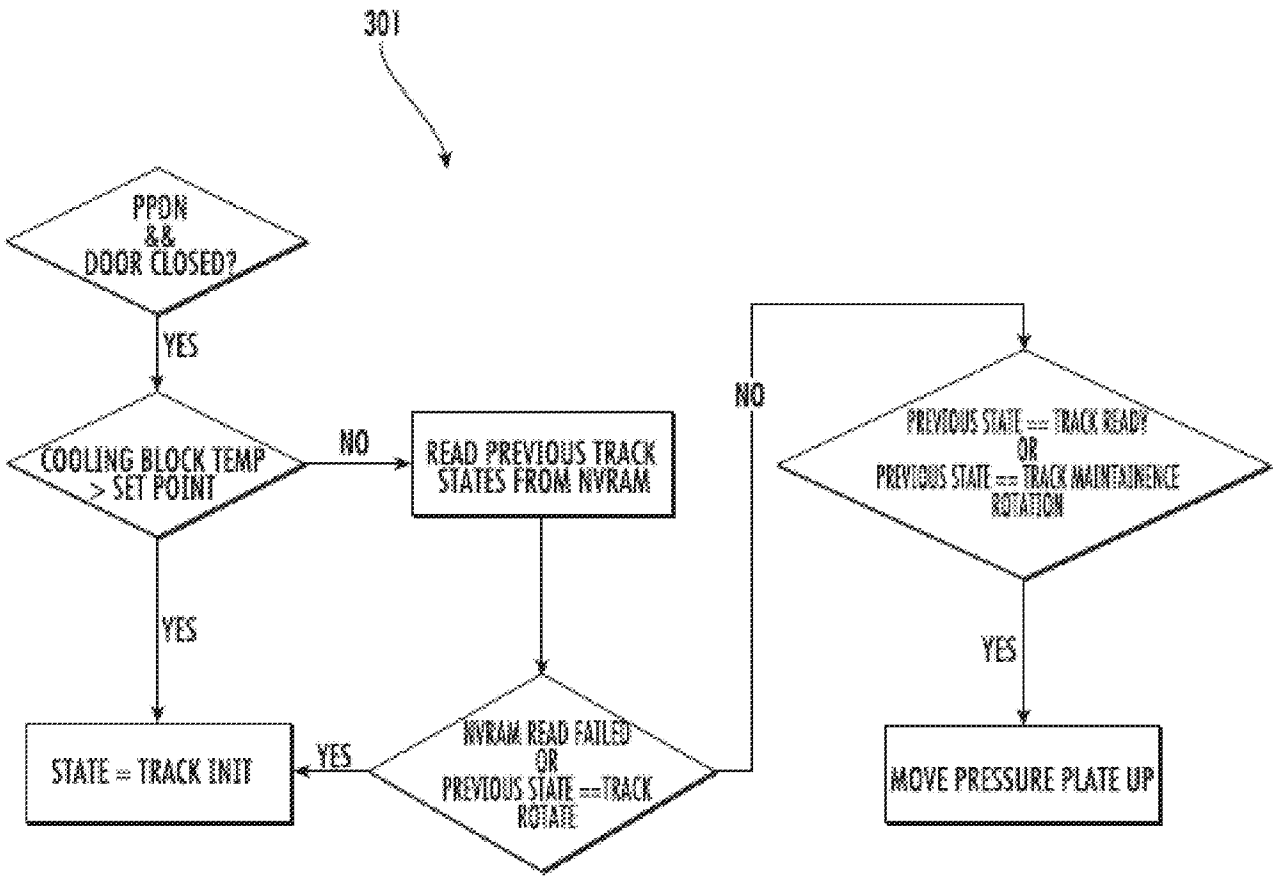

If the temperature of the cooling block is less than the temperature set point, then the conveying mechanism slave state machine 300 may move into a track recover state, "TRACK RECOVER" 301, as described in detail in FIG. 4A. If the temperature of the cooling block is not less than the temperature set point (i.e., is greater than the temperature set point), then the conveying mechanism slave state machine may transition to a start sub-state, "START", and then transition to a track initialize state, "TRACK INIT" 302, and may wait to receive and then execute further commands to transition out of this sub-state, as described in detail in FIG. 4B.

In FIG. 4A, for example, the track recover state, "TRACK RECOVER" 301, is illustrated. When the conveying mechanism slave state machine 300 is in the track recover state, the pressure plate is in an the initial position adjacent to a top surface of the fluid in the fluid molds and a track door for dispensing solids from the fluid molds is down or closed, and the temperature of the cooling block is less than the temperature set point. The conveying mechanism slave state machine may then execute a subcommand to retrieve and read stored previous states of the conveying mechanism slave state machine from a memory associated with a respective co-processor or a main processor, such as a non-volatile random-access memory (NVRAM). If the read of the stored previous states of the conveying mechanism slave state machine fails (e.g., retrieval of the previous states fails) or the previous state of the conveying mechanism slave state machine is in the track rotate state, "TRACK ROTATE" 303, such that the conveying mechanism is moving, then the conveying mechanism slave state machine may transition to the start state, "START" and then transition to the track initialize state, "TRACK INIT" 302, and may wait to receive and then execute further commands to transition out of this sub-state.

If the previous state of the conveying mechanism slave state machine is a track ready state, "TRACK READY" 306 or a track maintenance state, "TRACK MAINTENANCE ROTATION" 307, then a pressure plate slave state machine, such as the pressure plate slave state machine 204 in FIG. 2, may receive and execute a command to cause arrangement of the pressure plate into the second position in spaced apart relation from the top surface of the fluid in the fluid mold so as not to urge a bottom surface of the fluid mold into interaction with the cooling block.

Referring back to FIG. 3, when the conveying mechanism is in the start state, "START", the pressure plate is in an second position in spaced apart relation from the top surface of the fluid in the fluid molds, a track door for dispensing solids from the fluid molds is up or open, and the temperature of the cooling block is greater than the temperature set point. The pressure plate slave state machine 204 may then execute a command to cause arrangement of the pressure plate to be in the initial position or adjacent to the top surface of the fluid in the fluid molds and a solid-dispensing mechanism slave state machine (e.g., 205 in FIG. 2) may execute a command to cause the track door to move down or closed. In this manner, the conveying mechanism slave state machine 300 may then transition to the track initialize state, "TRACK INIT" 302.

Figure 4B:
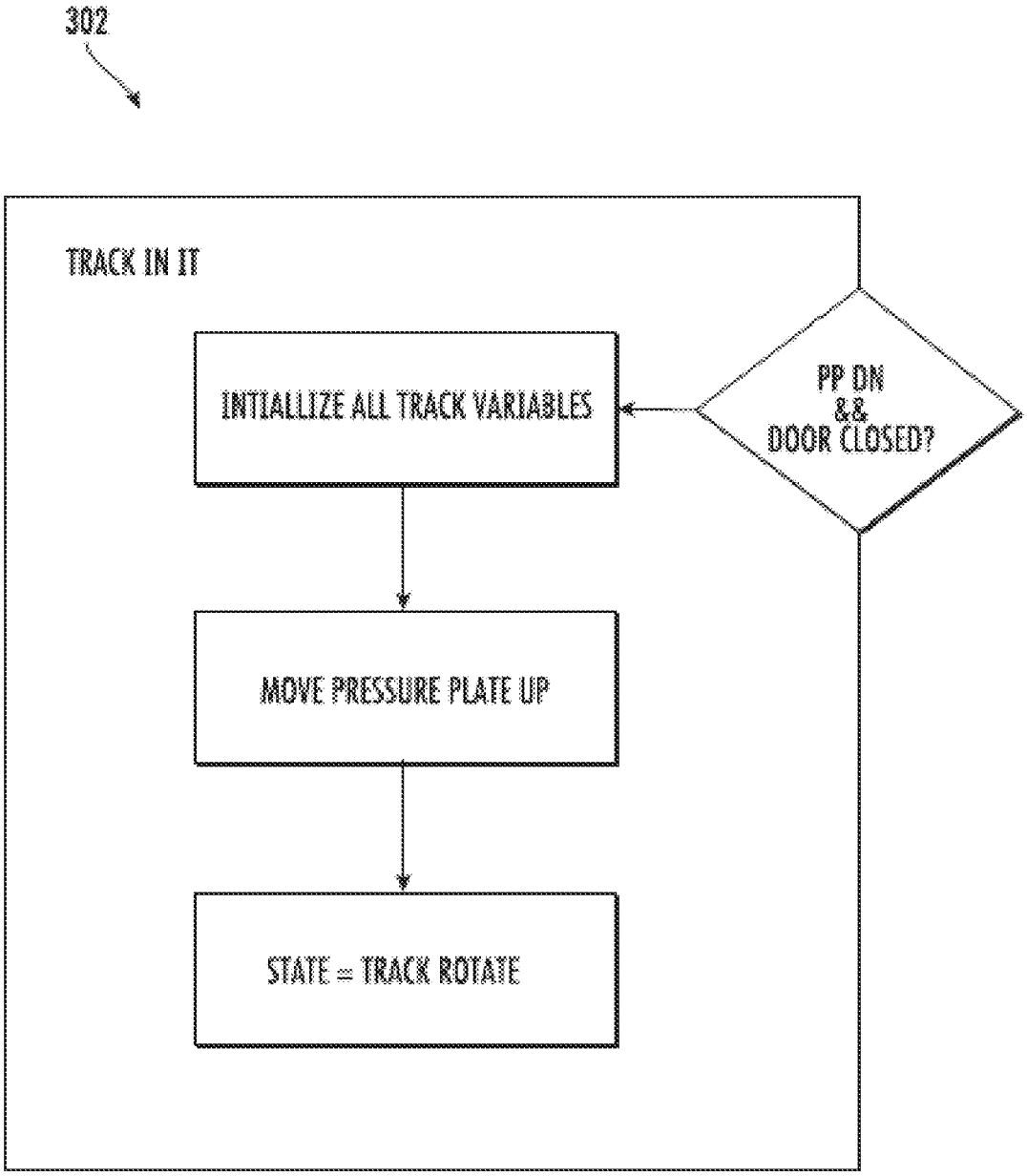

In FIG. 4B, for example, the track initialize state, "TRACK INITIALIZE" 302, is illustrated. When the conveying mechanism slave state machine 300 is in the track initialize state, the pressure plate is in the initial position adjacent to a top surface of the fluid in the fluid molds, the track door for dispensing solids from the fluid molds is down or closed, and the temperature of the cooling block is greater than the temperature set point. The master state machine may then be configured to detect variables associated with the track initialize state of the conveying mechanism and send commands and/or subcommands to the conveying mechanism slave state machine based thereon. The conveying mechanism slave state machine may then execute the commands and/or subcommands.

For example, as illustrated in FIG. 4B, the conveying mechanism slave state machine 300 may be configured to execute a subcommand to initialize track variables, such as, for example, a volume of the fluid or the solid in the fluid mold, a time period associated with a fluid or a solid in the fluid mold, sub-states of the conveying mechanism, a track error state, a number of cycles that the conveying mechanism moves through the solid-production system, an expiration of a time period associated with a cycle of the number of cycles, detection and update of a position of the fluid mold in the cycle, a temperature of the fluid or the solid in the fluid mold, an emptiness of the fluid mold, and an expiration of a time period associated with cooling the fluid in the fluid mold to form the solid. In this example, the pressure plate slave state machine may receive and execute another command to cause arrangement of the pressure plate into spaced apart relation from the top surface of the fluid in the fluid mold (i.e., second position), such that the fluid molds are not urged into interaction with the cooling block via the pressure plate. The conveying mechanism slave state machine may then transition to a track rotate state, "TRACK ROTATE" 303, described in greater detail in FIG. 4C.

Figure 4C:
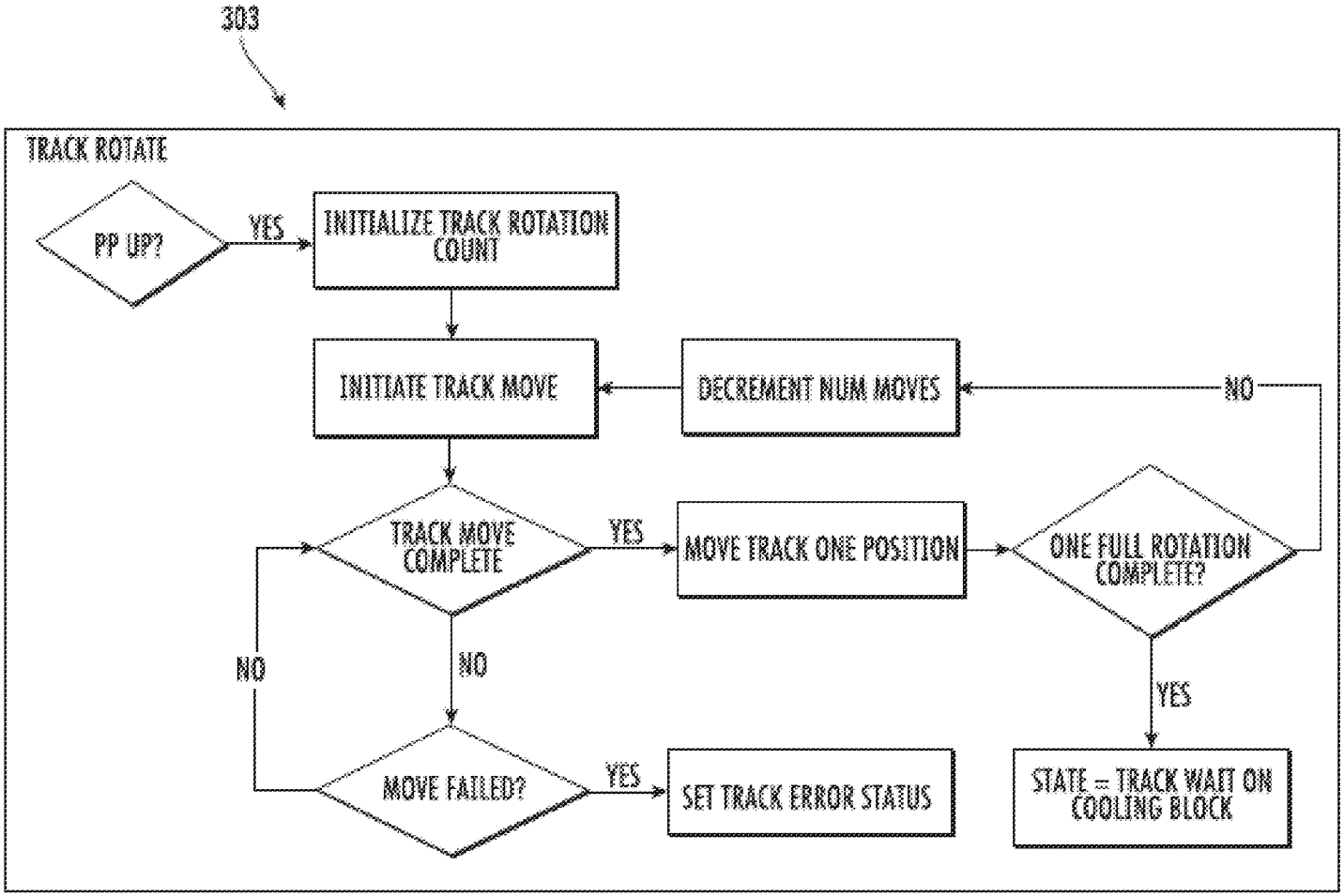

In FIG. 4C, for example, the track rotate state, "TRACK ROTATE" 303, is illustrated. In the track rotate state, the conveying mechanism slave state machine 300 may execute a subcommand to cause initialization of a track rotation count. The subcommand may comprise monitoring a position of the fluid molds within the solid-production system to determine when a fluid mold has moved through every position within the system, i.e., completed one cycle or rotation. For example, each position within the solid-production system may be numbered (e.g., positions P0-P29 in FIG. 1). In this example, the track rotation count may decrement the number of positions left before a specific fluid mold returns to an initial position, beginning with a total number of positions in the solid-production system and then decreasing that number by one each time that the fluid molds are moved one position in the machine direction. Thus, when a specific fluid mold returns to the initial position and there are 28 positions in the solid-production system, then the value is 0 and when it leaves the initial position, and when the specific fluid mold moves to the next position, the value is 27.

Further in this example, the number decremented each time the fluid molds are moved one position in the machine direction is used to count the number of full rotations made by the fluid molds (e.g., molds M0-M29) in the machine direction. As used herein, a "full rotation" or a "full cycle" refers to the track moving or indexing a fluid mold (e.g., M0) in the machine direction around the entire solid-production system. More particularly, the number of full rotations is based on how many times a fluid mold returns to an initial position. If, for example, the initial position of a fluid mold is P0, then each time the specific fluid mold returns to that initial position will be equivalent to a full rotation of that fluid mold throughout the system. As such, each subsequent full rotation will have its value increased by a value of one, so that a first rotation has a value of one (i.e., the specific fluid mold has returned to the initial position a first time), a second rotation has a value of 2 (i.e., the specific fluid mold has returned to the initial position a second time), etc.

Once the subcommand is initialized, then another command (e.g., the first command) may be executed to cause track movement via actuation of one or more motors associated with the track of the conveying mechanism. The track movement may be movement of each fluid mold one position in a machine direction.

Once the track of the conveying mechanism begins movement, then the conveying mechanism slave state machine 300 may transmit a signal back to the master state machine indicating that the conveying mechanism slave state machine has transitioned to the second state. In some example implementations, subcommands may define parameters of the second command, such that execution of the subcommands may be initiated by the conveying mechanism slave state machine after receipt of the second command from the master state machine. Completion of the second commands and/or subcommands may then result in the transition of the conveying mechanism slave state machine from the second state to the first state or another state through a series of sub-states, where the track moves the fluid mold through the solid-production system.

Movement of the fluid mold may be determined by analyzing whether a specific fluid mold (indicative of relative positions of all the fluid molds) has advanced one position from its previous position to a current position in the machine direction (e.g., from P0 to P1). If the fluid mold has not moved from its previous position, then another subcommand may be executed to determine if the move has failed (e.g., there is a system error) such that the track has not moved the fluid molds one position. If the move has not failed, then the command will run until the fluid molds have moved one position in the machine direction. If the move has failed, then the conveying mechanism slave state machine may transmit a signal to the master state machine to indicate the track error status of the track.

If the fluid molds have moved one position in the machine direction, then the command may continue execution to move the track so that the fluid molds each advance one position. More particularly, for example, the command may be configured to cause a motor associated with the track of the conveying mechanism to move the fluid molds one position in the machine direction in the track one position (e.g., move from P1 to P2). The conveying mechanism slave state machine 300 may then execute a subcommand to access an associated memory device to retrieve the track rotation count and/or previous and current positions of each of the fluid molds, and thereby determine whether the fluid molds of the track of the conveying mechanism have moved a number of positions equal to a full rotation (i.e., count value is 1). If the count value is not 1, then a subcommand may be executed and the number of positions left before the fluid molds return to their initial position may be decremented (e.g., by one). The subcommand may be executed then to move each fluid mold one position in the machine direction.

Figure 4D:
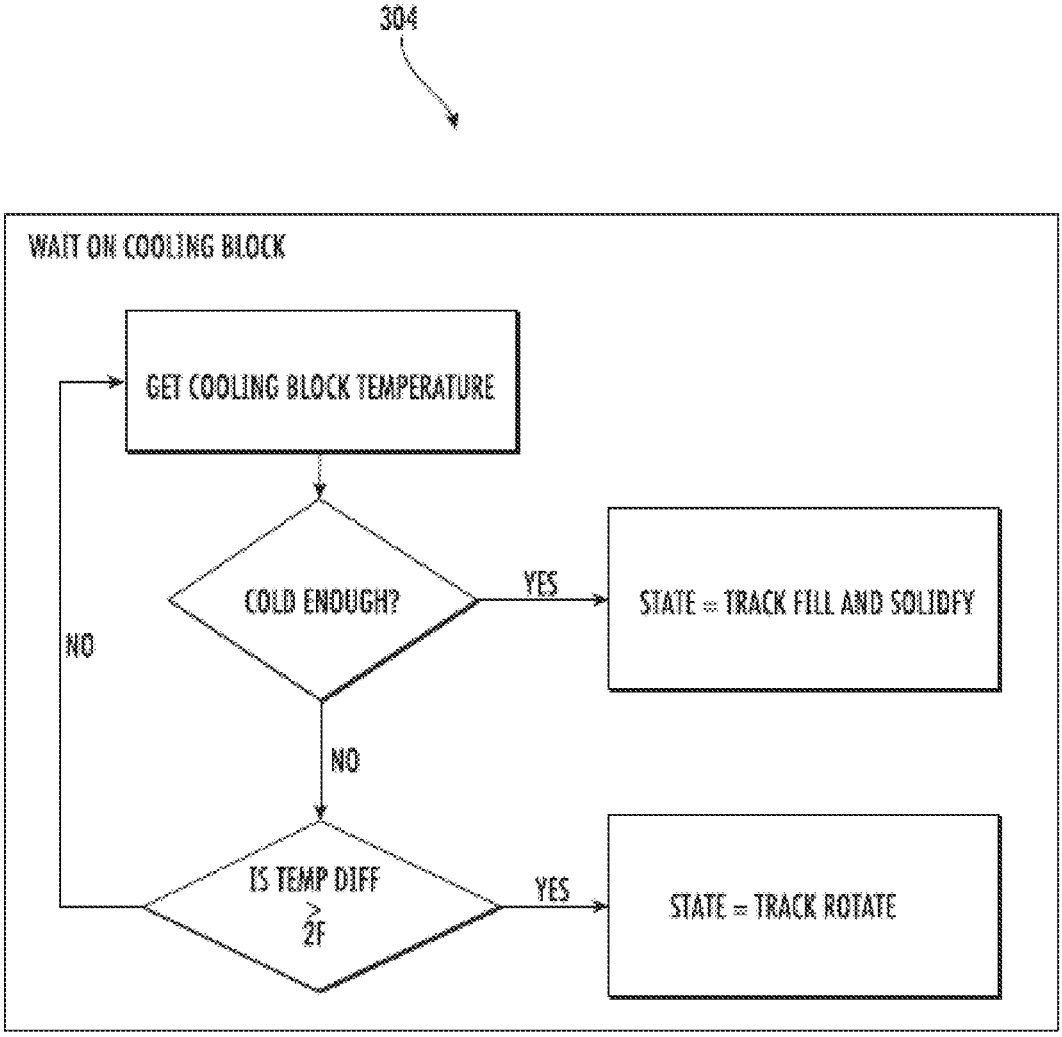

If the fluid molds of the track of the conveying mechanism have moved a number of positions equal to a full rotation, then the conveying mechanism slave state machine may transition to a track waiting state, "TRACK WAIT ON COOLING BLOCK" 304, described in more detail in FIG. 4D.

In FIG. 4D, for example, the track waiting state, "TRACK WAIT ON COOLING BLOCK" 304, is illustrated. The conveying mechanism slave state machine 300 may execute a subcommand to measure and read the temperature of the cooling block relative to a temperature set point. In particular, execution of the subcommand may cause a determination of whether the difference in temperature between the temperature of the cooling block and the temperature set point is greater than a predetermined tolerance (e.g., one (1) degree Fahrenheit (° F.), two (2) ° F., etc.) If the difference in temperature is not greater than the predetermined tolerance, then a subcommand may cause re-reading of the temperature of the cooling block and comparison of the temperature of the cooling block to the temperature set point. If the temperature of the cooling block is less than the temperature set point, then conveying mechanism slave state machine may receive a command to transition back to the track rotate state, "TRACK ROTATE" 303, and cause the conveying mechanism to move the fluid mold through the solid-production system for a full rotation.

Figure 4E:
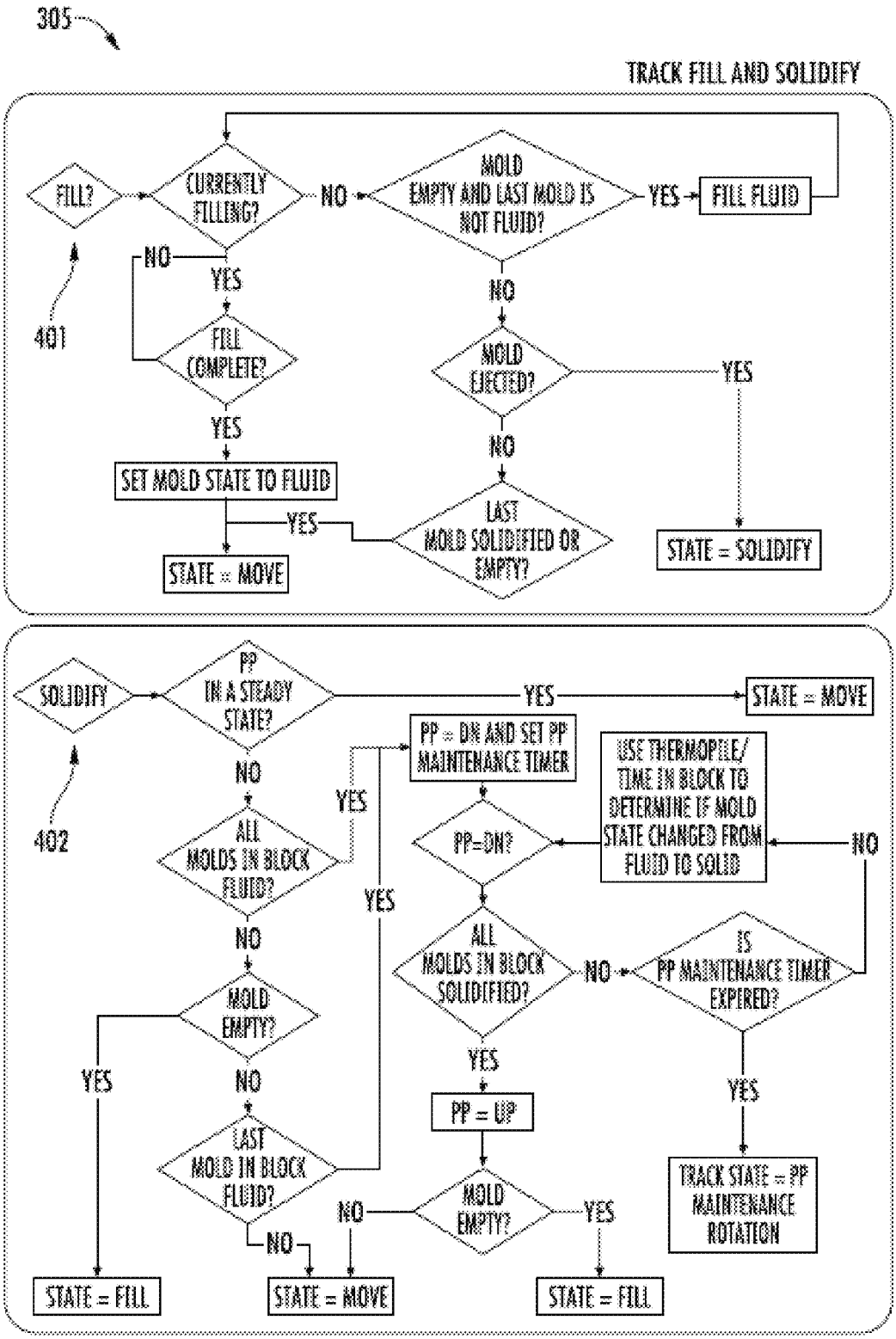

If the temperature of the cooling block is greater than the temperature set point, the conveying mechanism slave state machine 300 may transition to a track fill and solidify state, "TRACK FILL AND SOLIDIFY" 305, as described in greater detail in FIG. 4E.

In FIG. 4E, for example, the track fill and solidify state, "TRACK FILL AND SOLIDFY" 305, is illustrated. For example, the fluid-dispensing mechanism slave state machine, such as the fluid-dispensing slave state machine 203 in FIG. 2, may define a first state of the fluid-dispensing mechanism, "FILL" 401, so as to execute a command to begin dispensing fluid to the fluid molds (e.g., M0 in FIG. 1) at the fluid-dispensing position (e.g., P0 in FIG. 1). Any fluid may be dispensed using the fluid-dispensing mechanism, including, for example, water.

The conveying mechanism slave state machine 300 may then be configured to determine whether the fluid-dispensing mechanism is currently dispensing the fluid to the fluid mold using, for example, a sensor. A signal may be transmitted by the sensor to the conveying mechanism slave state machine indicating whether or not fluid dispensed by the fluid-dispensing mechanism is occurring. Fluid-dispensing may be complete after a predetermined threshold fill level has been achieved. The conveying mechanism slave state machine may be configured to receive measurements from the sensor of a measured fluid fill level for comparison against the predetermined threshold fill level. If the predetermined threshold fill level is met, fluid dispense is complete. The conveying mechanism slave state machine can then transition to the state "MOVE" (e.g., second state) to move the filled fluid mold through the cooling block.

If the fluid-dispensing mechanism is not currently filling a fluid mold, the conveying mechanism slave state machine can determine whether the fluid mold is empty. For example, the sensor may be configured to measure a temperature of the fluid mold to determine whether there is a solid, a fluid, or nothing in the fluid mold. In this example, if the sensor detects a temperature other than an ambient temperature of air, then the sensor may output a signal to the conveying mechanism slave state machine indicating that the fluid mold is not empty. If the fluid mold is not empty, the conveying mechanism slave state machine can determine whether a solid in the fluid mold has been ejected at, for example, ejection position P11 in FIG. 1. If so, then the pressure plate slave state machine can enter the solidify state "SOLIDIFY" 402, so as to urge the fluid mold into interaction with the cooling block. If the solid in the fluid mold has not been ejected, the conveying mechanism slave state machine can transition to the state defined by the conveying mechanism moving the fluid mold through the solid-production system. Further, the fluid-dispensing mechanism can record whether the fluid in the previous fluid mold was solidified, so that the conveying mechanism can index or move the fluid mold with the formed solid to the ejection position, e.g., P11 in FIG. 1, to eject the formed solid from the fluid mold.

Where the fluid mold is empty at the fluid-dispensing position, e.g., P0 in FIG. 1, the sensor may detect that the temperature in the fluid mold is the ambient temperature of air and transmit a signal indicating the same to the fluid-dispensing slave state machine. The fluid-dispensing slave state machine may be configured to determine if the previous mold was filled with fluid and then execute a command to initiate dispense of fluid into the current, empty fluid mold.

In some example implementations, where the pressure plate slave state machine is in the solidify state "SOLIDFY" 402, the pressure plate slave state machine can determine whether the pressure plate is in a steady state. If so, the conveying mechanism slave state machine can transition to the state defined by the conveying mechanism moving the fluid mold through the solid-production system.

If the pressure plate is not in a steady state, the pressure plate slave state machine can determine whether all the fluid molds in the cooling region relative to the cooling block include fluid for solidification. If so, the pressure plate slave state machine can execute a command to cause arrangement of the pressure plate to be adjacent to a top surface of the fluid in the fluid mold so as to urge the fluid mold into interaction with the cooling block and solidify the fluid in the fluid molds. In particular, motor(s) associated with the pressure plate can receive a signal from a sensing mechanism indicating that the fluid molds in the cooling region relative to the cooling block are filled to the predetermined fill level with fluid. The motors can then actuate an actuation mechanism so as to cause arrangement of the pressure plate to be adjacent to a top surface of the fluid in the fluid mold, i.e., move into the initial position, so as to urge a bottom surface of the fluid mold into interaction with the cooling block so as to reduce a first temperature of the fluid in the fluid molds to a second temperature to form a solid.

If all the fluid molds in the cooling region relative to the cooling block do not include fluid, fluid-dispensing mechanism can determine whether a fluid mold at the position P0 is empty via receiving a signal from an associated sensor. If so, the fluid-dispensing mechanism slave state machine can transition to the fill state "FILL" 401 to dispense fluid to the empty fluid mold in position P0. If the fluid mold at the position P0 is not empty, the fluid-dispensing slave state machine can receive a signal from a sensor whether a previous or last mold at the position P0 is filled with fluid. If so, then the pressure plate slave state machine may be configured to transition to the first state upon executing a second command so as to cause arrangement of the pressure plate to be adjacent to the top surface of the fluid in the fluid mold and solidify the fluid therein.

When the pressure plate is arranged adjacent to a top surface of the fluid in the fluid mold, a sensing mechanism may be configured to determine whether all the fluid molds in the cooling region relative to the cooling block have formed a solid from the fluid. The sensing mechanism may be a thermopile, a timer, a combination thereof, and the like. The sensing mechanism may be configured to detect whether or not a solid has formed and transmit the signal to the pressure plate slave state machine. If a solid has not formed, the sensing mechanism may continuously monitor the fluid molds to determine when the solid has formed. If a solid has formed, the pressure plate slave state machine can transition to the second state upon executing a first command so as to cause arrangement of the pressure plate into spaced apart arrangement from the top surface of the fluid in the fluid mold and not solidify the fluid therein. Then the conveying mechanism slave state machine can transition to the move state "MOVE" or the dispensing mechanism slave state machine can transition to the fill state "FILL" 401 based on whether the fluid mold is empty or not. If a timer for maintenance of the pressure plate is expired, the track fill and solidify state, "TRACK FILL AND SOLIDIFY" 305 can transition to the pressure plate maintenance rotation state, "PRESSURE PLATE MAINTENANCE ROTATION" 310.

Returning back to FIG. 3, in some example implementations, the pressure plate slave state machine (e.g., 204 in FIG. 2) may receive and execute a command to determine a state of the fluid mold (e.g., whether a solid is formed in the fluid mold, whether the fluid mold is empty, etc.) in an ejection position (e.g., position P11 in FIG. 1). If the fluid mold in the ejection position comprises a solid, then the pressure plate mechanism slave state machine may receive an eject command from the master state machine to cause a solid ejector (e.g., 103 in FIG. 1) to loosen the solid from the fluid mold. A sensing mechanism arranged adjacent to the solid ejector mechanism may determine whether the solid was ejected from the fluid mold. If so, then the conveying mechanism slave state machine 300 may transition to the track ready state, "TRACK READY" 306, as described in greater detail in FIG. 4F.

Figure 4F:
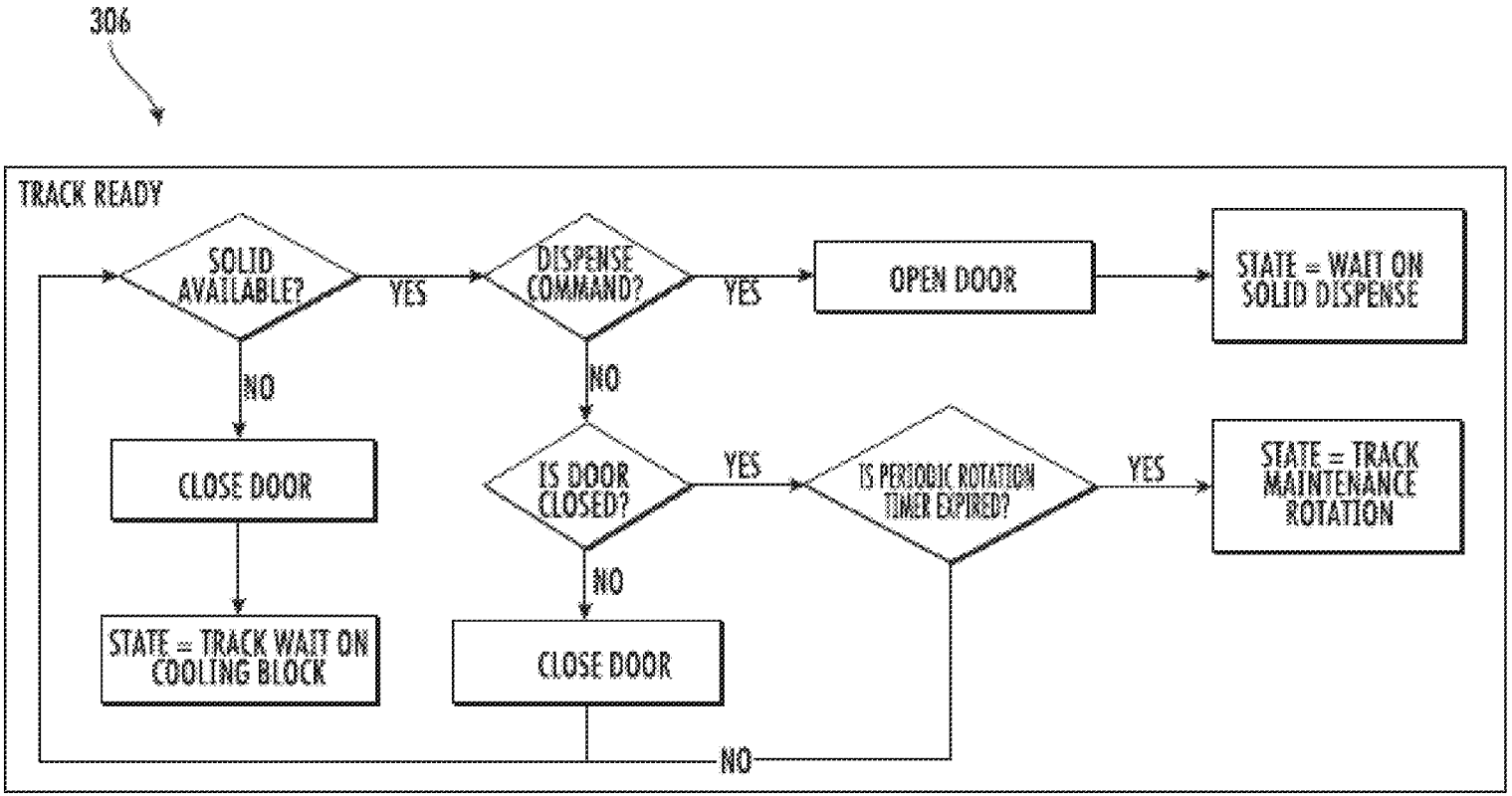

In FIG. 4F, for example, the track ready state, "TRACK READY" 306, is illustrated. The solid-dispensing slave state machine, such as the solid-dispensing slave state machine 205 in FIG. 2, may receive a command to determine if a solid is available to dispense at a solid-dispensing position (e.g., position P28 in FIG. 1) and open the track door to dispense a loosened solid to the user through the track door. A sensing mechanism associated with the solid-dispensing mechanism may be utilized to measure a temperature of the fluid mold and/or a fill level of a fluid in the fluid mold to determine whether a solid is formed and available. The master state machine may then transmit a second command to the solid-dispensing mechanism to cause arrangement of the solid-dispensing mechanism so as to cause the solid-dispensing mechanism to dispense the loosened solid in the fluid mold (e.g., M28 in FIG. 1) loosened by the solid ejector. The second command may cause the track door to open or be up so that the dispensed solid can exit from the track door through the exit port to the user. The conveying mechanism slave state machine may then transition to a solid dispense waiting state, "TRACK WAIT ON SOLID DISPENSE" 308.

If the master state machine does not transmit the second command to the solid-dispensing mechanism slave state machine, then the solid dispensing mechanism slave state machine may execute a subcommand to cause a determination of whether the track door to the exit port is closed. If the track door is not closed (i.e., is open), then the solid-dispensing mechanism slave state machine may execute a subcommand to close the door and may receive and re-execute a subcommand to determine if the fluid mold is in a solid state.

If the track door is closed, the conveying mechanism slave state machine 300 may execute a subcommand to cause a determination of whether a track maintenance timer has expired. The track maintenance timer, which may differ from or be the same timer as a pressure plate maintenance timer, may be activated during the track fill and solidify state, "TRACK FILL AND SOLIDIFY" 305 in order to monitor movement of the pressure plate. Specifically, the pressure plate maintenance timer may provide capabilities to determine that the pressure plate is not stuck in either of the first or the second position due to, for example, excessive frost due to water vapor. By comparison, the track maintenance timer may be activated during the track ready state, "TRACK READY" 306 so as to ensure that movement of the fluid molds is not hindered due to, for example, excessive frost due to water vapor.

If the track maintenance timer has expired (e.g., there is a period of inactivity in the system, such as for example, five minutes, ten minutes, etc.), then the conveying mechanism slave state machine may receive and execute the first command and cause the track of the conveying mechanism to move the fluid mold and transition to a track maintenance rotation state, "TRACK MAINTENANCE ROTATION" 307. Inactivity may include not receiving a user-request for a specified number of solids, such that none of the track(s) is/are rotating. The track maintenance rotation state is described in more detail in FIG. 4G. If the track maintenance timer has not expired, then the solid-dispensing mechanism slave state machine may receive and re-execute a command to determine if the fluid mold is in a solid state.

If a solid is not available (e.g., is still a fluid, the fluid mold is empty, etc.), then the solid-dispensing mechanism slave state machine may receive and execute a first command from the master state machine to cause arrangement of the solid-dispensing mechanism so as not to cause the solid-dispensing mechanism to dispense the loosened solid (i.e., the track door is closed to the exit port). The conveying mechanism slave state machine 300 may then transition back to the track waiting state, "TRACK WAIT ON COOLING BLOCK" 304.

Figure 4G:
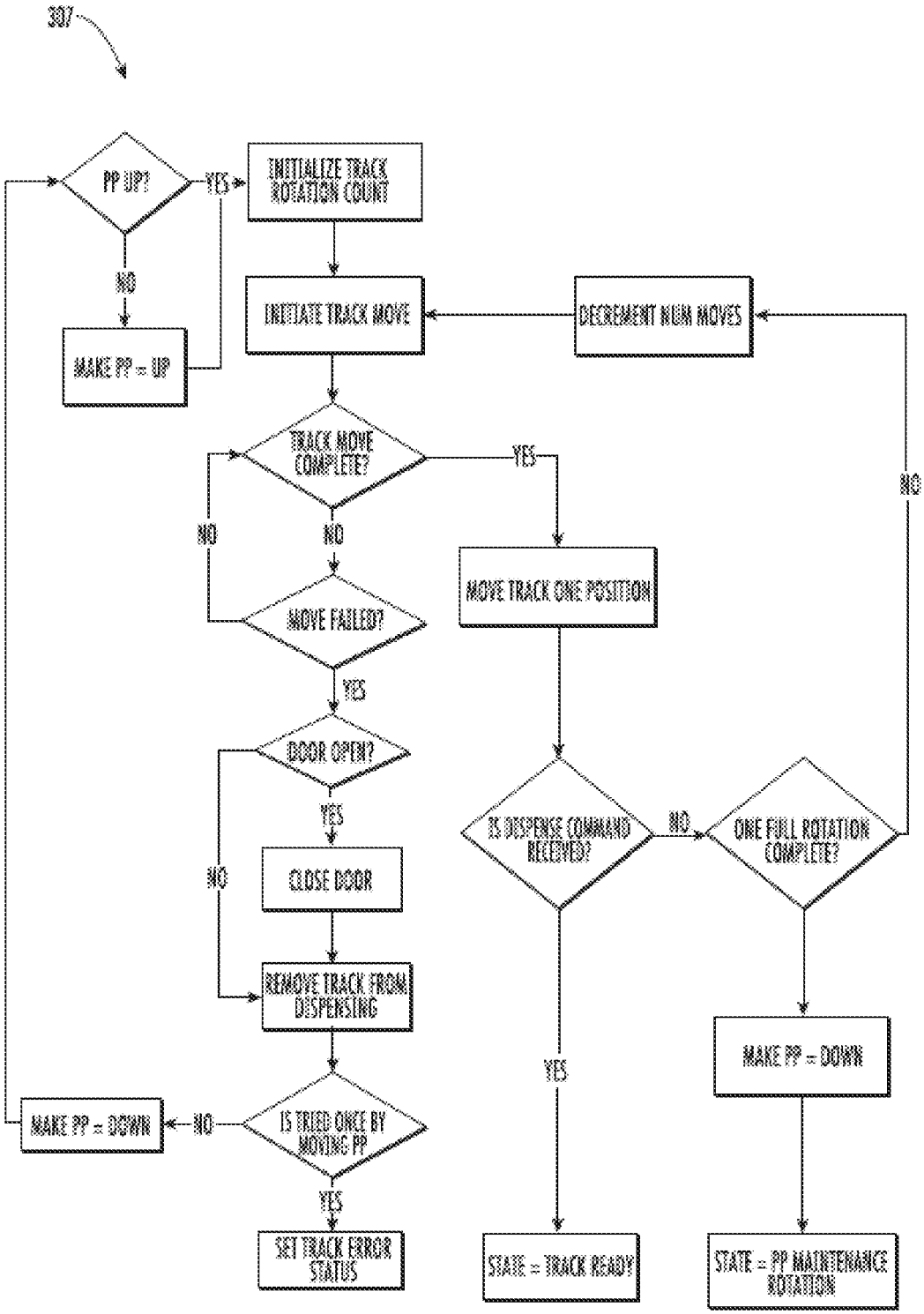

In FIG. 4G, for example, the track maintenance rotation state, "TRACK MAINTENANCE ROTATION" 307, is illustrated. When the conveying mechanism slave state machine 300 is in the track maintenance rotation state, the pressure plate is in a second position in spaced apart relation relative to a top surface of the fluid in the fluid molds and a track door for dispensing solids from the fluid molds is down or closed. The conveying mechanism slave state machine 300 may then execute a subcommand to initialize a track rotation count, as previously described, and then execute a first command and cause the conveying mechanism to move the fluid mold through the solid-production system. If the track is successfully moved one position and a fluid-dispensing mechanism slave state machine, e.g., 203 in FIG. 2, receives a second command from a master state machine (e.g., 201 in FIG. 2) to cause the fluid-dispensing mechanism to initiate dispensing the fluid to the fluid mold, then the conveying mechanism slave state machine can transition back to the track ready state, "TRACK READY" 306.

If the fluid-dispensing mechanism slave state machine does not receive the second command from the master state machine, and a full rotation of the track of the conveying mechanism is complete, the pressure plate slave state machine (e.g., 204 in FIG. 2) can execute a second command to cause arrangement of the pressure plate to be adjacent to the top surface of the fluid in the fluid mold so as to urge the fluid mold into interaction with the cooling block, and the conveying mechanism slave state machine can transition to a pressure plate maintenance rotation state, "PP MAINTENANCE ROTATION" 310.

If the track move has failed, then a solid-dispensing mechanism slave state machine (e.g., 205 in FIG. 1) can execute a first command to cause arrangement of the solid-dispensing mechanism so as not to cause the solid-dispensing mechanism to dispense the loosened solid (i.e., the track door can be closed), if the track door is not already closed. Then, the conveying mechanism slave state machine can execute a first command and cause the conveying mechanism to move the fluid mold through the solid-production system so that the track is removed from dispensing. The pressure plate slave state machine can make one attempt to execute a second command to cause arrangement of the pressure plate to be adjacent to the top surface of the fluid in the fluid mold so as to urge the fluid mold into interaction with the cooling block. If the pressure plate slave state machine tries once to execute the second command, then the conveying mechanism slave state machine can send a signal to the master slave state machine to record the state of the conveying mechanism slave state machine as "TRACK STATUS ERROR".

Referring back to FIG. 3, when the conveying mechanism slave state machine is in the track ready state, "TRACK READY" 306, the master slave state machine may send a second command to the solid-dispensing mechanism slave state machine to cause arrangement of the solid-dispensing mechanism so as to cause the solid-dispensing mechanism to dispense the solid loosened by the solid ejector to the user through the exit port. The solid dispense may be a result of a user request transmitted to the master state machine from a user's interaction with a user interface. The user request for additional solids may be in the form of a request for a specified number of solids (i.e., one solid, two solids, three solids, etc.), which may be input into the user interface upon user interaction therewith. Receipt of the user request at the master state machine can initialize the sending of a subcommand to the solid-dispensing mechanism slave state machine to initialize a solid counter equal to the user-requested number of solids. For example, if the user inputs into the user interface a request for five solids, then the solid counter is set to "5" and each time a solid is dispensed to the user through the exit port, the solid counter is decremented by one. As such, the solid-dispensing mechanism slave state machine may then execute the second command, so as to open the track door so that solids can be dispensed to the exit port through the track door. Then the conveying mechanism slave state machine 300 can transition from the track ready state, "TRACK READY" 306 to the solid dispense waiting state, "TRACK WAIT ON SOLID DISPENSE" 308, described in more detail in FIG. 4H.

Figure 4H:
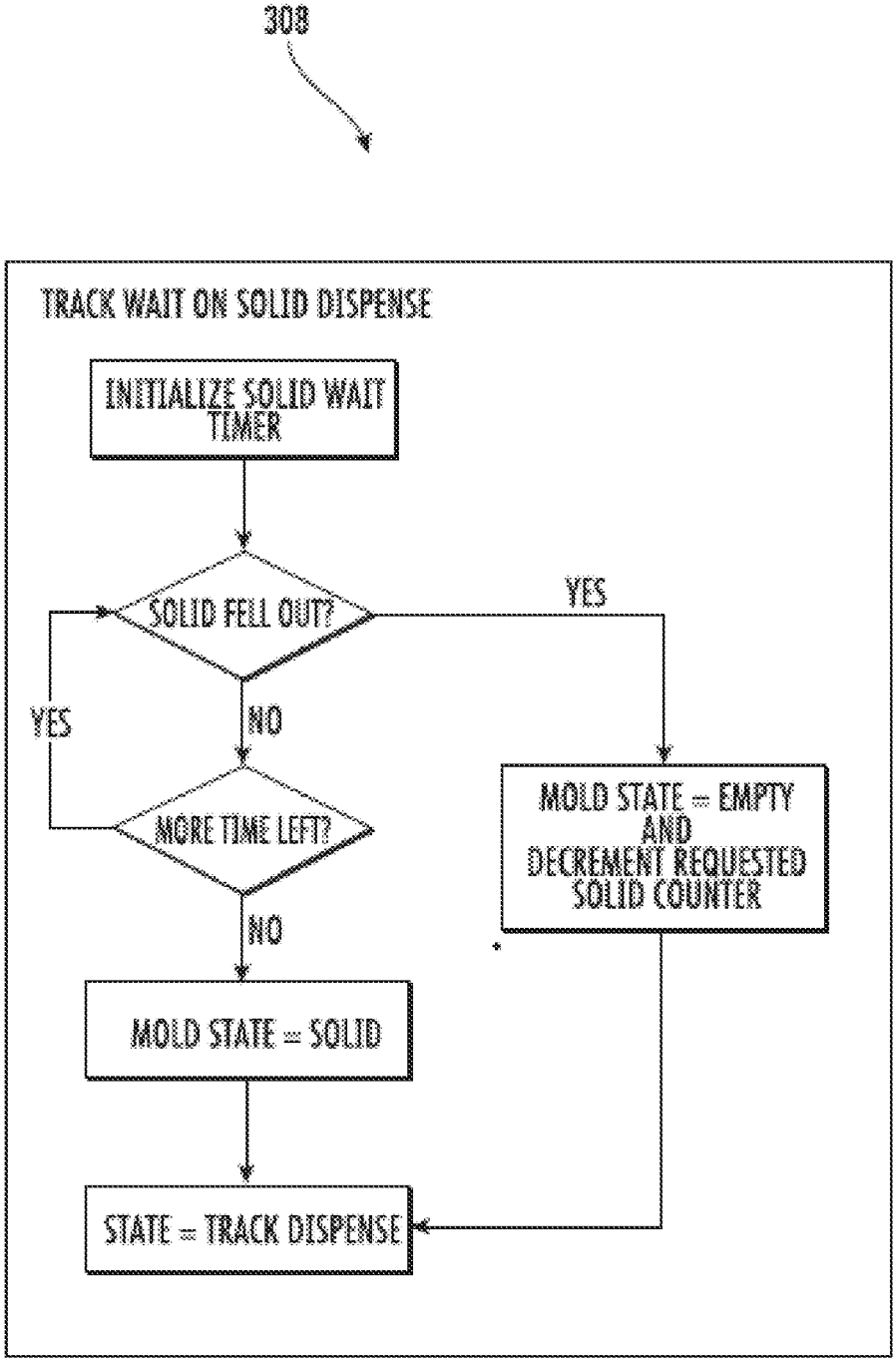
Figure 41:
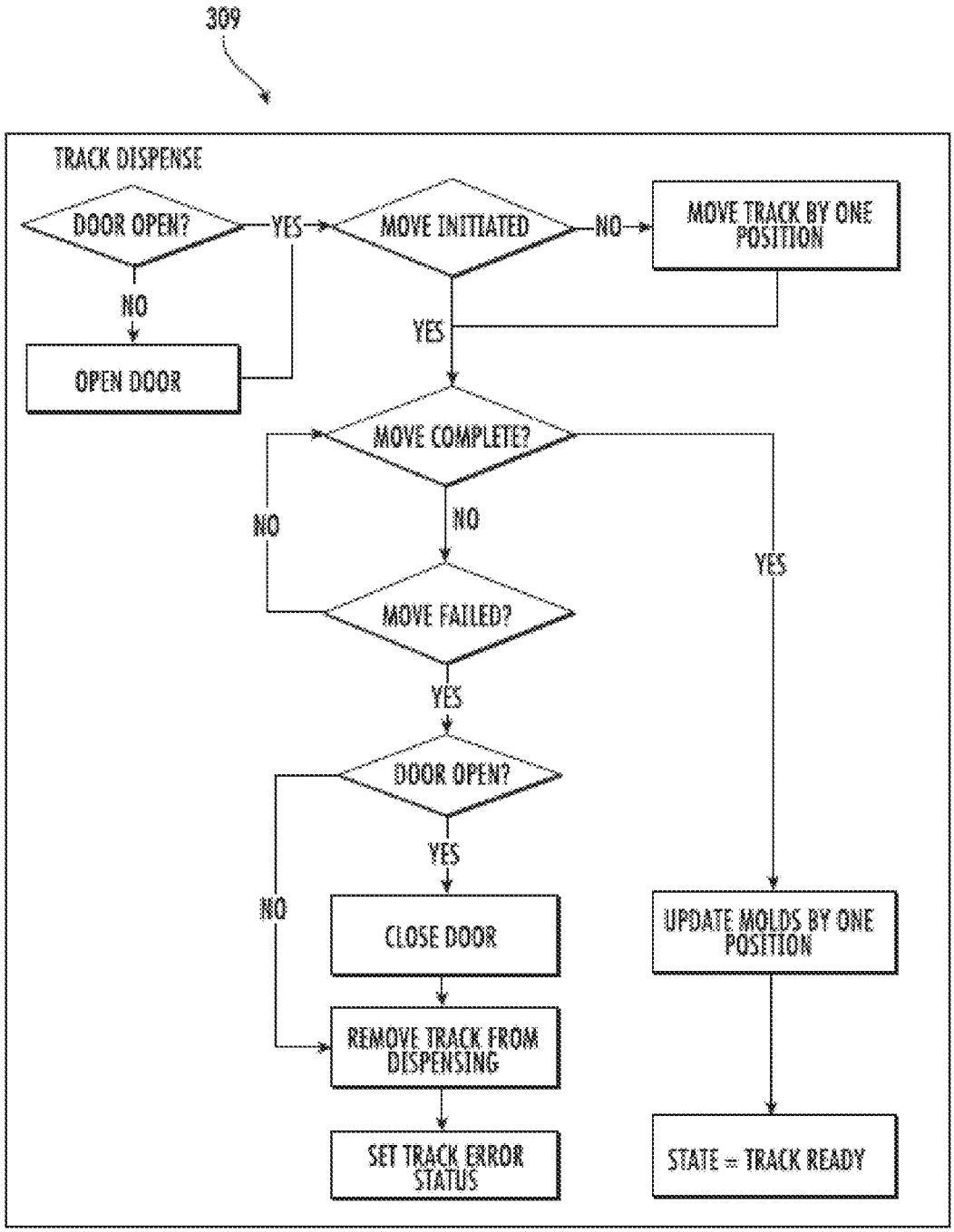

In FIG. 4H, for example, the solid dispense waiting state, "TRACK WAIT ON SOLID DISPENSE" 308 is illustrated. The solid-dispensing mechanism slave state machine, such as the solid-dispensing slave state machine 205 in FIG. 2, may receive subcommands to initialize a solid wait timer to count down from a predetermined solid wait time during which the user-requested number of solids can be dispensed from a fluid mold (e.g., M28 in FIG. 1) in a solid-dispensing position (e.g., P28 in FIG. 1) and a solid counter. The predetermined solid wait time may be 0.5 seconds, 1 second, 2 seconds, etc., which may be determinant on the number of solids requested by the user at the user-interface. However, the predetermined solid wait time may also be less than 0.5 seconds or may be increments smaller than 0.5 or 1 second intervals (e.g., 0.05 seconds, 0.05 seconds, 1.5 seconds, etc.). If the user-requested number of solids is dispensed from the fluid mold in the solid-dispensing position, then the solid-dispensing mechanism can send a signal to the master slave state machine to record the state of the fluid mold in the solid-position as "EMPTY" and can decrement the user-requested solid counter by one. Then, the conveying mechanism slave state machine can transition to a track dispense state, "TRACK DISPENSE" 309.

If the user-requested number of solids is not dispensed from the fluid mold in the solid-dispensing position, then the solid-dispensing mechanism can determine whether or not there is more time left in the predetermined solid wait time. If yes, then the solid-dispensing mechanism slave state machine can remain in a first state defined by the solid-dispensing mechanism being arranged to dispense the solid loosened by the solid ejector to the user through the exit port, and the second state defined by the solid-dispensing mechanism being arranged so as to not dispense the loosened solid. If no, then the solid-dispensing mechanism slave state machine can send a signal to the master slave state machine to record the state of the fluid mold in the solid-dispensing position as "SOLID" and can stop the solid counter. Then, the conveying mechanism slave state machine can transition to a track dispense state, "TRACK DISPENSE" 309, described in more detail in FIG. 4I.

In FIG. 4I, for example, the track dispense state, "TRACK DISPENSE" 309 is illustrated. When the conveying mechanism slave state machine 300 is in the track dispense state, the track door is up or open and the track of the conveying mechanism is moving the fluid molds through the solid-production system. The conveying mechanism slave state machine can receive and execute a first command and cause the conveying mechanism to move the fluid mold through the solid-production system a certain number of positions based on a user-request for a specified number of solids. Track movement may comprise incrementally moving the track by one position in a machine direction so as to transport the fluid molds (e.g., M0-M29 in FIG. 1) through the solid-production system (e.g., 100 in FIG. 1). If track movement is complete (i.e., the user-requested number of solids has been dispensed), then a subcommand may be executed by the conveying mechanism slave state machine and the position of the fluid molds in the solid-production system may be updated (e.g., updated by decremented the number of positions left before the fluid molds return to their initial position), and the conveying mechanism slave state machine can transition back to the track ready state, "TRACK READY" 306.

If track movement is not complete and track movement has failed, the solid-dispensing mechanism slave state machine can receive and execute a first command from the master state machine to cause arrangement of the solid-dispensing mechanism so as not to cause the solid-dispensing mechanism to dispense the loosened solid, such that the track door is closed or down. Then the conveying mechanism slave state machine can receive and execute a second command and cause the conveying mechanism to stop movement of the fluid mold through the solid-production system. Then, the conveying mechanism slave state machine can send a signal to the master slave state machine to record the state of the conveying mechanism slave state machine as "TRACK STATUS ERROR".

Figure 4J:
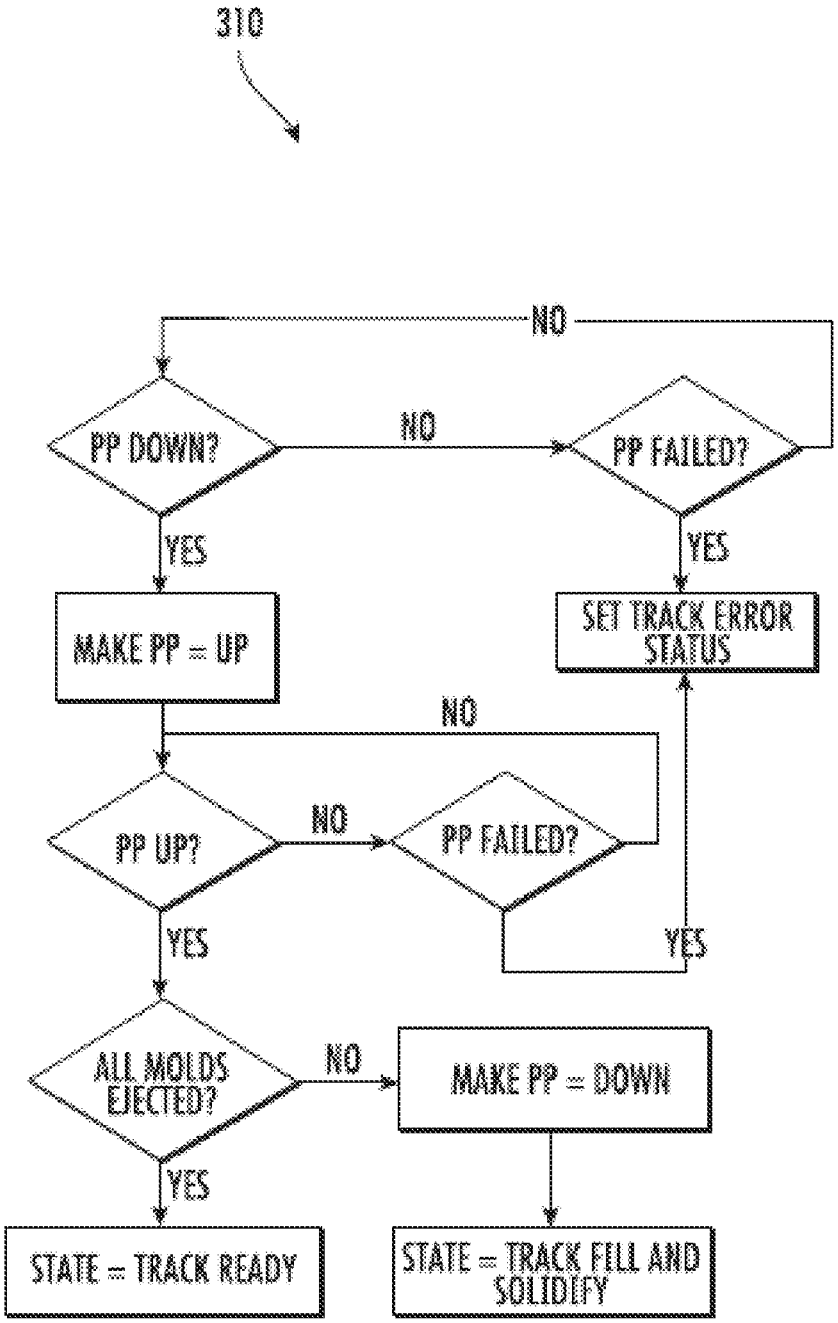

Referring back to FIG. 3, when the conveying mechanism slave state machine is in the track fill and solidify state, "TRACK FILL AND SOLIDIFY" 305 or the track maintenance rotation state, "TRACK MAINTEANCE ROTATION STATE" 307, the conveying mechanism slave state machine my transition to a pressure plate maintenance rotation state, "PP MAINTENANCE ROTATION" 310, as described in more detail in FIG. 4J, if there has been at least two (2) minutes of inactivity as measured by the track maintenance timer and solidification of the fluid in the fluid molds in the cooling region, or if one full rotation of the track of the conveying mechanism is complete.

In FIG. 4J, for example, the pressure plate maintenance rotation state, "PP MAINTENANCE ROTATION" 310 is illustrated. In the pressure plate maintenance rotation state, the pressure plate is in the second position or arranged in a spaced apart relation from the top surface of the fluid in the fluid mold so as not to urge the fluid mold into interaction with the cooling block. If the pressure plate is in the initial position, or arranged adjacent to the top surface of the fluid mold, then the pressure plate slave state machine may then execute a first command to cause arrangement of the pressure plate into second position or spaced apart relation from the top surface of the fluid in the fluid mold so as not to urge the fluid mold into interaction with the cooling block. If execution of the first command fails or the pressure plate remains in the initial position, then the conveying mechanism slave state machine may send a signal to the master slave state machine to record the state of the conveying mechanism slave state machine as "TRACK STATUS ERROR".

If execution of the first command is successful, then the pressure plate slave state machine can execute a subcommand to determine if the number of solids has been ejected by the solid ejector, i.e., has the number of solids requested by the user been loosened in the respective fluid molds for dispensing by the solid-dispensing mechanism to the user. If yes, then the conveying mechanism slave state machine can transition back to the track ready state, "TRACK READY" 306. If not, then the pressure plate slave state machine can receive and execute a second command from the master state machine to cause arrangement of the pressure plate to be adjacent to the top surface of the fluid in the fluid mold so as to urge the fluid mold into interaction with the cooling block, and the conveying mechanism can transition back to a track fill and solidify state, "TRACK FILL AND SOLIDIFY" 305.

Figure 4K:
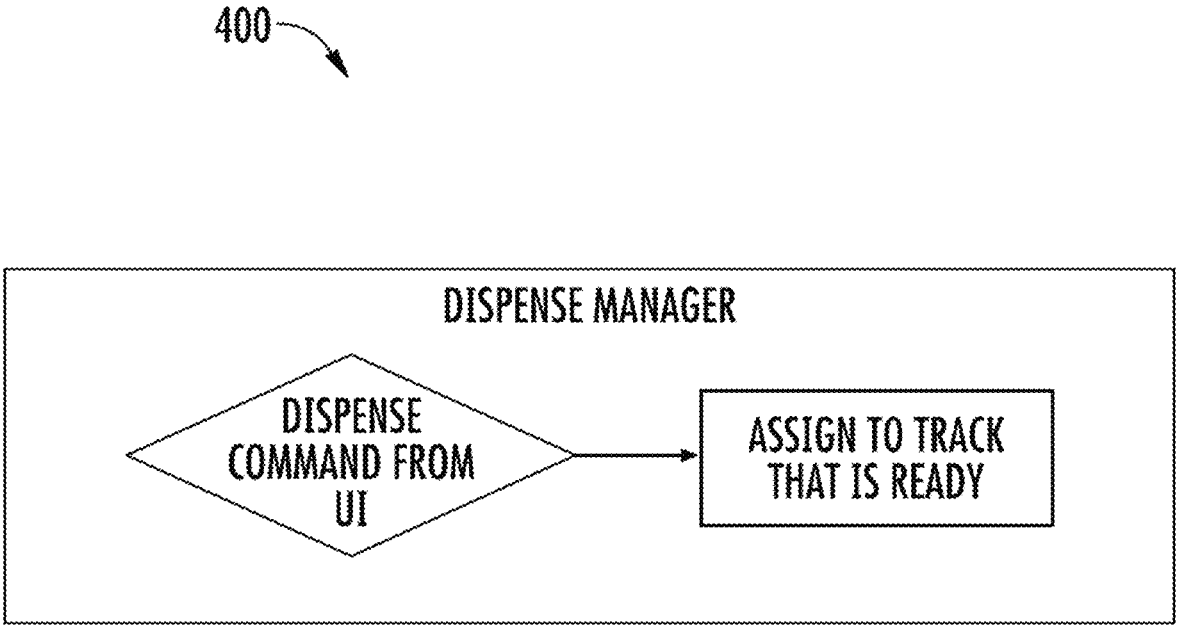
Figure 5:
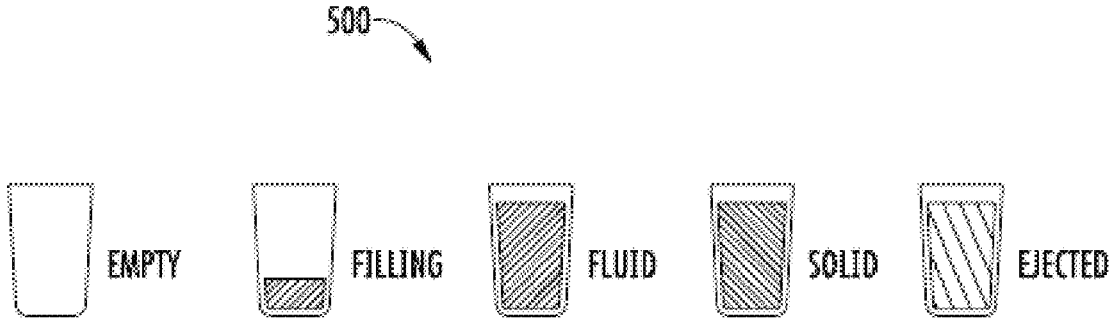
FIG. 5 illustrates a schematic of states of fluid molds according to example implementations of the present disclosure.

Referring now to FIG. 4K, a dispense manager 400, which can be software implemented by the master state machine, is illustrated. The dispense manager can be associated with the user interface, such that any request from the user (e.g., specified number of solids, different volume of solids, and the like) can be transmitted to the dispense manager of the master state machine. The master state machine can then send a subcommand to the conveying mechanism slave state machine (e.g., 202 in FIG. 2) to assign a track of the conveying mechanism, where there is more than one track, to begin rotation in order to dispense the user-requested number of solids. The track can be assigned based on whichever track is in the track ready state, "TRACK READY" 306 in order of incremental track number if there is more than one track (i.e., first track, second track, third track, etc.). FIG. 5 is a schematic 500 illustrating various example states of fluid molds in a solid-production system according to example implementations of the present disclosure. As shown, a fluid mold may have five states: empty, filling, fluid, solid; and ejected. Other states for the fluid molds and/or additional or less states are also contemplated, such as partially solid. The states can be detected by one or more sensing mechanisms associated with the conveying mechanism, the fluid-dispensing mechanism, the pressure plate, or the solid-dispensing mechanism. The states of the fluid molds may be set by one or more sensing mechanisms associated with the conveying mechanism, the fluid-dispensing mechanism, the pressure plate, or the solid-dispensing mechanism, which may be transmitted to the master state machine.

Figure 6A:
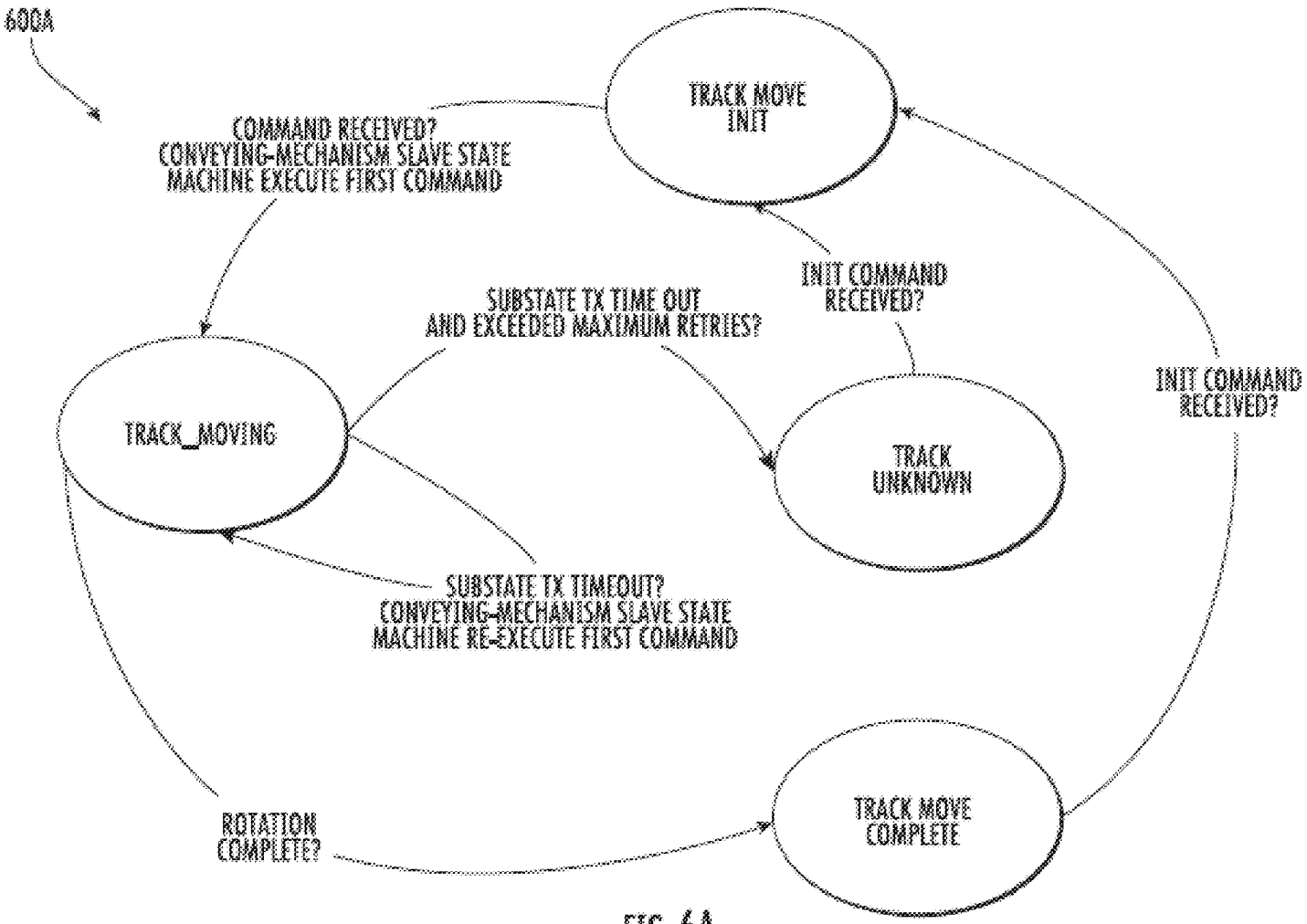
FIGS. 6A and 6B illustrate states and sub-states of a conveying mechanism slave state machine according to example implementations of the present disclosure.
Figure 6B:
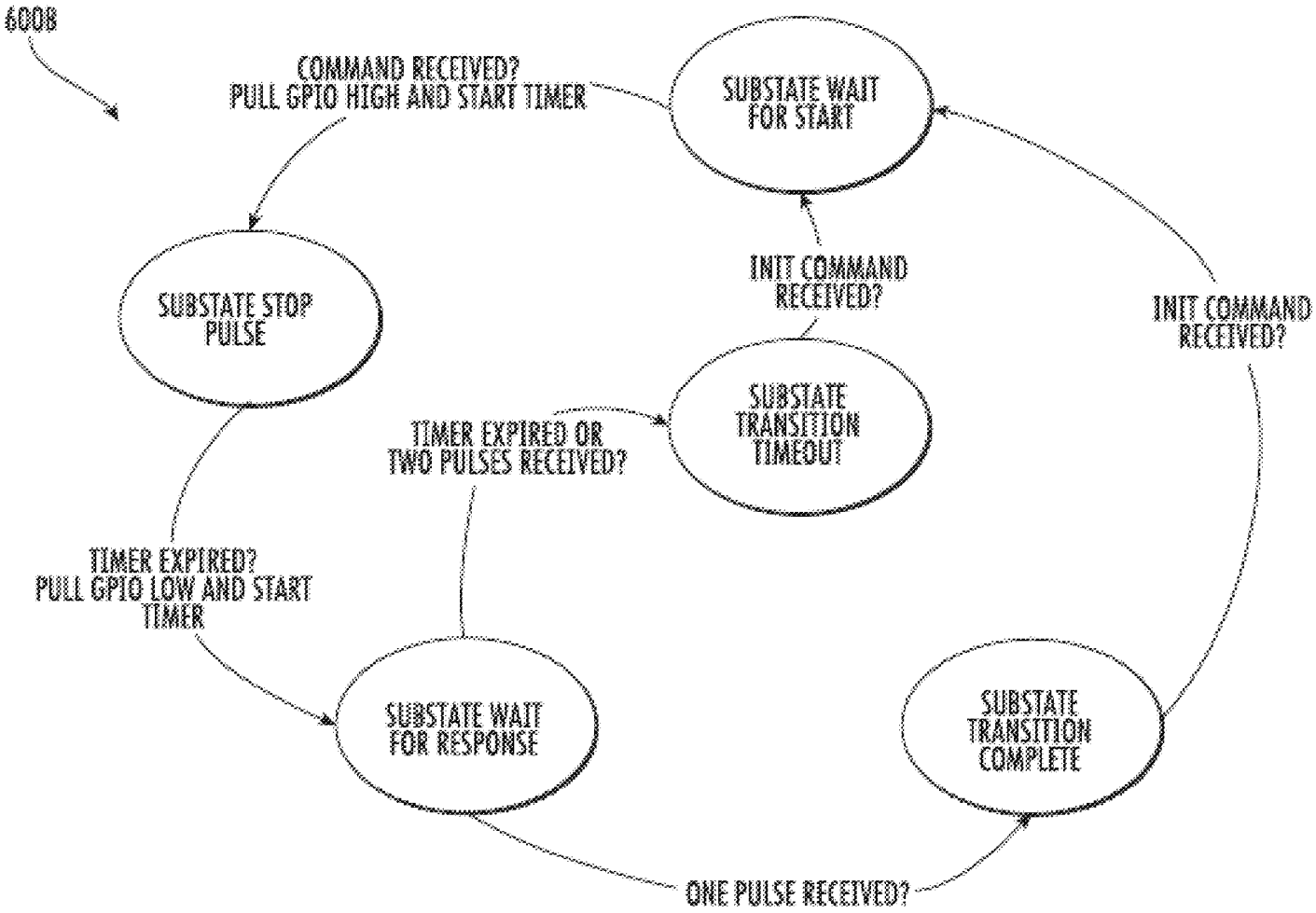

FIGS. 6A and 6B illustrate example states and sub-states of the conveying mechanism slave state machine, according to example implementations of the present disclosure. For example, in FIG. 6A, a schematic 600A is illustrated. In particular, when the conveying mechanism slave state machine is in an initialize track move state, "TRACK MOVE INIT" (e.g., 302 in FIG. 3), the conveying mechanism slave state machine can receive and execute a first command from a master state machine (e.g., 201 in FIG. 2) to transition to the track moving state, "TRACK_MOVING" (e.g., 303 in FIG. 3) so as to cause the conveying mechanism to move the fluid mold through the solid-production system. After track movement is complete, the track moving state, "TRACK_MOVING", can transition to a track move complete sub-state, "TRACK MOVE COMPLETE", indicating that track movement is complete.

As noted herein, in some example implementations, the conveying mechanism slave state machine can use a timer to monitor the track movement. In some instances, timeout may occur when the track is still moving. When timeout occurs and the maximum number of allowed retries is exceeded to move the track (i.e., a specified number of retries that the conveying mechanism slave state machine can try to execute the first command sent by the master state machine), the state "TRACK_MOVING" may transition to a sub-state "TRACK UNKNOWN", indicating an unknown state of the track. The sub-state "TRACK UNKNOWN" may transition to the state "TRACK MOVE INIT" to initialize track movement. In another example, when timeout occurs, the conveying mechanism slave state machine can attempt to re-execute the first command to enter the state "TRACK_MOVING" to enable track movement.

In FIG. 6B, a schematic 600B is illustrated. Upon receiving a command, a GPIO associated with the conveying mechanism slave state machine may be configured as an output such that a particular pin may be turned or "pulled" HIGH so that the voltage may be up to about 3.3 volts (V). The GPIO may comprise one or more uncommitted digital signal pins on an integrated circuit or an electronic circuit board on one of the processors used to the control the conveying mechanism slave state machine. A series of pulses may be generated by the GPIO via pulse width modulation (PWM) and a timing mechanism, e.g., a timer, may be started. The series of pulses may be generated for a period of time, such as, for example between about 3 (three) and about 10 (ten) seconds, or once a number of pulses has been generated, such as, for example, one, two, three, four, etc., pulses and received by one or more co-processors associated with the conveying mechanism slave state machine for controlling track movement and/or a pressure plate slave state machine for controlling pressure plate arrangement.

The conveying mechanism slave state machine may then receive and execute a subcommand from the master state machine to transition to a stop pulse sub-state, "SUB-STATE STOP PULSE", in order to stop generating the series of pulses once the period of time has expired or the number of pulses has been generated. The GPIO may then be configured as an input such that the pin may be turned or pulled "LOW". The voltage may be about zero (0) V to about one (1) V. A series of pulses may be generated by the GPIO via PWM and the timing mechanism may be restarted. The series of pulses may be generated for a period of time, such as, for example between about three (3) seconds and about ten (10) seconds, or once a number of pulses has been generated, such as, for example, one, two, three, four, etc., pulses. The conveying mechanism slave state machine may then receive and execute a subcommand from the master slave state machine to enter the wait for response sub-state, "SUB-STATE WAIT FOR RESPONSE", in order to stop generating the series of pulses once the period of time has expired or the number of pulses has been generated and received by one or more co-processors responsible for controlling track movement and/or pressure plate arrangement.

In the wait for response sub-state "SUB-STATE WAIT FOR RESPONSE," the conveying mechanism slave state machine can determine whether track movement is successfully completed based on a number of pulses received by the co-processors associated with the conveying mechanism slave state machine for controlling track movement.

If the period of time is expired, or the conveying mechanism slave state machine receives two pulses, the conveying mechanism slave state machine may receive and execute a subcommand from the master state machine to transition from the wait for response sub-state "SUB-STATE WAIT FOR RESPONSE" to a transition timeout sub-state "SUB-STATE TRANSITION TIMEOUT". The transition timeout sub-state is defined by the track of the conveying mechanism not being successfully moved the necessary number of positions in the required period of time.

If the co-processor receives one pulse as generated by the GPIO, the conveying mechanism slave state machine may receive and execute a subcommand from the master state machine to transition from the wait for response sub-state, "SUB-STATE WAIT FOR RESPONSE", to the transition complete sub-state, "SUB-STATE TRANSITION COMPLETE". The transition complete sub-state may be defined by the track of the conveying mechanism having successfully moved the fluid molds the necessary number of positions.

When the conveying mechanism slave state machine is in either of the transition timeout sub-state or the transition complete sub-state, the conveying mechanism slave state machine may receive and execute a subcommand from the master state machine to transition from either of these sub-states to the wait for start sub-state "SUB-STATE WAIT FOR START". The wait for start sub-state may be defined by the conveying mechanism receiving and executing a first command and cause the conveying mechanism to move the fluid mold through the solid-production system. Notably, the execution of various commands and subcommands by the conveying mechanism slave state machine so as to transition into one or more sub-states as described in FIGS. 6A and 6B may define one or more states of a conveying mechanism slave state machine. For example, the transitions to various sub-states in FIGS. 6A and 6B may be used in conjunction with and/or define the track rotate state, "TRACK ROTATE" 303 in FIG. 3.

Figure 7:
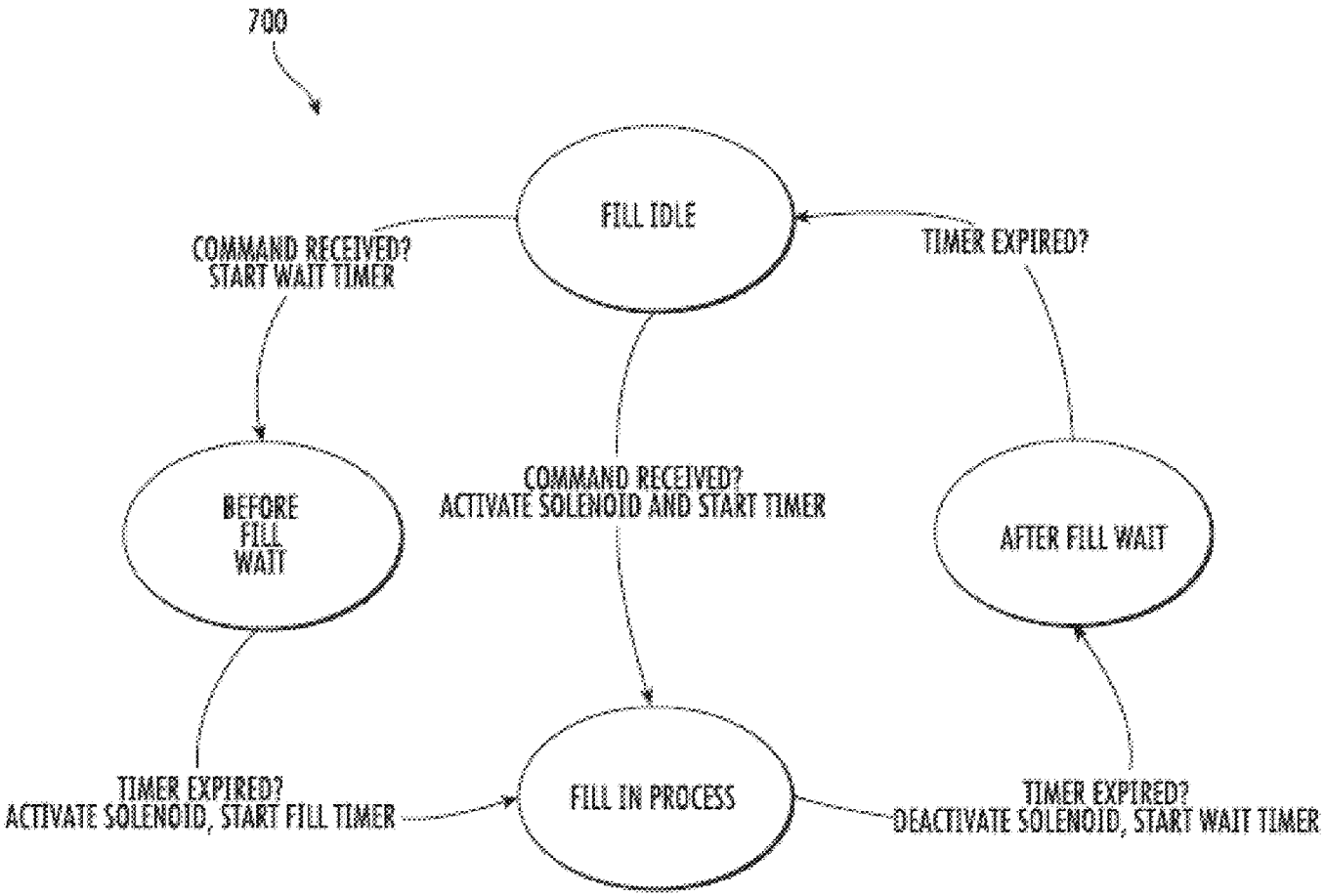
FIG. 7 illustrates a fluid-dispensing mechanism slave state machine according to example implementations of the present disclosure.

FIG. 7 illustrates a fluid-dispensing mechanism slave state machine 700, which may be the same as or similar to the fluid-dispensing mechanism slave state machine 203 according to example implementations of the present disclosure. The fluid-dispensing mechanism slave state machine in FIG. 7 may illustrate one example implementation of the fluid-dispensing mechanism slave state machine 203 described in FIG. 2, which receives commands and/or subcommands from the master state machine based on respective states of the fluid-dispensing mechanism slave state machine. Execution of the commands by the fluid-dispensing mechanism slave state machine may be initiated by the fluid-dispensing mechanism slave state machine after receipt of the commands from the master slave state machine.

In some example implementations, as shown in FIG. 7, the fluid-dispensing mechanism slave state machine 700 may define four different states or sub-states: "FILL IDLE," "FILL IN PROCESS," "BEFORE FILL WAIT" and "AFTER FILL WAIT" indicating different states of the fluid-dispensing mechanism. A timing mechanism, such as a timer, can be used in the fluid-dispensing mechanism slave state machine to control transitions between the states or sub-states.

For example, upon receiving a subcommand from the master slave state machine, the fluid-dispensing mechanism slave state machine 700 can execute the subcommand and start a wait timer so as to transition to a before fill wait sub-state, "BEFORE FILL WAIT". When the wait timer expires, the fluid-dispensing mechanism slave state machine can send a signal to the master state machine, which can then send a second command to the fluid-dispensing mechanism slave state machine to cause the fluid-dispensing slave state mechanism to transition to a first state, "FILL IN PROCESS", defined by the fluid-dispensing mechanism dispensing the fluid to a fluid mold in a fluid-dispensing position relative to the fluid-dispensing mechanism (e.g., P0 in FIG. 1). In particular, the fluid-dispensing mechanism slave state machine can execute the second command to activate a valve mechanism, e.g., a solenoid, of the fluid-dispensing mechanism and start a fill timer.

After the fill timer is expired, the fluid-dispensing mechanism slave state machine can receive and execute a first command from the master state machine to cause the fluid-dispensing mechanism to stop dispensing the fluid to the fluid mold. In particular, the fluid-dispensing mechanism slave state machine can deactivate the valve mechanism and start the wait timer. The fluid-dispensing mechanism slave state machine can then transition from the first state, "FILL IN PROCESS", to the after fill wait sub-state, "AFTER FILL WAIT". After the wait timer has expired, the fluid-dispensing mechanism slave state machine can receive and execute a first command from the master state machine to cause the fluid-dispensing mechanism to stop dispensing the fluid to the fluid mold in the dispensing position, so as to transition from the after fill wait sub-state, "AFTER FILL WAIT" to the second state, "FILL IDLE", defined by the fluid-dispensing mechanism not dispensing the fluid to the fluid mold.

Figure 8:
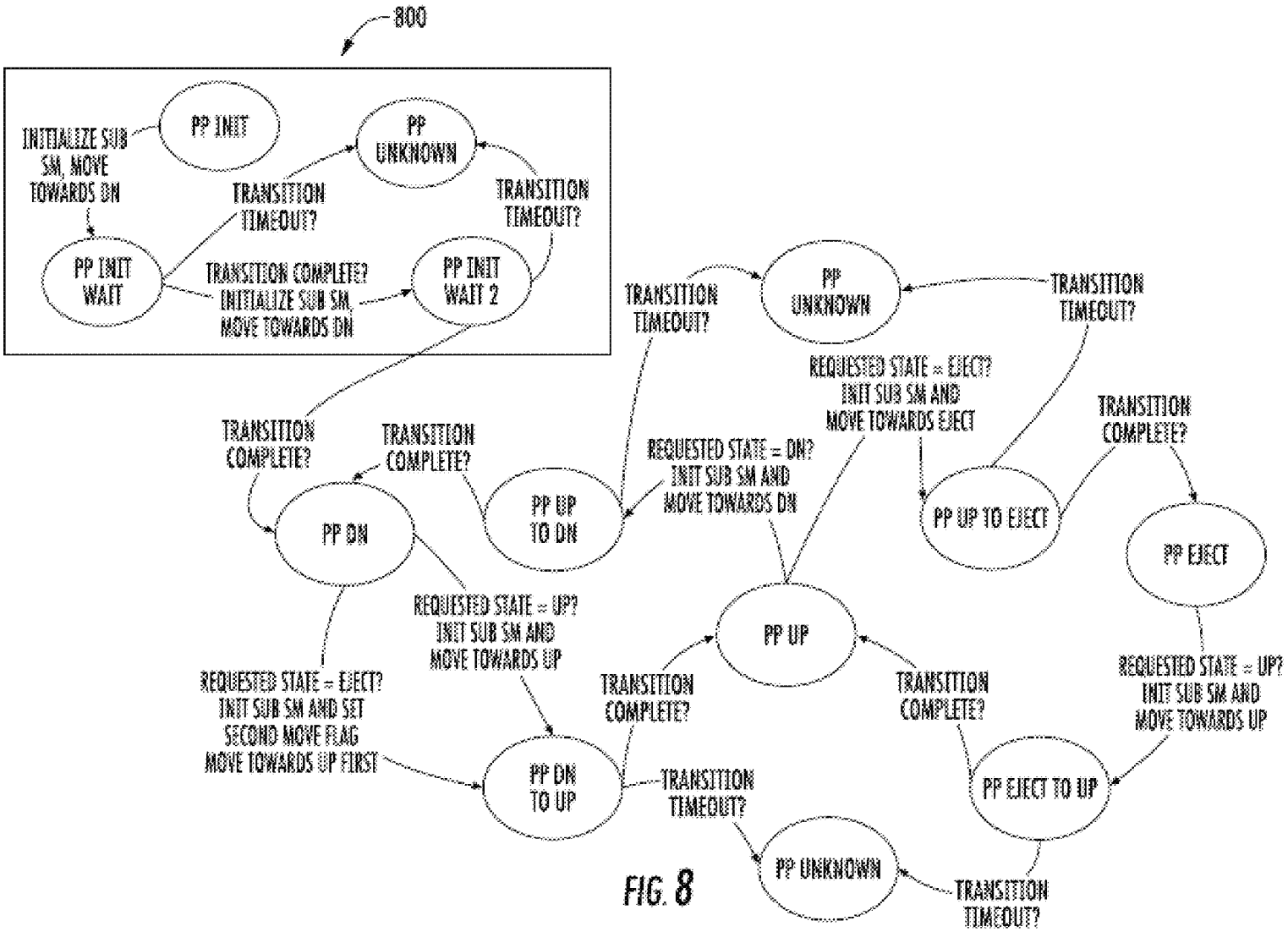
FIG. 8 illustrates a pressure plate slave state machine according to example implementations of the present disclosure.

FIG. 8 illustrates a schematic of an example implementation of a pressure plate state machine 800, which may be the same as or similar to the pressure plate slave state machine 204 in FIG. 2, according to example implementations of the present disclosure. The pressure plate slave state machine in FIG. 8 may illustrate one example implementation of the pressure slave state machine described in FIG. 2, which receives commands and/or subcommands from the master state machine based on respective states of the pressure plate slave state machine. Execution of the commands by the pressure plate slave state machine may be initiated by the pressure plate slave state machine after receipt of the commands from the master slave state machine.

For example, as shown in FIG. 8, when the pressure plate is arranged in an initial position, i.e., arranged adjacent to a top surface of a fluid mold as a result of a normal biasing force exerted on a top surface of the pressure plate by a biasing mechanism, then the pressure plate slave state machine 800 may be in a first state defined by the pressure plate being arranged adjacent to a top surface of the fluid in the fluid mold so as to urge the fluid mold into interaction with the cooling block.

In the first state, the pressure plate slave state machine may receive a first command that initiates a series of subcommands from a master state machine, such as master state machine 201 in FIG. 2, to cause the pressure plate slave state machine to transition to a second state or another state or sub-state. Likewise, where the pressure plate slave state machine is in the second state, the pressure plate slave state machine may receive a second command that initiates a series of subcommands from a master state machine to cause the pressure plate slave state machine to transition back to the first state or another state or sub-state.

In some example implementations, subcommands may define parameters of the first or second command sent by the master state machine to the pressure plate slave state machine 800, such that execution of the subcommands may be initiated by the pressure plate slave state machine after receipt of the first or second command from the master state machine. Completion of the first or second command and/or subcommands may then result in the transition of the pressure plate slave state machine between the first state and the second state or to another state through a series of sub-states.

In particular, the pressure plate slave state machine 800, may be in an initialization state, "PP INIT". The pressure plate slave state machine may receive and execute a subcommand from the master state machine to transition from the initialization state, "PP INIT" to a wait sub-state, "PP INIT WAIT." If the transition from the initialization state, "PP INIT" to the wait sub-state, "PP INIT WAIT" takes longer than a predetermined amount of time (e.g., longer than one minute, two minutes, three minutes, etc.), then pressure slave state machine may receive and execute a subcommand from the master slave state machine to transfer to an unknown sub-state, "PP UNKNOWN."

If the transition is complete, then the pressure plate slave state machine 800 may receive and execute a second command to cause arrangement of the pressure plate to be adjacent to the top surface of the fluid in the fluid mold so as to urge the fluid mold into interaction with the cooling block, i.e., the initial state. In particular, the pressure plate slave state machine may actuate an actuation mechanism so as to move the pressure plate into the initial state. Then the pressure plate slave state machine may transition to the second wait sub-state, "PP INIT WAIT 2." If the transition from the second wait sub-state, "PP INIT WAIT 2", takes longer than the predetermined amount of time, then pressure slave state machine may receive and execute a subcommand from the master slave state machine to transfer to the unknown sub-state, "PP UNKNOWN." Otherwise, if the transition is complete, the conveying mechanism slave state machine can transition to a first state, "PP DN" defined by the pressure plate being arranged adjacent to a top surface of the fluid in the fluid mold so as to urge the fluid mold into interaction with the cooling block. The first state assists in more efficient solidification of the fluid in the fluid molds in the cooling region relative to the cooling block.

If the pressure plate is requested to be in the second state, "UP", then the pressure plate slave state machine may receive and execute a first command so as to transition to the second state, defined by the pressure plate being arranged in a spaced apart relation from the top surface of the fluid in the fluid mold so as not to urge the fluid mold into interaction with the cooling block. Upon receiving the first command from the master state machine, the pressure plate slave state machine may cause arrangement of the pressure plate into the spaced apart relation from the top surface of the fluid in the fluid mold so as not to urge the fluid mold into interaction with the cooling block, and transition to the down to up sub-state, "PP DN TO UP". A signal may be sent from the pressure plate slave state machine to the master state machine to indicate that the transition from the first state to the second state.

If the pressure plate is requested to be in a eject or ejection state, "EJECT", then the pressure plate slave state machine may receive and execute a command so as to transition to the eject state, defined by the pressure plate being arranged in a spaced apart relation from the top surface of the fluid in the fluid mold so as not to urge the fluid mold into interaction with the cooling block, where in the eject state the pressure plate is arranged in a spaced apart relation from the top surface of the fluid in the fluid mold a greater distance than in the second state. Upon receiving the command from the master state machine, the pressure plate slave state machine may cause arrangement of the pressure plate into the eject state, and transition to the down to up sub-state, "PP DN TO UP". A signal may be sent from the pressure plate slave state machine to the master state machine to indicate the transition between the states.

In the down to up sub-state, "PP DN TO UP", the pressure plate slave state machine may receive and execute a subcommand from the master state machine to transition from the down to up sub-state to the second state, "PP UP", if the transition from the first state to the second state is complete. If the transition from the first state to the second state times out (i.e., the pressure plate does not transition to the second state within a predetermined period of time), then the pressure plate slave state machine may receive and execute a subcommand from the master state machine to transition to the unknown sub-state, "PP UNKNOWN".

In the second state, "PP UP", the conveying mechanism slave state machine may receive and execute a subcommand to transition to an up to down sub-state, "PP UP TO DN", where the pressure plate slave state machine is requested to be in the first state, "PP DN". In the up to down sub-state, the pressure plate slave state machine may receive and execute a second command so as to transition to the first state, defined by the pressure plate being arranged adjacent to a top surface of the fluid in the fluid mold so as to urge the fluid mold into interaction with the cooling block. Upon receiving the second command from the master state machine, the pressure plate slave state machine may cause arrangement of the pressure plate to be adjacent to the top surface of the fluid in the fluid mold so as to urge the fluid mold into interaction with the cooling block, and may transition to the up to down sub-state, "PP UP TO DN". A signal may be sent from the pressure plate slave state machine to the master state machine to indicate that the transition from the second state to the first state.

In the up to down sub-state, "PP UP TO DN", the pressure plate slave state machine may receive and execute a subcommand from the master state machine to transition from the up to down sub-state to the first state, "PP DN", if the transition from the second state to the first state is complete. If the transition from the second state to the first state times out (i.e., the pressure plate does not transition to the first state within a predetermined period of time), then the pressure plate slave state machine may receive and execute a subcommand from the master state machine to transition to the unknown sub-state, "PP UNKNOWN".

Further, in the second state, "PP UP", the conveying mechanism slave state machine may receive and execute a subcommand to transition to an up to eject sub-state, "PP UP TO EJECT", where the pressure plate is requested to be in the eject sub-state, "EJECT". In the up to eject sub-state, the pressure plate slave state machine may receive and execute subcommand so as to transition to an eject state, defined by the actuation mechanism interacting with the solid ejector to move it into an ejection position. Upon receiving the subcommand from the master state machine, the pressure plate slave state machine may cause interaction of the actuation mechanism with the solid ejector to move it into an ejection position, and a signal may be sent from the pressure plate slave state machine to the master state machine to indicate that the transition from the first state to the eject state.

If the transition is complete, then the pressure plate slave state machine 800 may transition to the eject state, "PP EJECT", where a fluid mold in the ejection position is ejected (or loosened) by the solid ejector. In particular, the pressure plate slave state machine may actuate an actuation mechanism to eject the solid in the ejection position. If the transition takes longer than the predetermined amount of time, then pressure slave state machine may receive and execute a subcommand from the master slave state machine to transfer to the unknown sub-state, "PP UNKNOWN."

If the pressure plate is requested to be in the second state, "UP", then the pressure plate slave state machine may receive and execute a first command so as to transition to the second state, defined by the pressure plate being arranged in a spaced apart relation from the top surface of the fluid in the fluid mold so as not to urge the fluid mold into interaction with the cooling block. Upon receiving the first command from the master state machine, the pressure plate slave state machine may cause arrangement of the pressure plate into the spaced apart relation from the top surface of the fluid in the fluid mold so as not to urge the fluid mold into interaction with the cooling block, and transition to the eject to up sub-state, "PP EJECT TO UP". A signal may be sent from the pressure plate slave state machine to the master state machine to indicate that the transition from the eject state to the second state.

In the eject to up sub-state, "PP EJECT TO UP", the pressure plate slave state machine may receive and execute a command from the master state machine to transition from the eject state to the second state, "PP UP", if the transition from the eject state to the second state is complete. If the transition from the eject state to the second state times out (i.e., the pressure plate does not transition to the second state within a predetermined period of time), then the pressure plate slave state machine may receive and execute a subcommand from the master state machine to transition to the unknown sub-state, "PP UNKNOWN".

Figure 9:
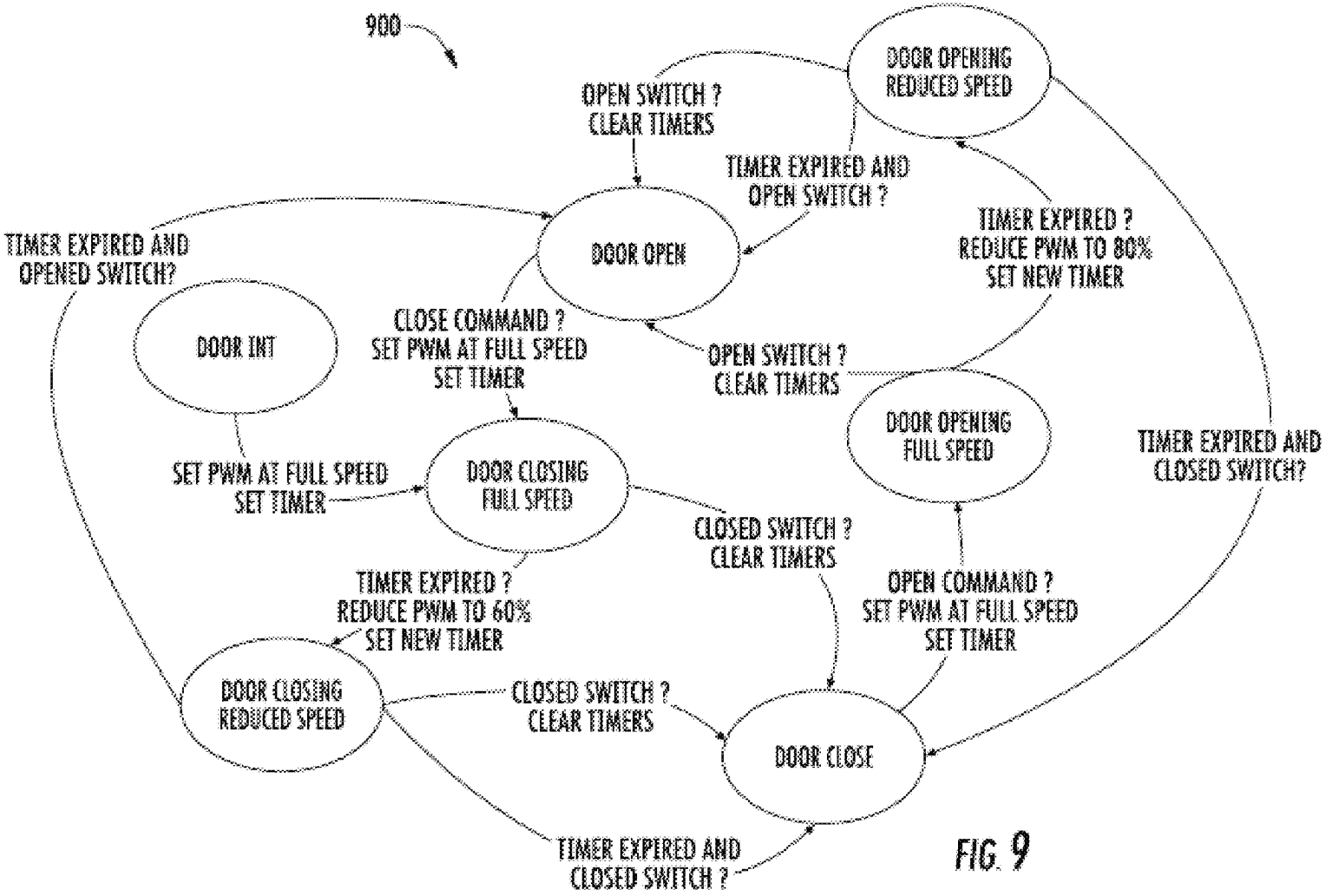
FIG. 9 illustrates a solid-dispensing mechanism slave state machine according to example implementations of the present disclosure.

FIG. 9 illustrates a solid-dispensing mechanism slave state machine 900, which may be the same as or similar to the solid-dispensing mechanism slave state machine 205 in FIG. 2 according to example implementations of the present disclosure. The solid-dispensing mechanism slave state machine in FIG. 9 may illustrate one example implementation of the solid-dispensing mechanism slave state machine described in FIG. 2, which receives commands and/or subcommands from the master state machine based on respective states of the solid-dispensing mechanism slave state machine. Execution of the commands by the solid-dispensing mechanism slave state machine may be initiated by the solid-dispensing mechanism slave state machine after receipt of the commands from the master slave state machine.

For example, as shown in FIG. 9, the solid-dispensing mechanism slave state machine 900 may be in an initialization state, "DOOR INIT". In some example implementations, after the track door is initialized in in the initialization state, "DOOR INIT", the solid-dispensing mechanism slave state machine 900 can receive and execute a set of subcommands from the master state machine to set the PWM of a GPIO to transmit a series of pulses to control the motors for track door control at one hundred percent (100%) of the full speed of the motors and set a timing mechanism, such as a timer, to control the speed of closing the track door. The solid-dispensing mechanism slave state machine may then receive and execute a subcommand from the master state machine to transition from the initialization state, "DOOR INIT" to a door closing at full speed sub-state, "DOOR CLOSING FULL SPEED."

In the door closing at full speed sub-state, "DOOR CLOSING FULL SPEED", the solid-dispensing mechanism slave state machine 900 can receive and execute a first command to cause arrangement of the solid-dispensing mechanism so as not to cause the solid-dispensing mechanism to dispense the loosened solid, i.e., the motors can control the closing of the track door at the full speed so that the solid-dispensing mechanism slave state machine is in a second state defined by the solid-dispensing mechanism being arranged so as to not dispense the loosened solid. If the transition of the solid-dispensing mechanism slave state machine from the door closing at full speed sub-state to the second state is successful, then the solid-dispensing mechanism slave state machine can clear the timer and transition to the second state, "DOOR CLOSE". If the transition of the solid-dispensing mechanism slave state machine from the door closing at full speed sub-state to the second state is not successful during the time period (i.e., the timer expires), then the solid-dispensing mechanism slave state machine can receive and execute a subcommand from the master state machine to set the PWM associated therewith to transmit a series of pulses to control the motors at a reduced speed, such as at 60% of the full speed and reset the timer to control the speed of closing the track door at the reduced speed. The solid-dispensing mechanism slave state machine can then transition from the door closing at full speed sub-state, "DOOR CLOSING FULL SPEED", to the door closing at reduced speed sub-state, "DOOR CLOSING REDUCED SPEED". In the door closing at reduced speed sub-state, the motors can control the closing of the door at a reduced speed.

In some example implementations, the solid-dispensing mechanism slave state machine 900 can activate a switch mechanism connected to the GPIO that is configured to control closing of the track door by deactivating the switch mechanism so as to cause a low signal or low state to be transmitted to the processor on the GPIO. The solid-dispensing mechanism slave state machine can clear timers and can transition from the door closing at reduced speed sub-state "DOOR CLOSING REDUCED SPEED" to the second state, "DOOR CLOSE". In another example, the solid-dispensing mechanism slave state machine can clear timers and can transition from the door closing at reduced speed sub-state "DOOR CLOSING REDUCED SPEED" state to the second state, "DOOR CLOSE", when the switch is activated or the timer is expired. A sensing mechanism located proximate to the track door may be configured to detect whether the track door is successfully closed or not. When the track door is closed, it may indicate that there is no solid to be dispensed at the solid-dispensing position (e.g., P28 in FIG. 1).

In some example implementations, when the solid-dispensing mechanism slave state machine 900 is in the second state, "DOOR CLOSE," the solid-dispensing mechanism slave state machine may receive and execute a second command to cause arrangement of the solid-dispensing mechanism so as to cause the solid-dispensing mechanism to dispense the solid loosened by the solid ejector to the user through the track door to the exit port. In particular, the solid-dispensing mechanism slave state machine may receive and execute the second command from the master state machine to open the track door, and subcommands from the master state machine to set the PWM of the GPIO to control the motors at a full speed and set the timer to control the speed of opening the track door at the full speed. The solid-dispensing mechanism slave state machine can transition from the second state, "DOOR CLOSE", to a door opening at full speed sub-state, "DOOR OPENING FULL SPEED".

In the door opening at full speed sub-state, "DOOR OPENING FULL SPEED", the motors can control the closing of the door at the full speed. In another example, when the timer is expired, the solid-dispensing mechanism slave state machine can receive and execute a subcommand to set PWM to control the motors at a reduced speed, such as at 80% of the full speed, and reset the timer to control the speed of opening the track door at the reduced speed. The solid-dispensing mechanism slave state machine can then transition from the door opening at full speed sub-state, "DOOR OPENING FULL SPEED", to the door opening at reduced speed sub-state, "DOOR OPENING REDUCED SPEED", where the motors can control the closing of the door at the reduced speed.

In some example implementations, the solid-dispensing mechanism slave state machine 900 may receive and execute a subcommand from the master state machine to activate another switch connected to the GPIO, which may control opening the track door by opening the switch so as to cause a low signal or low state to be transmitted to the processor on the GPIO. The solid-dispensing mechanism slave state machine can receive and execute another subcommand to clear timers. Further, the solid-dispensing mechanism can receive and execute a second command to cause arrangement of the solid-dispensing mechanism so as to cause the solid-dispensing mechanism to dispense the solid loosened by the solid ejector to the user through the exit port, so that the solid-dispensing mechanism slave state machine can transition from the door opening at reduced speed sub-state, "DOOR OPENING FULL SPEED", to the first state, "DOOR OPEN".

In a further example, the solid-dispensing mechanism slave state machine 900 can receive and execute a subcommand from the master state machine to clear timers so as to transition from the door opening at reduced speed sub-state, "DOOR OPENING REDUCED SPEED", to the first state, "DOOR OPEN", when the other switch is activated or the timer is expired. A sensing mechanism located proximate to the track door may be configured to detect whether the track door is successfully opened or not. When the solid-dispensing mechanism is arranged to dispense the solid loosened by the solid ejector to the user through the exit port, i.e., track door is open or in the first state, the sensing mechanism may indicate that there is solid to be dispensed at the solid-dispensing position.

In some implementations, when the timer is expired and the other switch controlling opening the track door is activated, the solid-dispensing mechanism slave state machine can transition from the door closing at reduced speed sub-state, "DOOR CLOSING REDUCED SPEED", to the first state, "DOOR OPEN". In another example, when the timer is expired and the switch controlling closing of the track door is activated, the solid-dispensing mechanism slave state machine can transition from the door opening at reduced speed sub-state "DOOR OPENING REDUCED SPEED", to the second state "DOOR CLOSE".

In some example implementations, when the solid-dispensing mechanism slave state machine 900 is in the first state, "DOOR OPEN," the solid-dispensing mechanism slave state machine may receive and execute a first command to cause arrangement of the solid-dispensing mechanism so as not to cause the solid-dispensing mechanism to dispense the loosened solid, i.e., close the track door. In particular, for example, the solid-dispensing mechanism slave state machine can set the PWM of the GPIO to control the motors at full speed and set the timer to control the speed of closing the track door at full speed. The solid-dispensing mechanism slave state machine can then transition from the first state, "DOOR OPEN", to the door closing at full speed sub-state, "DOOR CLOSING FULL SPEED". For example, after the solid is dispensed to the user at the solid-dispensing position, the solid-dispensing mechanism slave state machine can receive the first command to cause arrangement of the solid-dispensing mechanism so as not to cause the solid-dispensing mechanism to dispense the loosened solid, i.e., close the track door.

In some example implementations, when the solid-dispensing mechanism slave state machine is in the first state, i.e., the track door is open, a user-requested number of solids can be dispensed to the user or consumer through the track door, as described above. After the user-requested number of solids is dispensed to the user, then the solid-dispensing mechanism slave state machine 900 may receive and execute a first command to cause arrangement of the solid-dispensing mechanism so as not to cause the solid-dispensing mechanism to dispense the loosened solid, i.e., close the track door. In some example implementations, when the track is still moving and not ready for the solid to be dispensed, the GPIOs of the two switches associated with the solid-dispensing mechanism slave state machine may be "HIGH". When the GPIOs are "HIGH", no solid may be dispensed to the user.

Figure 10:
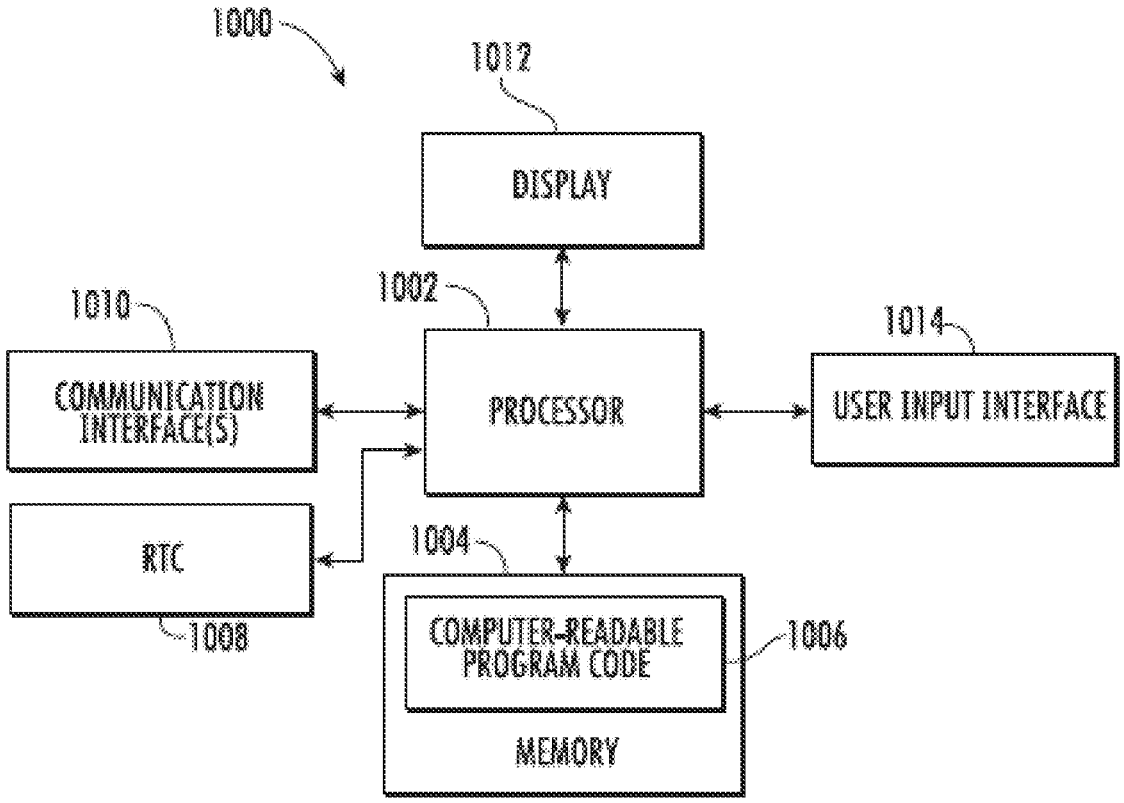
FIG. 10 illustrates an apparatus according to some example implementations.

FIG. 10 illustrates an apparatus 1000 according to some example implementations of the present disclosure. In some examples, the apparatus may include the one or more processors and motors to implement the state machines as described above. As shown, the apparatus may include one or more of each of a number of components such as, for example, a processor 1002 connected to a memory 1004.

The processor 1002 is generally any piece of computer hardware that is capable of processing information such as, for example, data, computer-readable program code, instructions or the like (at times generally referred to as "computer programs," e.g., software, firmware, etc.), and/or other suitable electronic information. The processor is composed of a collection of electronic circuits some of which may be packaged as an integrated circuit or multiple interconnected integrated circuits (an integrated circuit at times more commonly referred to as a "chip"). The processor may be configured to execute computer programs, which may be stored onboard the processor or otherwise stored in the memory 1004 (of the same or another apparatus). In other examples, the processor may be embodied as or otherwise include one or more application-specific integrated circuits (ASICs), field-programmable gate arrays (FPGAs) or the like. Thus, although the processor may be capable of executing a computer program to perform one or more functions, the processor of various examples may be capable of performing one or more functions without the aid of a computer program.

The memory 1004 is generally any piece of computer hardware that is capable of storing information such as, for example, data, computer programs (e.g., computer-readable program code 1006) and/or other suitable information either on a temporary basis and/or a permanent basis. The memory may include volatile and/or non-volatile memory, and may be fixed or removable. Examples of suitable memory include random access memory (RAM), read-only memory (ROM), a hard drive, a flash memory, a thumb drive or the like. In various instances, the memory may be referred to as a computer-readable storage medium. The computer-readable storage medium is a non-transitory device capable of storing information, and is distinguishable from computer-readable transmission media such as electronic transitory signals capable of carrying information from one location to another. Computer-readable medium as described herein may generally refer to a computer-readable storage medium or computer-readable transmission medium.

In addition to the memory 1004, the processor 1002 may also be connected to a real-time clock (RTC) 1008 configured to keep be set to and keep the current standard time. In addition, the processor may be connected to one or more interfaces for displaying, transmitting and/or receiving information. The interfaces may include a communications interface 1010 and/or one or more user interfaces. In some examples, particularly in instances in which the apparatus 1000 is configured to implement a network interface unit (NIU), the apparatus may not include a separate user interface, and may instead interact with one provided by the appliance. The communications interface may be configured to transmit and/or receive information, such as to and/or from other apparatus(es), network(s) or the like. The communications interface may be configured to transmit and/or receive information by physical (wired) and/or wireless communications links. Examples of suitable communication interfaces include a network interface controller (NIC), wireless NIC (WNIC) or the like.

The user interfaces may include a display 1012 and/or one or more user input interfaces 1014. The display may be configured to present or otherwise display information to a user, suitable examples of which include a liquid crystal display (LCD), light-emitting diode display (LED), plasma display panel (PDP) or the like. The user input interfaces may be wired or wireless, and may be configured to receive information from a user into the apparatus, such as for processing, storage and/or display. Suitable examples of user input interfaces include a microphone, image or video capture device, keyboard or keypad, mouse, joystick, touch-sensitive surface (e.g., touchpad, touchscreen), biometric sensor or the like.

As indicated above, program code instructions may be stored in memory, and executed by a processor, to implement functions described herein. As will be appreciated, any suitable program code instructions may be loaded onto a computer or other programmable apparatus from a computer-readable storage medium to produce a particular machine, such that the particular machine becomes a means for implementing the functions specified herein. These program code instructions may also be stored in a computer-readable storage medium that can direct a computer, a processor or other programmable apparatus to function in a particular manner to thereby generate a particular machine or particular article of manufacture. The instructions stored in the computer-readable storage medium may produce an article of manufacture, where the article of manufacture becomes a means for implementing functions described herein. The program code instructions may be retrieved from a computer-readable storage medium and loaded into a computer, processor or other programmable apparatus to configure the computer, processor or other programmable apparatus to execute operations to be performed on or by the computer, processor or other programmable apparatus.

Retrieval, loading and execution of the program code instructions may be performed sequentially such that one instruction is retrieved, loaded and executed at a time. In some example implementations, retrieval, loading and/or execution may be performed in parallel such that multiple instructions are retrieved, loaded, and/or executed together. Execution of the program code instructions may produce a computer-implemented process such that the instructions executed by the computer, processor or other programmable apparatus provide operations for implementing functions described herein.

Execution of instructions by a processor, or storage of instructions in a computer-readable storage medium, supports combinations of operations for performing the specified functions. In this manner, an apparatus 1000 may include a processor 1002 and a computer-readable storage medium or memory 1004 coupled to the processor, where the processor is configured to execute computer-readable program code 1006 stored in the memory. It will also be understood that one or more functions, and combinations of functions, may be implemented by special purpose hardware-based computer systems and/or processors which perform the specified functions, or combinations of special purpose hardware and program code instructions.

Figure 11:
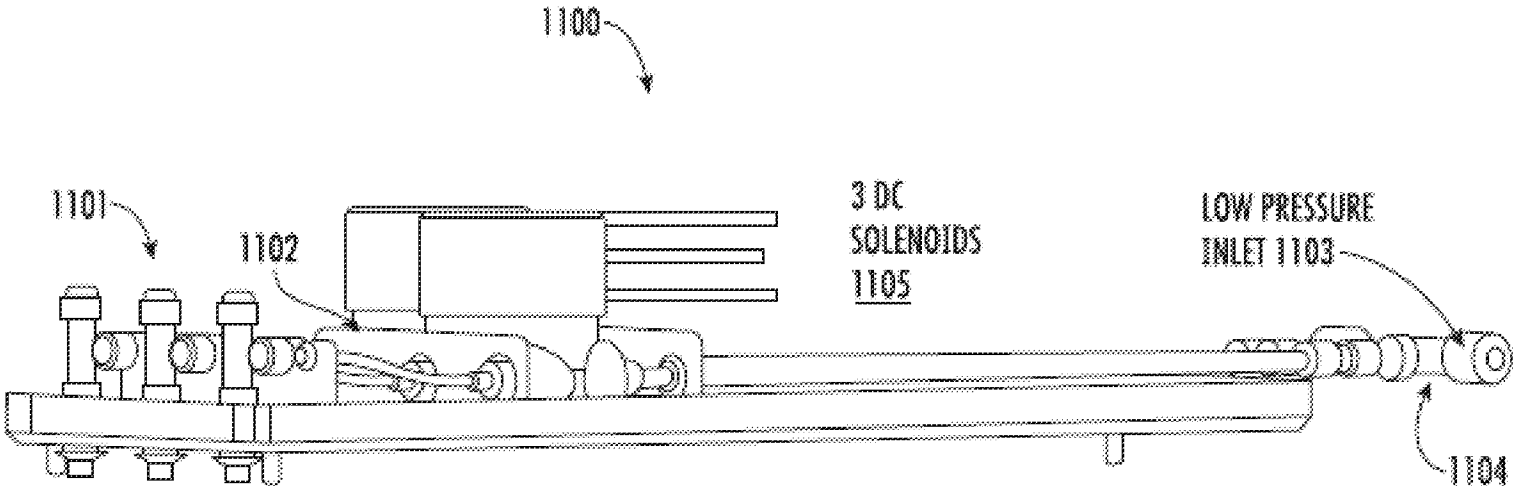
FIG. 11 illustrates a fluid-dispensing mechanism according to example implementations of the present disclosure.

FIG. 11 illustrates a fluid-dispensing mechanism 1100 that may be used in conjunction with the solid-production system 100 in FIG. 1, according to example implementations of the present disclosure. The fluid-dispensing mechanism 1100 can be configured to dispense fluid, such as water, individually into each fluid mold (e.g., M0-M29 in FIG. 1) of the solid-production system at a fluid-dispensing position, e.g., P0 in FIG. 1. Dispensing fluid individually into each fluid mold is different from some fluid dispensing solutions that introduce fluid at one location and rely on a cascading mechanism to distribute fluid throughout all the fluid molds. In another example implementation, the fluid-dispensing mechanism can dispense fluid into another container vessel that is different from the fluid molds.

In some example implementations, the fluid-dispensing mechanism 1100 includes a dispensing apparatus 1101 configured to dispense a quantity of fluid, such as water, individually into the fluid molds M0-M29 indexed into the fluid-dispensing position. The dispensing apparatus may comprise a dispensing nozzle configured to direct the quantity of fluid into the fluid molds, as well as sealing components, valve mechanisms, and the like. A length of tubing 1102 may be coupled to the dispensing apparatus to transmit the quantity of fluid thereto. An inlet 1103 of the length of tubing may receive the quantity of fluid from a reservoir, fluid pipes, or the like.

In some other example implementations, the fluid-dispensing mechanism 1100 may further comprise a pressure regulator 1104. The pressure regulator may be disposed in-line with the length of tubing 1102 or may be provided upstream and externally to the length of tubing. The pressure regulator may be configured to measure a fluid pressure of the fluid flowing through the length of tubing and control the fluid pressure. With lower fluid pressure, the flow rate of the fluid flow may be lower. As such, it may be desirable to control the fluid pressure using the pressure regulator to maintain the fluid pressure at a substantially lower fluid pressure than what is typically used in residential homes so as to prevent splash of the dispensed fluid at the dispensing apparatus 1101.

For example, water flowing through the length of tubing may have a water pressure of 12 pounds per square inch (psi), which is substantially lower than current operating pressures (30-100 psi) of typical residential water pressure. The dispensing apparatus 1101 may also incorporate a tube fitting that maintains an opening to the atmosphere, so as to prevent the dispensing fluid from exiting the tubing prior to dispensing into the desired fluid mold. In this way, the dispensing apparatus 1101 can facilitate a break in the fluid vacuum built up in the tubing from a dispense operation at a location above the freezing point, in order to prevent ice formation and blockage in the tube.

In some example implementations, it may be desirable to provide the fluid regulator 1104 at the inlet 1103. The fluid regulator can be configured to regulate the fluid pressure at the inlet to have a value (e.g., 12 psi) that is below current operating pressures (30-100 psi) of typical residential water pressure. In this way, the fluid-dispensing mechanism 1100 may not need to use a flow meter to monitor or measure variable flow rates and can precisely regulate fluid dispense based on time alone. For example, the fluid-dispensing mechanism can be configured to control the time of fluid dispense to achieve accurate dispensing of fluid to each of the fluid molds. Software logic, such as that described in FIGS. 2-10, can be used to control or change quantities of fluid dispensed to each fluid mold by the fluid-dispensing mechanism. Properly controlled quantities of fluid dispensed by the fluid-dispensing mechanism 1100 may provide a tradeoff between volume of the formed solid in the fluid molds and time for cooling the fluid in the fluid molds to form the solid. A user may select the desired volume of the solid at a user interface, which will in turn affect the quantity of fluid dispensed by the fluid-dispensing mechanism and then the time for cooling the fluid to form the solid.

The fluid-dispensing mechanism 1100 may further include, in some example implementations, one or more valves to control flow of the fluid in the system. For example, and as illustrated in FIG. 11, the fluid-dispensing mechanism includes three valves; although one valve, two valves, three valves, four valves, etc., provided in series or in parallel, or a combination thereof may be useful for controlling the flow of the fluid in the system. As illustrated in FIG. 11, each of the three valves is or includes a direct current (DC) solenoid 1105. The DC solenoids may be disposed in-line with the length of tubing 1102 or may be provided upstream and externally to the length of tubing. Other types of valves may also be implemented.

Figure 12:
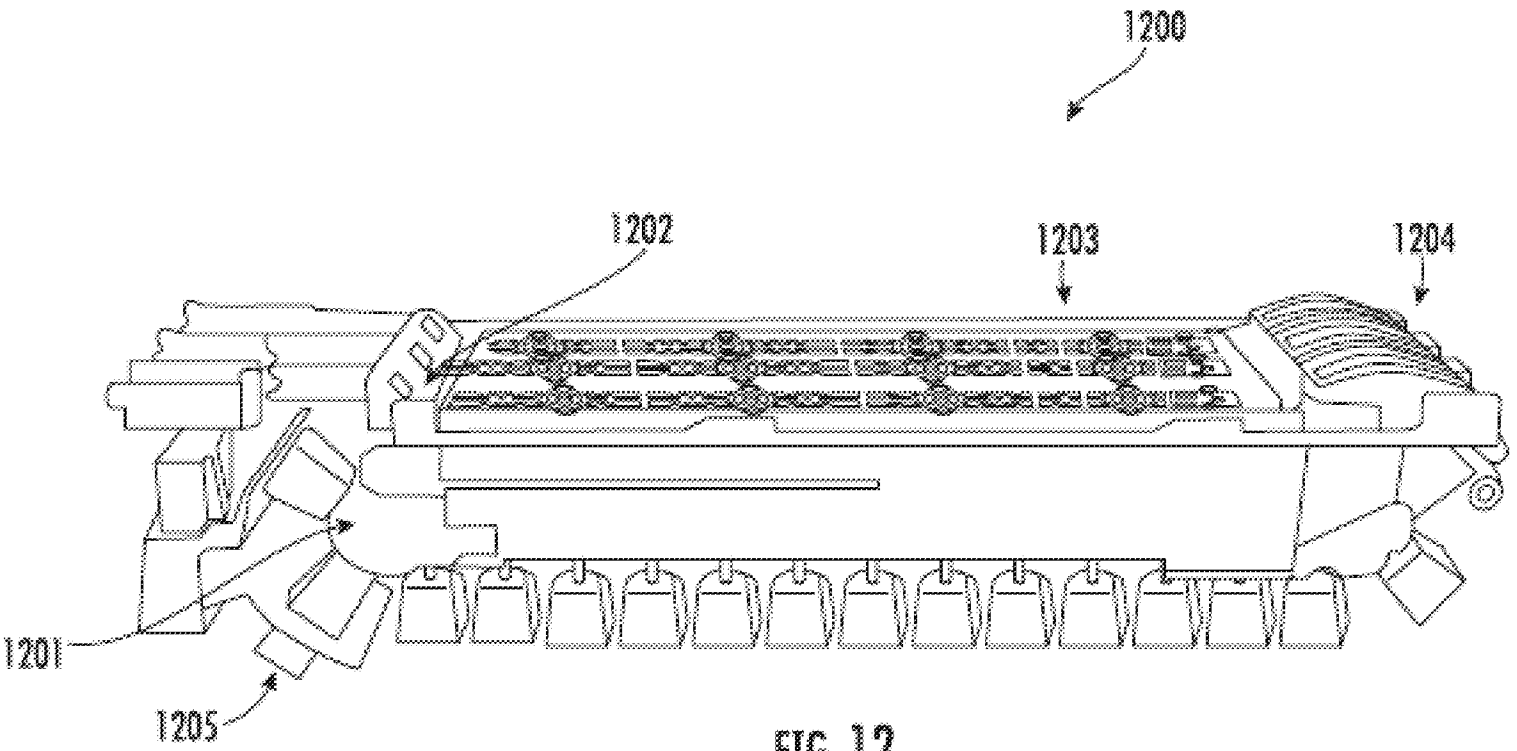
FIG. 12 illustrates a solid-production system according to example implementations of the present disclosure.

FIG. 12 illustrates a solid-production system 1200 that is the same as or similar to the solid-production system 100, in FIG. 1. The solid-production system in FIG. 12 includes a conveying mechanism 1201, a fluid-dispensing mechanism 1202, a pressure plate and a cooling block arrangement 1203, a solid ejector 1204, and a solid-dispensing mechanism 1205. FIG. 12 in particular illustrates a location of a fluid-dispensing mechanism according to example implementations of the present disclosure.

Figure 13:
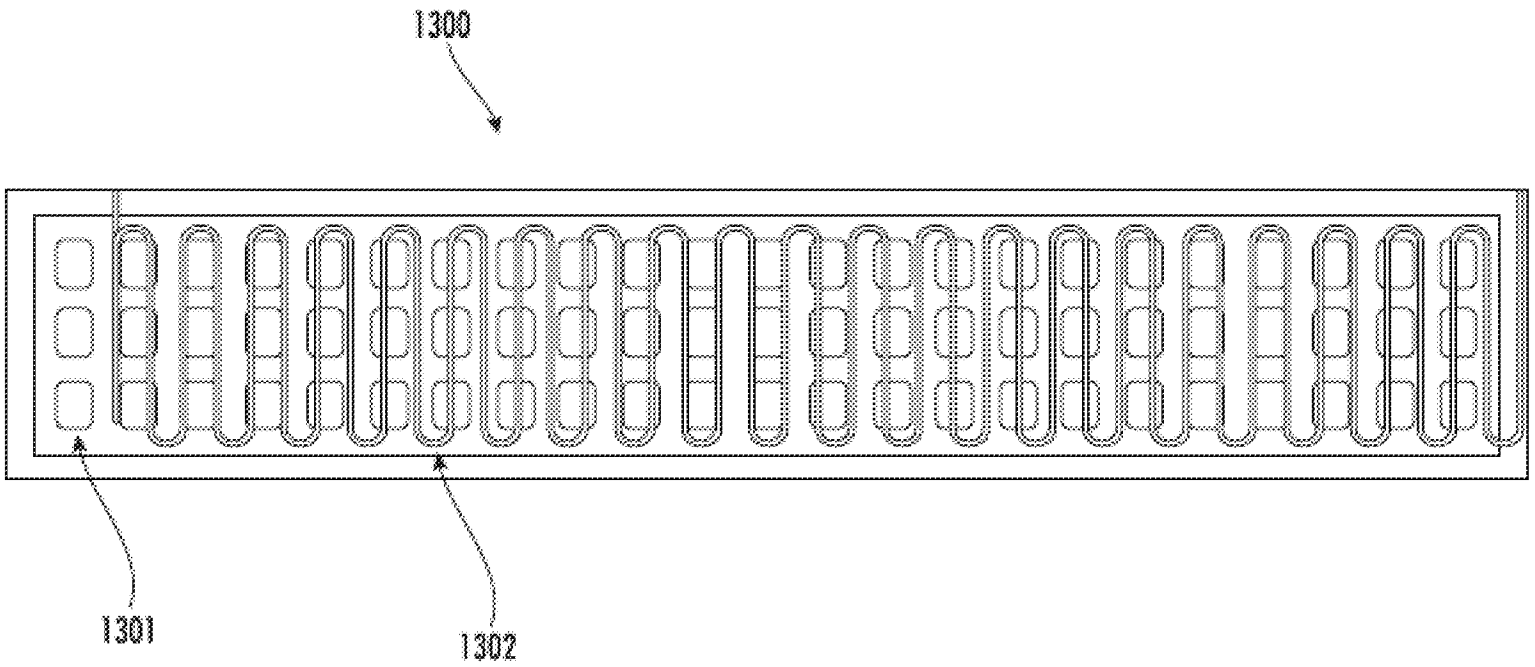
FIG. 13 illustrates a top plan view of a cooling block with flow tubes arranged in a serpentine pattern according to one example implementation of the present disclosure.
Figure 14:
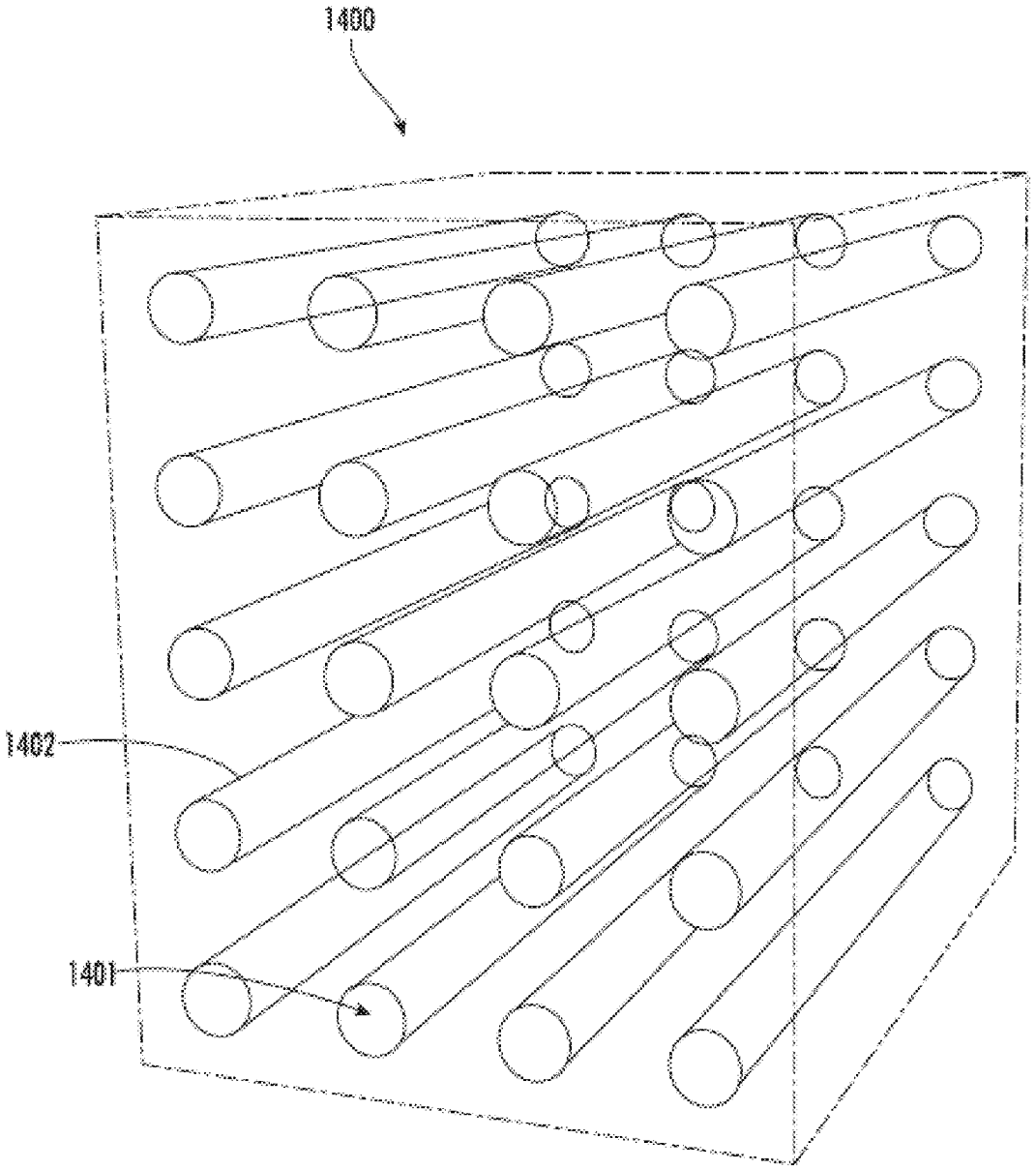
FIG. 14 illustrates a front perspective view of a cooling block with flow tubes arranged in a coiled pattern according to another example implementation of the present disclosure.

FIGS. 13 and 14 illustrate example cooling blocks 1300, 1400, respectively, which may be used in conjunction with the solid-production system 100 in FIG. 1, according to example implementations of the present disclosure.

A cooling block as contemplated by the present disclosure, is, for example, arranged to interact with one or more fluid molds to reduce a first temperature of a fluid dispensed in each of the one or more fluid molds to a second temperature, the second temperature being lower than the first temperature, to solidify the fluid in each of the one or more fluid molds. In such example implementations, the cooling block has a thermal mass operable to absorb and store thermal energy transferred by the fluid in each of the one or more fluid molds so as to reduce the first temperature of the fluid to the second temperature. In some example implementations, a material of the thermal mass may be aluminum, or another material having similar thermal characteristics to aluminum. In some other example implementations, a material of the thermal mass may be iron, or another material having similar characteristics to iron. In some still further example implementations, a material of the thermal mass may be one having thermal characteristics that enable the cooling block to absorb and store thermal energy as efficiently as a thermal mass having a material of aluminum, iron, and the like.

In order to increase a rate of solidification or decrease a solidification time of the fluid molds in a cooling region of the cooling block, in some example implementations, a pressure plate may be arranged to urge the one or more fluid molds into interaction with the cooling block. More particularly, the pressure plate may be arrangeable in an initial position adjacent to the top surface of the fluid in each of the one or more fluid molds so as to urge the one or more fluid molds into interaction with the cooling block in order to reduce the first temperature of the fluid in each of the one or more fluid molds to the second temperature, and may be arrangeable in a second position in spaced apart relation from the top surface of the fluid in each of the one or more fluid molds so as not to urge the one or more fluid molds into interaction with the cooling block. This is described in more detail in FIG. 27.

In some still further example implementations, one or more actuation mechanisms may be arrangeable to bias the pressure plate into the initial position adjacent to the top surface of the fluid in each of the one or more fluid molds, and arrangeable to bias the pressure plate into the second position in spaced apart relation from the top surface of the fluid in each of the one or more fluid molds. The one or more actuation mechanisms may comprise a biasing member arranged adjacent to a top surface of the pressure plate to exert a normal force on the top surface of the pressure plate so as to bias the pressure plate into the initial position adjacent to the top surface of the fluid in each of the one or more fluid molds. The one or more actuation mechanisms may further comprise a sliding member, wherein the sliding member is slidingly engaged with the pressure plate and is movable in a reverse machine direction to exert an opposing normal force against the normal force exerted on the top surface of the pressure plate by the biasing member, the opposing normal force being greater than the normal force exerted by the biasing member, so as to bias the pressure plate into the second position in spaced apart relation from the top surface of the fluid in each of the one or more fluid molds.

Further, the one or more actuation mechanisms may further comprise a motor and a reciprocating shaft engaged with the sliding member, wherein actuation of the motor drives the reciprocating shaft to reciprocatingly move the sliding member in a machine direction and the reverse machine direction. The motor may be actuated by a control mechanism, which may comprise a hardware processor and at least one memory. The control mechanism may interface with and be operable to actuate the motor. In some example implementations, the control mechanism may comprise a pressure plate slave state machine (e.g., 204 in FIG. 2), which may receive commands from a master state machine (e.g., 201 in FIG. 2) to actuate the motor in order to arrange the pressure plate in either the initial position, the second position, or an ejection position, and arrange a solid ejector in a first or second position as described in detail in FIG. 8.

In some example implementations, a conveying mechanism may be arranged to convey one or more fluid molds in a machine direction through a solid-production system (e.g., 100 in FIG. 1). The conveying mechanism may be arranged to convey the one or more fluid molds in the machine direction through a cooling region of the cooling block, so that in the cooling region, each of the one or more fluid molds is urged into interaction with the cooling block. Specifically, the fluid in each of the one or more fluid molds entering the cooling region may be at the first temperature and the fluid in each of the one or more fluid molds exiting the cooling region may be reduced to the second temperature and solidified.

In some still further example implementations, a fluid-dispensing mechanism may be arranged adjacent to the one or more fluid molds to dispense the fluid at the first temperature into each of the one or more fluid molds when the fluid molds are in a fluid-dispensing position relative to the fluid-dispensing mechanism.

In some example implementations, the cooling block may comprise a monolithic mass of a material, such as for example, a monolithic mass of aluminum. However, in other example implementations, the cooling block may also comprise multiple parts, such as, for example, two or more blocks of a material (e.g., aluminum), which may be coupled together to form the cooling block. The total volume of the cooling block, whether as a monolithic mass or as a coupling of multiple blocks, may be between about 100 inches cubed ($in^3$) and about 120 $in^3$; and in some example implementations, the volume of the cooling block may be about 110.5 $in^3$, with dimensions of about 4.25 inches by about 2 inches by about 13 inches. However, these dimensions, and volume, may vary.

Regardless, a cooling block having a thermal mass of a material so sized, shaped, and/or dimensioned may be advantageous as it forms a larger heat sink for absorbing and storing the thermal energy transferred by the fluids in each of the one or more fluid molds when the fluid molds are in the cooling region of the cooling block. As such, the thermal mass is able to more efficiently solidify fluid in more fluid molds on more tracks than conventional solidification methods using conduction or blowing air on the fluid.

In some still further example implementations, a cooling block may comprise defined channels throughout the cooling block, which are arranged to have a cooling material flowed therethrough. In some still other example implementations, a cooling block may comprise at least one tube, extending laterally between a top surface and a bottom surface of the cooling block in a pattern, and arranged to have a cooling material flowed therethrough. The at least one tube may comprise an evaporator tube and the cooling material may comprise refrigerant. However, other cooling materials are also contemplated herein, such as, for example, but not limited to carbon dioxide, ammonia, water or brine. Depending on the cooling material used, the cooling material may be provided to the at least one tube in different manners. For example, the cooling material may be transmitted to the at least one tube from a heat exchanger where the cooling material is a refrigerant used in a compressor. However, the cooling material may be another material depending on the application of the solid-production system. The evaporator tube may be inserted or embedded into extruded parts of the cooling block and may receive the cooling material. In some examples, where the cooling block comprises two or more blocks, the at least one tube may be inserted or embedded between the two or more blocks.

The cooling material flowing through the at least one tube can be configured to reduce the temperature of the fluid in the fluid molds from the first temperature to the second temperature. For example, where refrigerant is flowed through the at least one tube in the cooling block, the cooling block is able to absorb and store the thermal energy transferred by the fluid in each of fluid molds from a first temperature to a second, refrigerant temperature (about −22 degrees (° F.)).

Notably, an energy density or amount of energy stored in the cooling block may be variable based on the material of the thermal mass. For example, the energy density of aluminum is about 83.8 mega joule per liter (MJ/L), which may allow the cooling block to exchange more energy with the fluid in the fluid molds than the compressor only (over a certain period of time) due to the material density, specific heat, and thermal conductivity properties. For example, the cooling block may exchange between about 420 kilowatts (kW) and about 450 kW with the fluid molds in order to reduce a temperature of the fluid in the fluid molds to the second temperature. The thermal mass of the cooling block is sized, shaped, and/or dimensioned so that the thermal mass of the cooling block is greater than an energy density of cooling material (e.g., refrigerant) flowing through the at least one tube.

Thus, it is advantageous to provide the thermal mass having the at least one tube embedded or otherwise inserted in the thermal mass, so that the thermal mass is positioned between the at least one tube and a top surface of the fluid in the fluid molds so as to allow for the cooling block to deliver more cooling power (i.e., decrease the solidification time) to the fluid, then would be typical of a compressor/refrigerant alone, such that the first temperature of the fluid in the fluid molds is reduced to the second temperature faster than using a compressor/refrigerant alone. In addition, the cooling block can advantageously reduce the temperature of the fluid in the fluid mold from the first temperature to the second temperature only through conduction using the thermal mass of the cooling block without the need of using blown air or convection, such that solidification of the fluid in the fluid molds is more cost efficient and quicker than conventional solidification modalities.

For example, FIG. 13 illustrates a top view of the example cooling block 1300, according to example implementations of the present disclosure. In FIG. 13, the cooling block defines a thermal mass that is sized, shaped, and/or dimensioned to allow three tracks, each track comprising a plurality of fluid molds 1301 to be received in a cooling region of the cooling block. At least one tube 1302 is provided in the cooling block of FIG. 13, where the at least one tube extends in a serpentine pattern along and within the cooling block, the serpentine pattern extending laterally within a plane of the cooling block.

In another example, FIG. 14 illustrates a front perspective view of the example cooling block 1400, according to example implementations of the present disclosure. In FIG. 14, the cooling block defines a thermal mass that is sized, shaped, and/or dimensioned to allow a plurality of tracks, each comprising a plurality of fluid molds (not shown), to be received in a cooling region of the cooling block. As shown in FIG. 14, the cooling block defines longitudinally-extending channels 1401 extending parallel to a longitudinal axis of the cooling block. Each of the longitudinally-extending channels may be arranged to receive one of at least one tube 1402, each tube being arranged in a coiled pattern extending along a length of the corresponding longitudinally-extending channels.

In some example implementations, the thermal mass of the cooling block may be optimized or made most effective. More particularly, the thermal mass of the cooling block may comprise a material and be sized, shaped, and/or dimensioned to optimize performance of the cooling block based on desired functionality of a solid-production system. For example, where the desired functionality of a solid-production system is to optimize performance to produce a solid as quickly as possible, while keeping a size of the solid-production system small, then the thermal mass of the cooling block may be optimized to achieve this functionality.

A computer generated model may be utilized for optimizing a design of the thermal mass of the cooling block. The computer generated model may be a computational fluid dynamics (CFD) model, or the like, created using any software currently available so as to run a simulation to determine the dynamics of different elements in a solid-production system and may then be refined in order to optimize a design of the elements, e.g., the cooling block. For example, the computer-generated model may simulate the thermal mass of the cooling block based on one or more parameters of the solid-production system, where the parameters may be independent, dependent or semi-independent in the simulation. The one or more parameters may include at least, for example, but are not limited to, full three-dimensional (3D) geometries, unsteady states, phase changes from fluid to solid. The one or more parameters may also include, but are not limited to material property changes, full conjugate heat transfer (CHT), compressor performance considerations, fully parameterized geometries, and the like.

The full CHT may further include parameters such as, but not limited to, conformal meshes, radiation, convection, and conduction, and material properties including density, specific heat, thermal conductivity, surface emissivity, and surface transmissivity. The fully parameterized geometry may further include parameters such as, but not limited to, thermal mass sizes, shapes, and/or dimensions, material of the thermal mass, thermal mass cost, solid dimensions, track dimensions, number of tracks, track spacing, radius of the at least one tube, location of the at least one tube, number of bends of the at least one tube, bending radius of the at least one tube, liner thickness, liner material, and insulation thickness.

In some example implementations, simulating the design of the thermal mass of the cooling block may have objectives such as, for example, to minimize time to solidify the fluid and minimize fluid mold material cost. The simulation may have multiple constraints. For example, the constraints may include that the time to solidify should be less than 600 seconds, the maximum solid temperature should be less or equal than −0.2° C., the mass for the fluid molds should be less or equal than 5 kilograms (kg) and the total mass of solid in the solid-production system should be more or equal than 600 grams (g).

Figure 15:
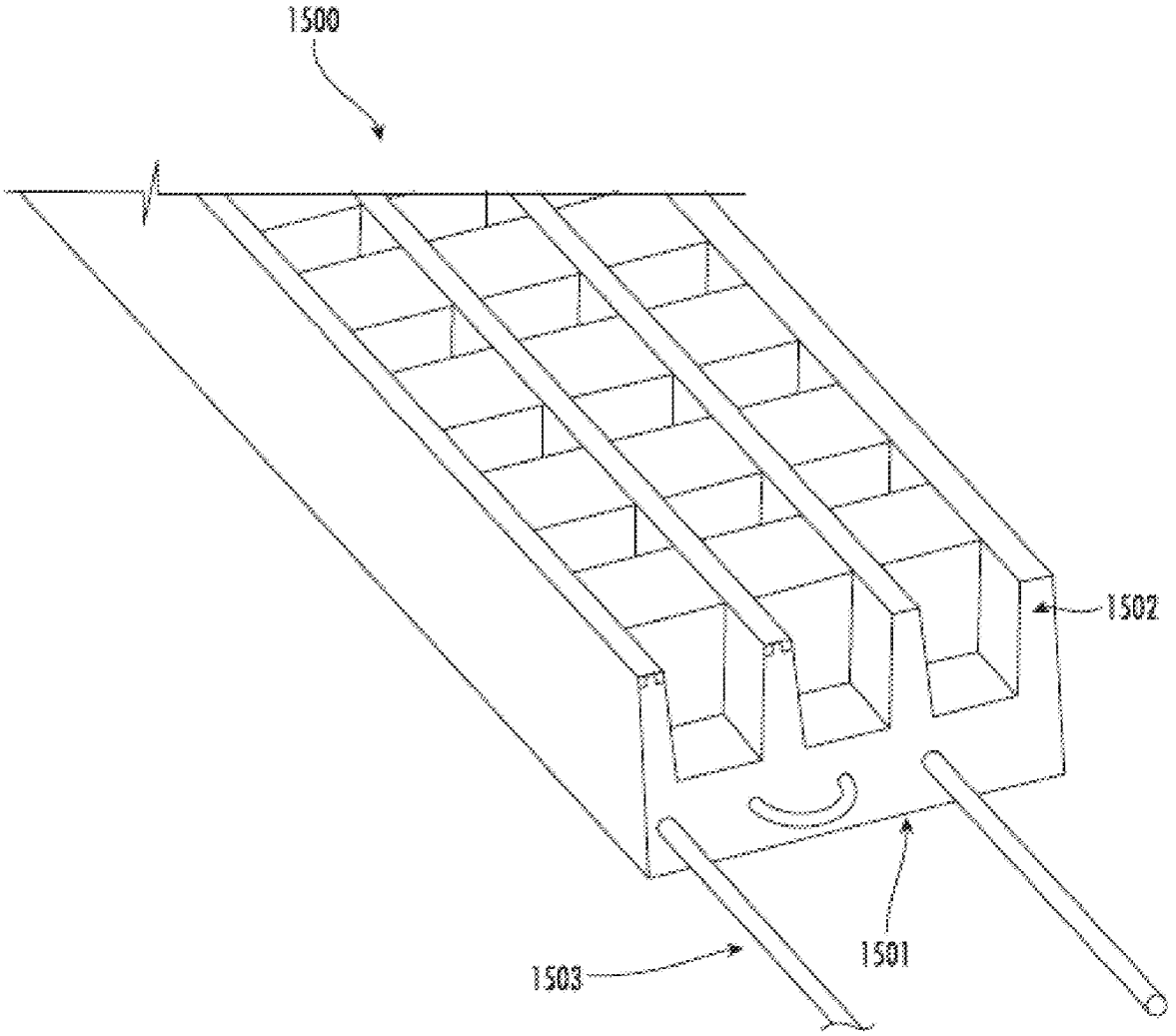
FIG. 15 illustrates a computer-generated model of an optimized cooling block according to example implementations of the present disclosure.

In one example implementation, the parameters input into the software for creating the computer-generated model may include, but are not limited to:

CoolingBlock_Xaxis
CoolingBlock_Zaxis
IceCube_EdgeFillet
IceCube_Yaxis
IceCube_Xaxis
IceCubeSpacingOffset_Yaxis
Insulation_Thickness
Liner_Thickness_mm
NumberofCubes_Yaxis
NumberofTracks
NumberofTubeBends_MinusY
NumberofTubeBends_PlusY
NumberofTubes_Inner
LengthofTubes_Inner
TubeBend_BendRadius
LengthofTubes_Outer
Tube_Outer_TranslationXaxis
TubeStart_Offset_Xaxis
TubeStart_Offset_Zaxis
Tube_Radius
IceCube_DraftAngle
TrackBottom_Fillet
TrackSpacing_InnerXaxis
TrackDepth_Zaxis
TrackSpacing_OuterXaxis
IceCube_Zaxis
IceCube_Spacing
IceCube Liner Extrusion
IceCube_Edge_Offset_Yaxis
CoolingBlock_Zaxis_Offset
TubeStart_Offset_Xaxis_Percent
Tube_Offset_Xaxis_TotalLength
MoldMaterial
MaxTemp_IcePlane
XPlane_DerivedPart
IceCubeWidth_Yaxis
TrackSpacing_InnerXaxis_total
LinerThickness_m
Liner_Material
Liner_ThermalCond FIG. 15 illustrates a computer-generated model of an optimized cooling block 1500 according to example implementations of the present disclosure. The optimized cooling block in FIG. 15 may be an example simulated design of a thermal mass of a cooling block using the parameters as described above. As shown, the thermal mass includes a base 1501 and extruded regions 1502. The extruded regions may correspond to a design of the fluid molds, such that when the fluid molds are urged into interaction with the cooling block, the fluid molds may be recessed into the extruded regions thereof.

Further, as illustrated in FIG. 15, at least one tube 1503 may be inserted or embedded into the base of the thermal mass. The at least one tube may be inserted or embedded into the thermal mass of the cooling block in an optimized manner, or in a manner that will most effectively and efficiently cool fluid molds urged into interaction with the cooling block.

Also as shown in FIG. 15 are example parameters of the simulated design of the thermal mass of the cooling block 1500. The example parameters illustrated in FIG. 15 are in no way the only parameters that may be used in simulating the design of the cooling block. The parameters illustrated in FIG. 15 include the inner and outer spaces between two tracks (e.g., TrackSpacing_InnerXaxis and TrackSpacing_OuterXaxis), offset for inserting the evaporator tube (e.g., TubeStart_Offset_Zaxis) and space between consecutive fluid molds (e.g., IceCubeSpacingOffset_Yaxis).

Figure 16A:
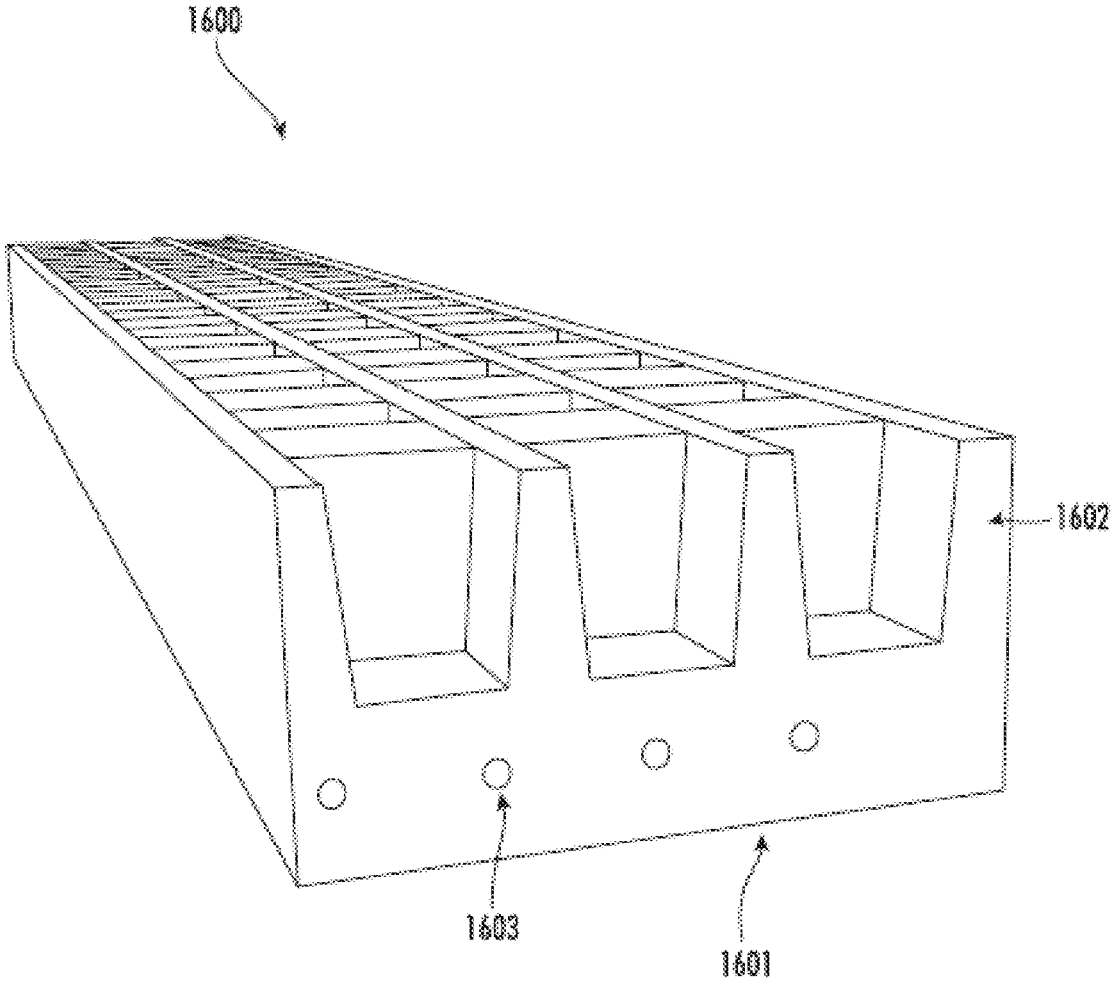
FIGS. 16A and 16B illustrate two different views of a computer-generated model of an optimized cooling block according to example implementations of the present disclosure.
Figure 16B:
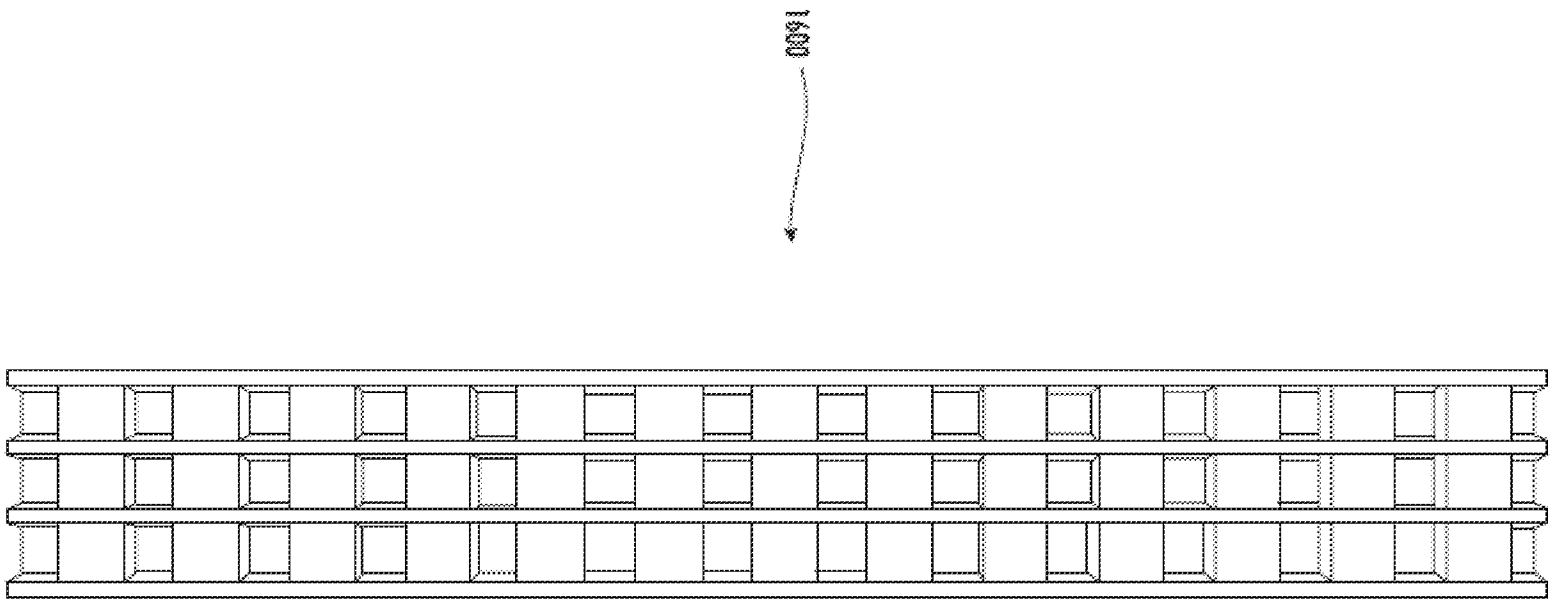

FIGS. 16A and 16B further illustrate two different views of a computer-generated model of an optimized cooling block 1600 according to example implementations of the present disclosure. As shown in FIG. 16A, a front perspective view of the optimized cooling block illustrates a base 1601 and extruded regions 1602. The base may define multiple, longitudinally extending channels 1603 arranged to receive at least one tube. FIG. 16B illustrates the optimized cooling block 1600 from a top plan view.

Figure 17A:
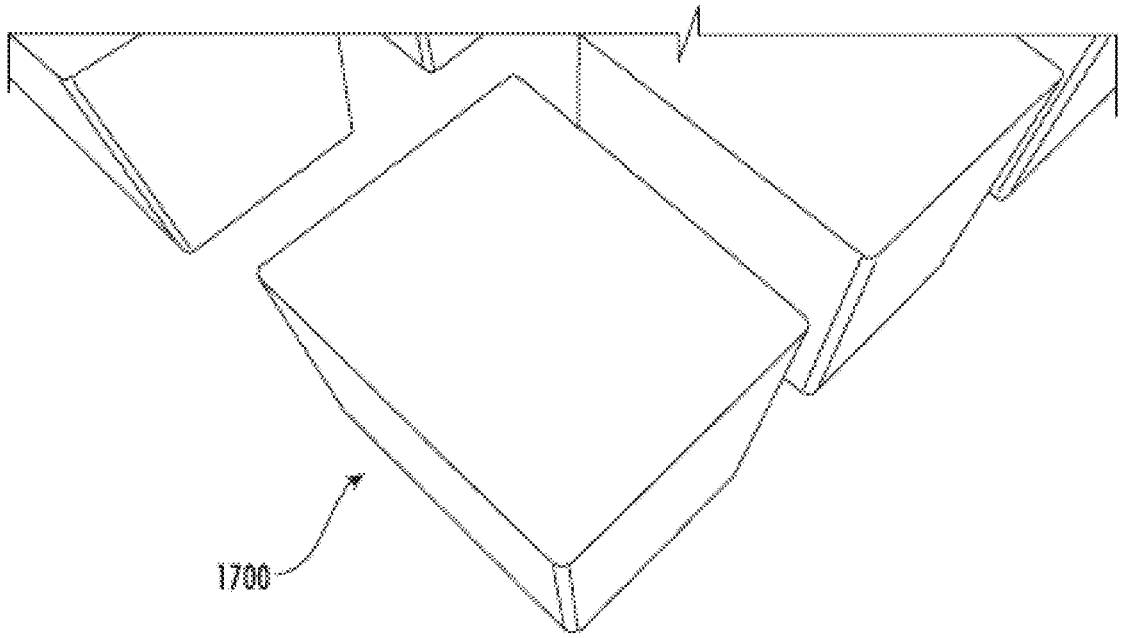
FIGS. 17A and 17B illustrate two different views of a computer-generated model of a solid according to example implementations of the present disclosure.
Figure 17B:
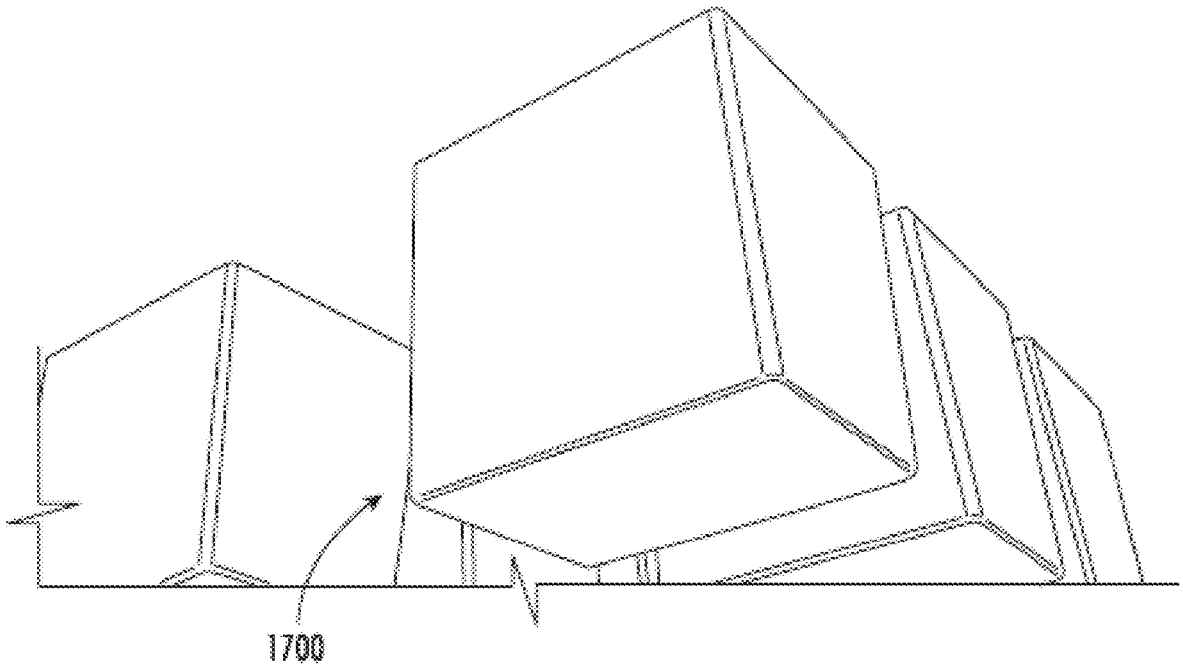

FIGS. 17A and 17B illustrate two different views of a computer-generated model of a solid 1700 according to example implementations of the present disclosure. The solid may be produced in fluid molds moved along a track of a conveying mechanism, when the fluid molds are in a cooling region of a cooling block, such as the cooling block 1600 described above in FIGS. 16A and 16B. The solid may be formed in a fluid mold that is sized, shaped, and/or dimensioned to most efficiently form a solid therein. The fluid mold may be shaped as a rectangular prism, a square prism, a cylinder, or any other polygonal shape, which may then produce a correspondingly shaped solid. This may be described in further detail in FIG. 22.

Figure 18:
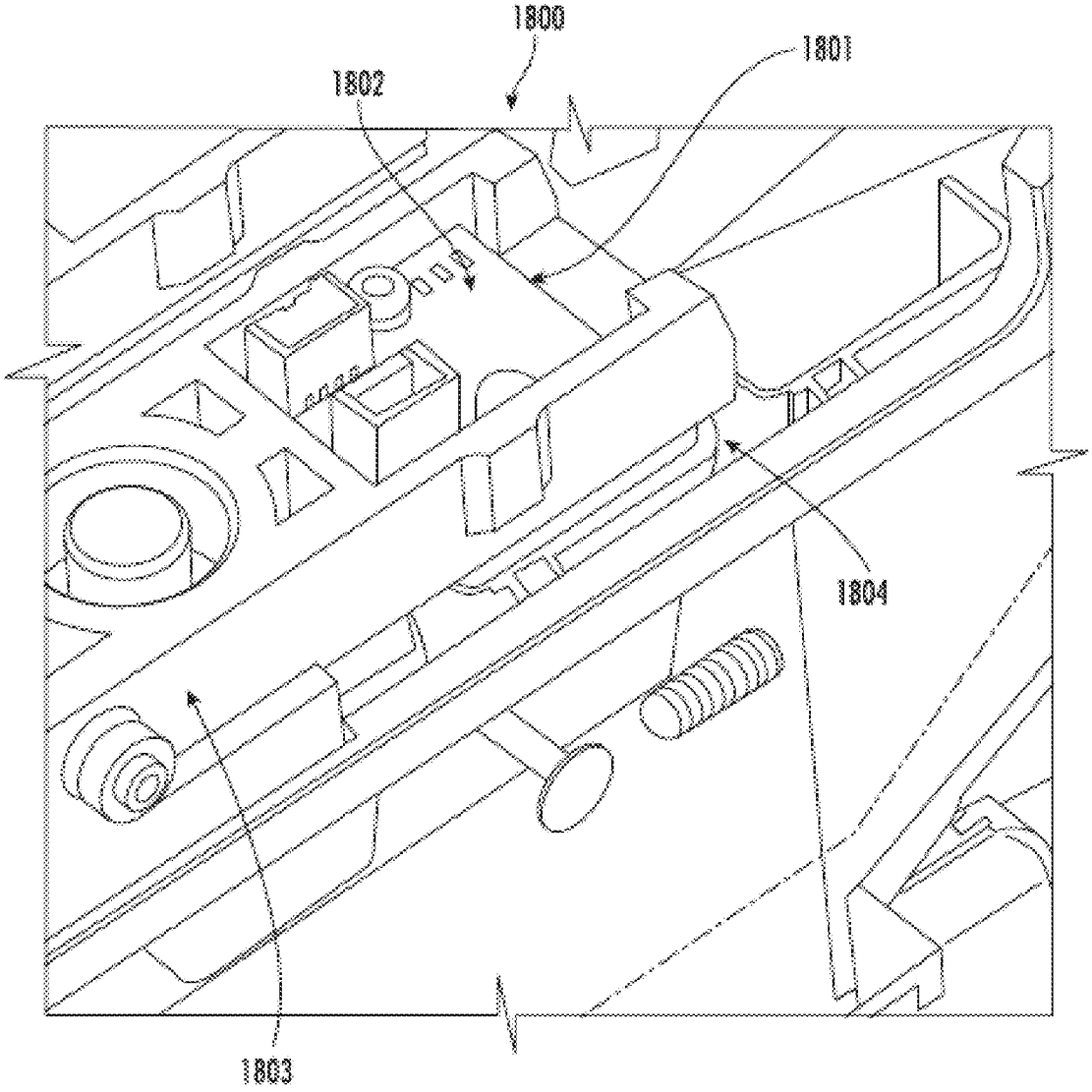
FIG. 18 illustrates a solid-detection mechanism according to example implementations of the present disclosure.

FIG. 18 illustrates an example schematic of a solid-detection mechanism 1800 that may be used in with the solid-production system 100 in FIG. 1, according to example implementations of the present disclosure. In one example implementation, the solid-detection mechanism in FIG. 18 can be a part of a solid ejector 103 in FIG. 1 as a mechanism to detect whether or not a solid is formed in a fluid mold when the fluid mold moves out of a cooling region relative to a cooling block (e.g., P1-P10 in FIG. 1) and into a solid-detection position (e.g., P11 in FIG. 1). In another example implementation, the solid-detection mechanism can be a separate mechanism proximate to a fluid-dispensing mechanism 101 in FIG. 1 or in another location in the solid-production system.

The solid-detection mechanism 1800 can be configured to use a sensor 1801 to detect whether a solid, such as ice, has been formed in the fluid mold. In some example implementations, the sensor can include a non-contact temperature sensor to measure a surface temperature of the fluid or solid in the fluid mold, which can be, for example, any one of the fluid molds M0-M29 in the solid-detection position P11. In other example implementations, a contact temperature sensor configured to contact a fluid in the fluid mold or a capacitive sensor can be utilized. Other types of sensors are also contemplated herein.

Where the sensor 1801 is a non-contact temperature sensor, the solid-detection mechanism can be configured to determine whether the solid, such as ice, has been formed in the fluid mold based on the measured surface temperature of the fluid in the fluid mold. For example, the non-contact temperature sensor can be configured to detect whether or not an entirety or a substantial entirety of a volume of water in the fluid mold has been cooled to a temperature at which ice has been formed. For example, the temperature sensor can be a non-contact thermopile temperature sensor such as a thermopile infrared temperature sensor.

In some example implementations, the solid-detection mechanism 1800 can include a thermopile board 1802. The thermopile board may be placed on a pressure plate 1803. The thermopile board may define a hole on the board to enable the sensor to measure thermal energy from the fluid or a solid in a fluid mold 1804, where the sensor and the hole may be on a side of the thermopile board shown in FIG. 18. Notably, the thermal energy measured by the temperature sensor may differ between a solid and a fluid.

Using a non-contact temperature sensor to measure the surface temperature of the fluid or solid in a fluid mold may be advantageous as compared to solutions requiring a temperature sensor being submerged in the fluid or adjacent to the fluid mold. More particularly, a temperature sensor submerged in the fluid may have a build-up of a solid (e.g., ice) on the temperature sensor. Thus, the temperature sensor submerged in the fluid may have to be heated to remove the build-up. Heating the temperature sensor to remove the build-up may inhibit solid creation in the fluid mold and slow the rotation speed of the fluid molds through the solid-production system. Further, a temperature sensor positioned adjacent to the fluid mold may only be able to measure the sides of the fluid mold, where a solid (e.g., ice) forms first based on geometry and heat transfer of the fluid mold. Thus, a temperature sensor adjacent to the fluid mold may have no knowledge of whether or not the entire volume of the solid in the fluid mold has formed a solid and may require a secondary timer to compensate. Using a sensor, such as but not limited to, a non-contact temperature sensor 1801 as described herein to measure the surface temperature of the fluid or solid in the fluid mold can thus avoid the above problems.

Figure 19A:
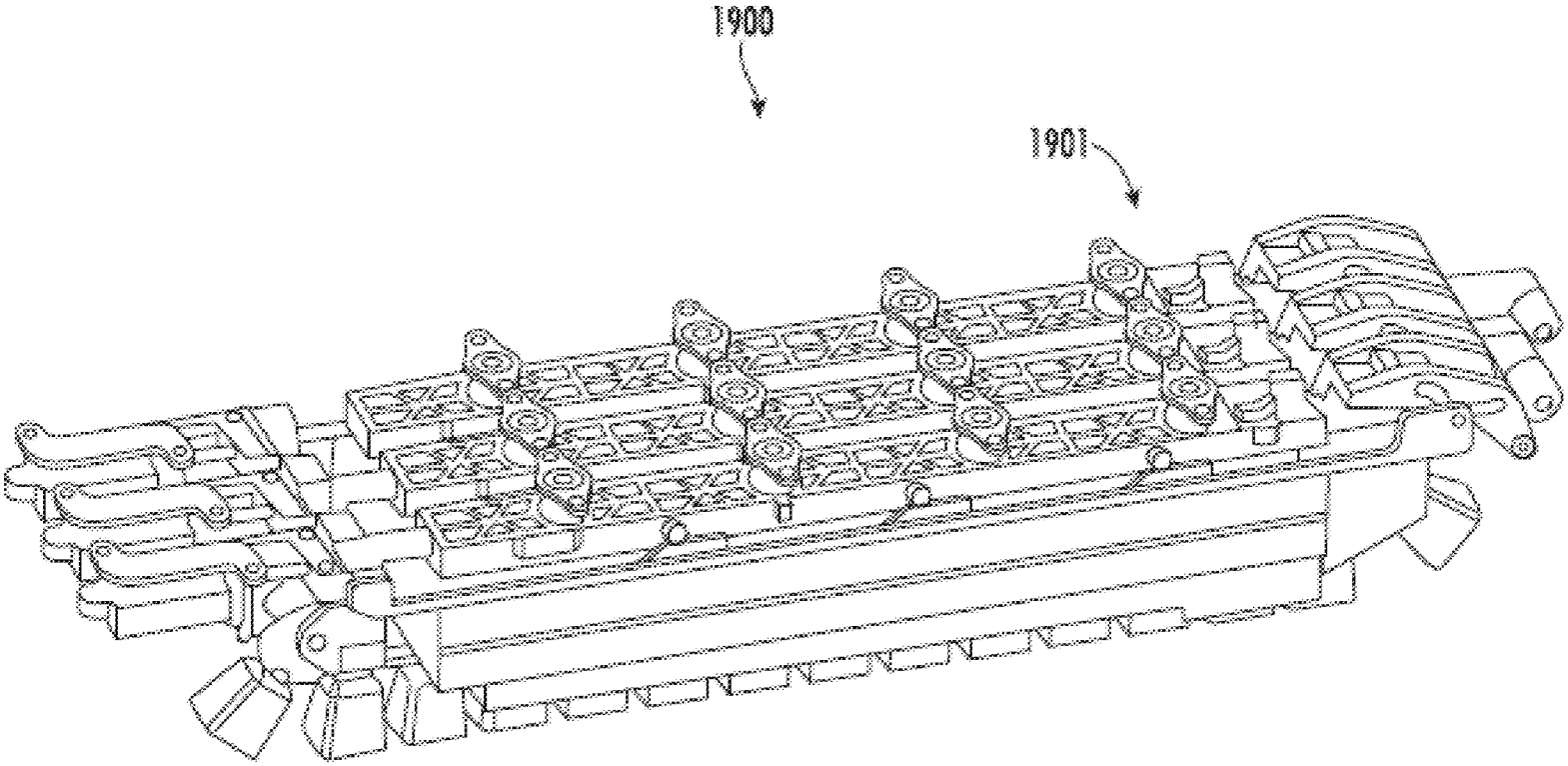
FIGS. 19A and 19B illustrate two different views of a solid-production system with an indication of a location of a solid-detection mechanism according to example implementations of the present disclosure.
Figure 19B:
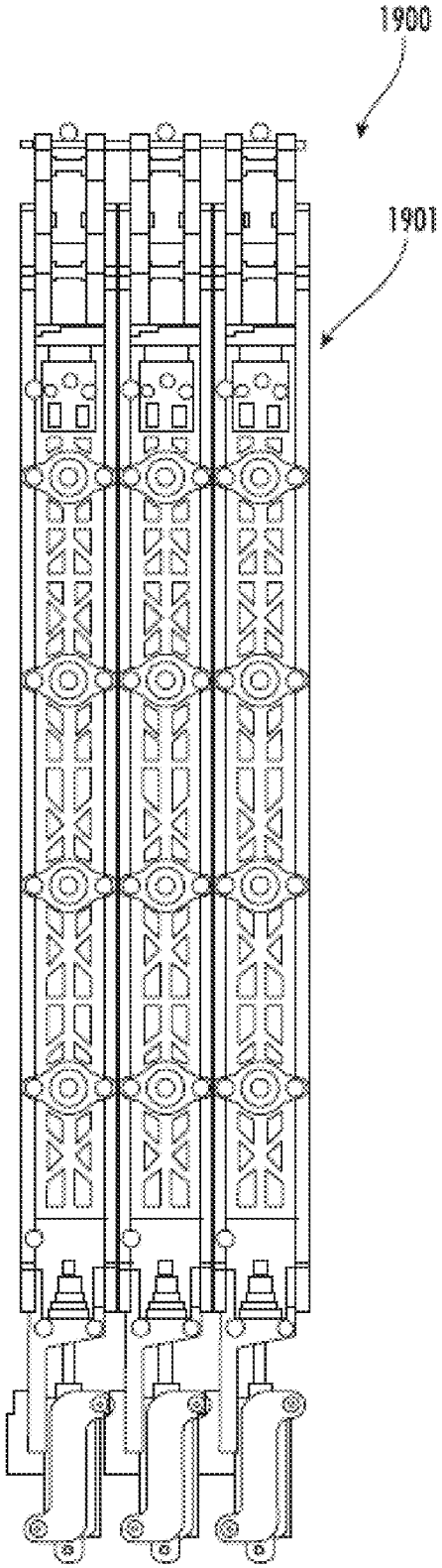

FIGS. 19A and 19B illustrate two different views of a solid-production system 1900, which may be the same as or similar to the solid-production system 100 in FIG. 1, with an indication of a location of an example solid-detection mechanism 1901. The solid-detection mechanism in FIGS. 19A and 19B may be the same as or similar to the solid-detection mechanism described in reference to FIG. 18.

Figure 20A:
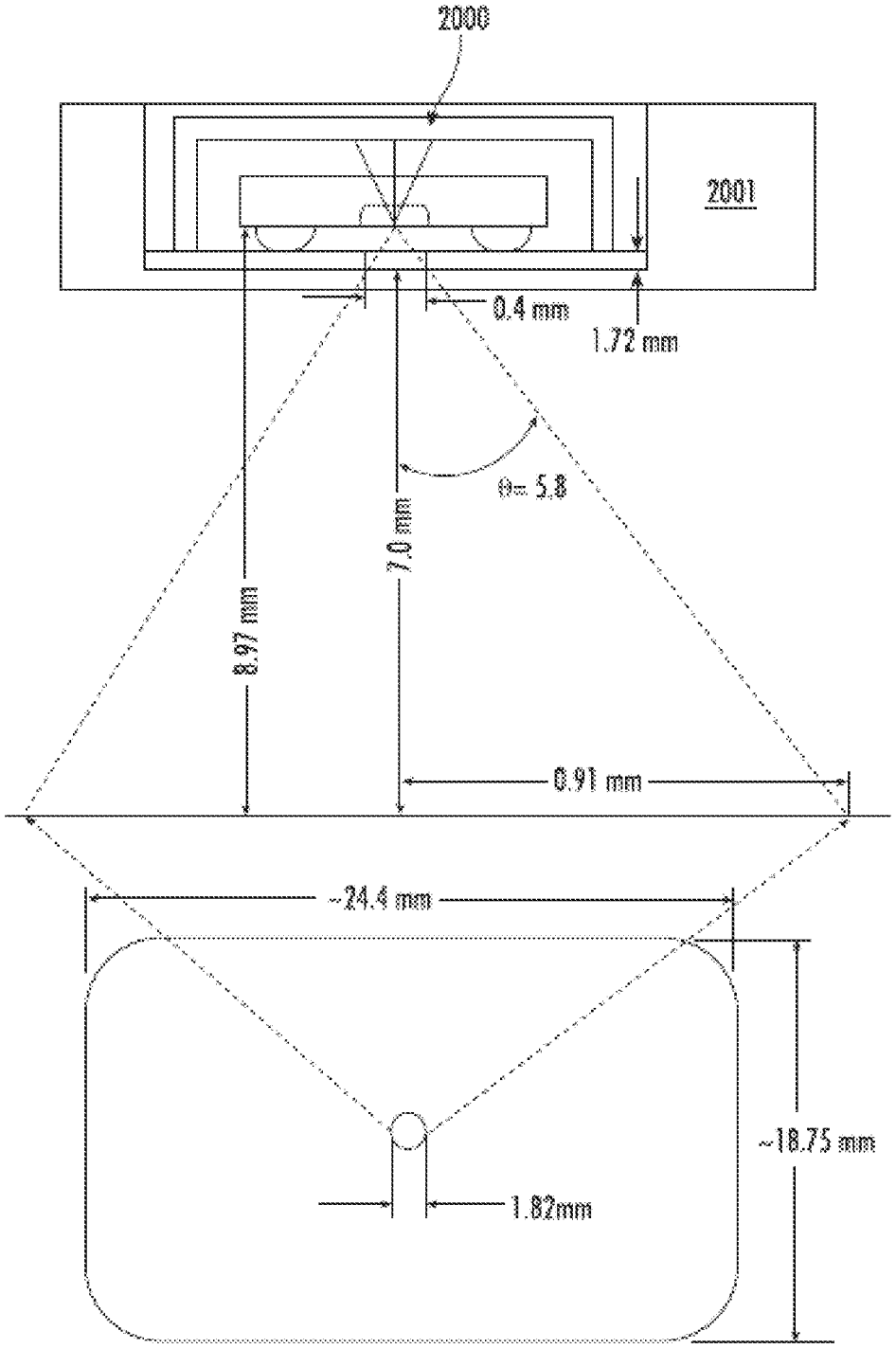
FIGS. 20A and 20B illustrate schematics of temperature measurement areas as detected by a solid-detection mechanism according to example implementations of the present disclosure.
Figure 20B:
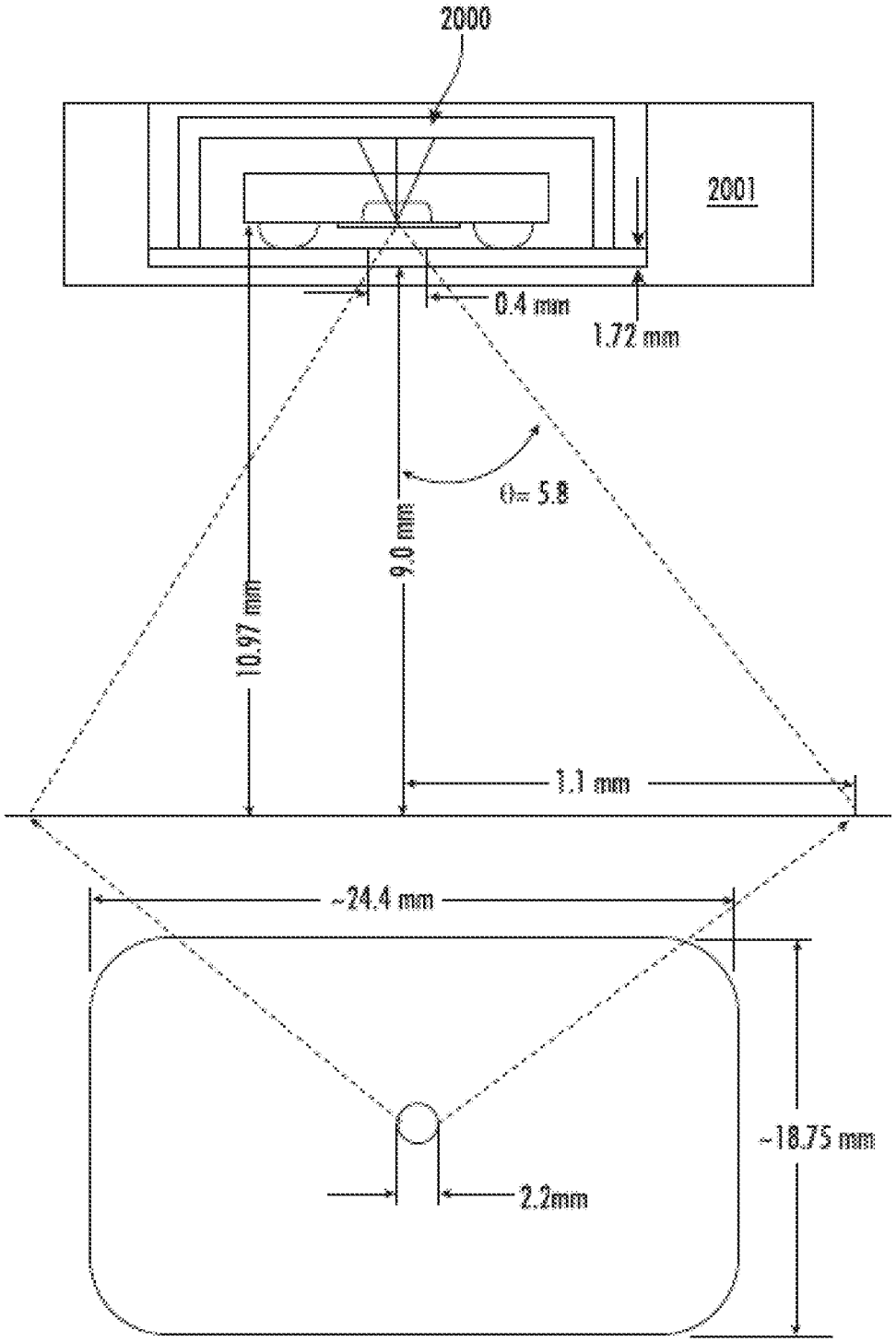

FIGS. 20A and 20B illustrate schematics of temperature measurement areas as detected by a solid-detection mechanism 2000 according to example implementations of the present disclosure. The solid-detection mechanism illustrated in FIGS. 20A and 20B may be the same as or similar to the solid-detection mechanism described in reference to FIG. 18.

The temperature measurement area can be calculated based on a performance specification of a thermopile temperature sensor of the solid-detection mechanism 2000. The performance specification may define one or more variables relating to detection of a temperature of the fluid or solid formed in the fluid mold. Such variables may include, but are not limited to: a field of view of the thermopile temperature sensor, a size of an aperture through which the thermopile temperature sensor can measure the temperature, a distance between the thermopile temperature sensor and a surface of the fluid mold or a top surface of the fluid or solid formed in the fluid mold, and fluid mold geometry. In some example implementations, modification of the temperature measurement area may require a change to the aperture and/or distance between the thermopile temperature sensor and a surface of the fluid mold or a top surface of the fluid or solid formed in the fluid mold.

FIG. 20A illustrates one example implementation of a temperature measurement area of a solid-detection mechanism 2000 to detect a temperature a fluid mold when a pressure plate 2001 is in an initial position, or arranged adjacent to a top surface of the fluid in the fluid mold so as to urge the fluid mold into interaction with the cooling block.

FIG. 20B illustrates one example implementation of a temperature measurement area of a solid-detection mechanism 2000 to detect a temperature of a fluid mold when a pressure plate 2001 is in a second position, or arranged in a spaced apart relation from the top surface of the fluid in the fluid mold so as not to urge the fluid mold into interaction with the cooling block.

Figure 21:
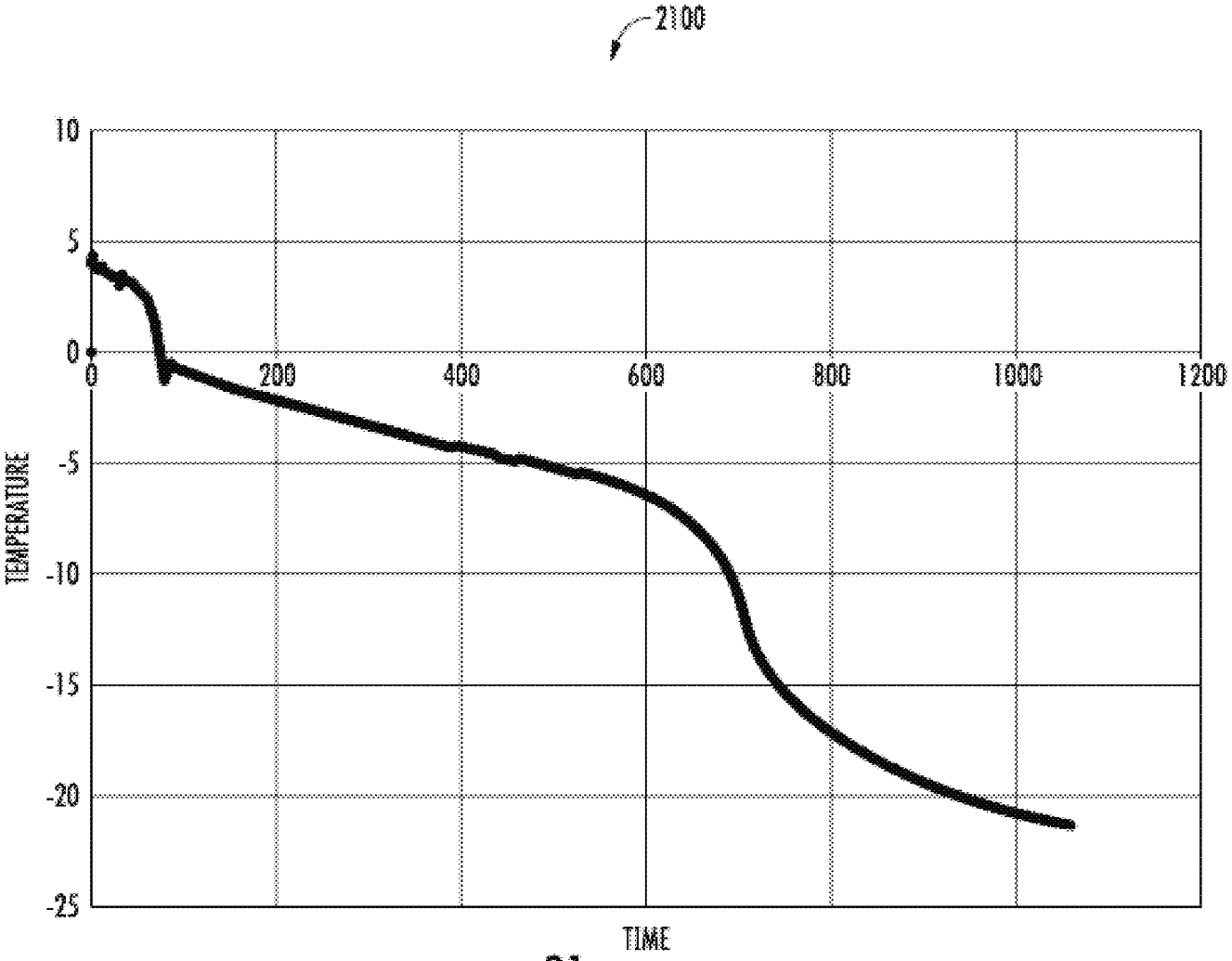
FIG. 21 illustrates a graphical representation of a temperature profile of a fluid/solid over time according to example implementations of the present disclosure.

FIG. 21 illustrates a graphical representation 2100 of a temperature profile of a fluid/solid over time according to example implementations of the present disclosure. In one example implementation, a temperature sensor of the solid-detection mechanism may be configured to detect a characteristic plateau of the fluid, which then decreases in temperature as the fluid changes from a sensible cooling phase to a latent cooling phase back to a sensible cooling phase, with each phase starting after the previous phases has ended. The "characteristic plateau" of the fluid occurs during the latent cooling phase, where solid crystals (e.g., ice crystals) are formed.

Where the fluid is water, for example, the changes may be a manifestation of a phase change phenomenon where ice crystals start forming during the characteristic plateau and grow (as dictated by latent energy transfer) until the water becomes ice completely and transitions to sensible cooling. The temperature sensor may be configured to transmit a signal to the software logic of the solid-production system, indicating that ice has formed in a fluid mold when the fluid mold is in a solid-detection position.

Figure 22:
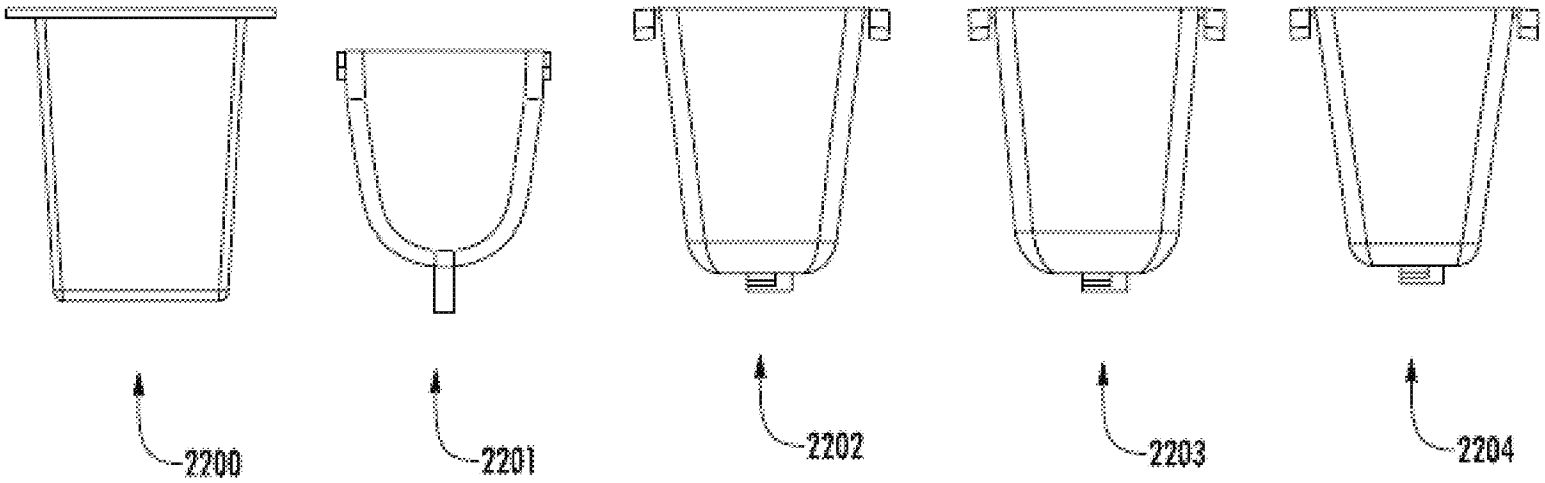
FIG. 22 illustrates different designs of fluid molds according to example implementations of the present disclosure.

FIG. 22 illustrates different designs of fluid molds 2200-2204 according to example implementations of the present disclosure. The fluid molds illustrated in FIG. 22 may be the same or similar to the fluid molds M0-M29 illustrated in FIG. 1. Each of the fluid molds illustrated in FIG. 22 may be designed with a size, shape, dimension, and/or material to achieve a desired function (e.g., quicker solidification time, smaller volume of the fluid mold). A computer-generated model, such as that described in reference to FIGS. 15, 16A, and 16B, may run a simulation to determine the dynamics of the fluid molds and then be refined so that the fluid molds are optimized to achieve the desired function.

For example, the fluid mold 2200 in FIG. 22 may have an interior width of 16 mm to 20 mm, an interior height of 18 mm to 26 mm, and an interior angle of 85° to 98°. In some example implementations, the fluid mold comprises an interior width of 18.20 mm, an interior height of 20.90 mm, and an interior angle of 94.2°. In some examples, as designed, the fluid mold may be made of polypropylene, stainless steel, and the like. As such, the fluid mold of this implementation may be advantageous when compared to conventional fluid mold designs because the design may result in a decreased time to solidify fluid such as water in the fluid mold and decreased mold material cost. The decreased time to solidify fluid using the fluid mold of this example implementation may occur because the shape of the fluid mold maximizes heat transfer into the fluid mold so as to reduce solidification time, the material of the fluid mold has a high thermal conductivity material (e.g., polypropylene) which does not restrict the heat transfer as much as a regular high thermal conductivity material (e.g., regular polypropylene), and conduction heat transfer is inherently higher than convection.

In another example, a fluid mold 2201 in FIG. 22 may comprise an interior width of 16 mm to 21 mm, an interior height of 18 mm to 26 mm, and an interior angle of 90° to 95°. In some example implementations, the fluid mold comprises an interior width of 21 mm, an interior height of 20.9 mm, and an interior angle of 95°. The fluid mold may also comprise a fillet at an intersection between side surfaces and a bottom surface thereof. As such, the fluid mold of this example implementation may be advantageous because it may optimize solid ejection due to the elimination of sharp interior angles in the fluid mold.

In some examples, the designs of the fluid mold 2200 and the fluid mold 2201 may be combined to provide blended designs that balance thermal capacity and efficiency, contact between the fluid mold and the cooling block, and ease of ejection of a formed solid in the fluid mold. Fluid molds 2202, 2203 and 2204 illustrate a blend of the designs of the fluid molds 2200 and 2201, which consider multiple factors as described above.

For example, the fluid mold 2202 may comprise a draft angle of 7°, a bottom of 3 mm and a side of 1 mm. The fluid mold 2203 may comprise draft angle of 5°, a bottom of 4 mm and sides of 1 mm. The fluid mold 2204 may comprise draft angle of 9°, a bottom of 3 mm and sides of 1 mm. The bottom of 3 mm (or 4 mm) and the sides of 1 mm may refer to the radius of the fillet on either the bottom of the mold or the vertical sides/corners. In one example, the fluid molds 2202, 2203, and 2204 may provide an improved ability of ejection of a formed solid from the fluid mold as compared to conventional fluid mold designs. In one example, the fluid molds M0-M29 in the solid-production system 100 in FIG. 1 can be produced according to one of the designs of fluid molds 2202, 2203 and 2204.

Figure 23:
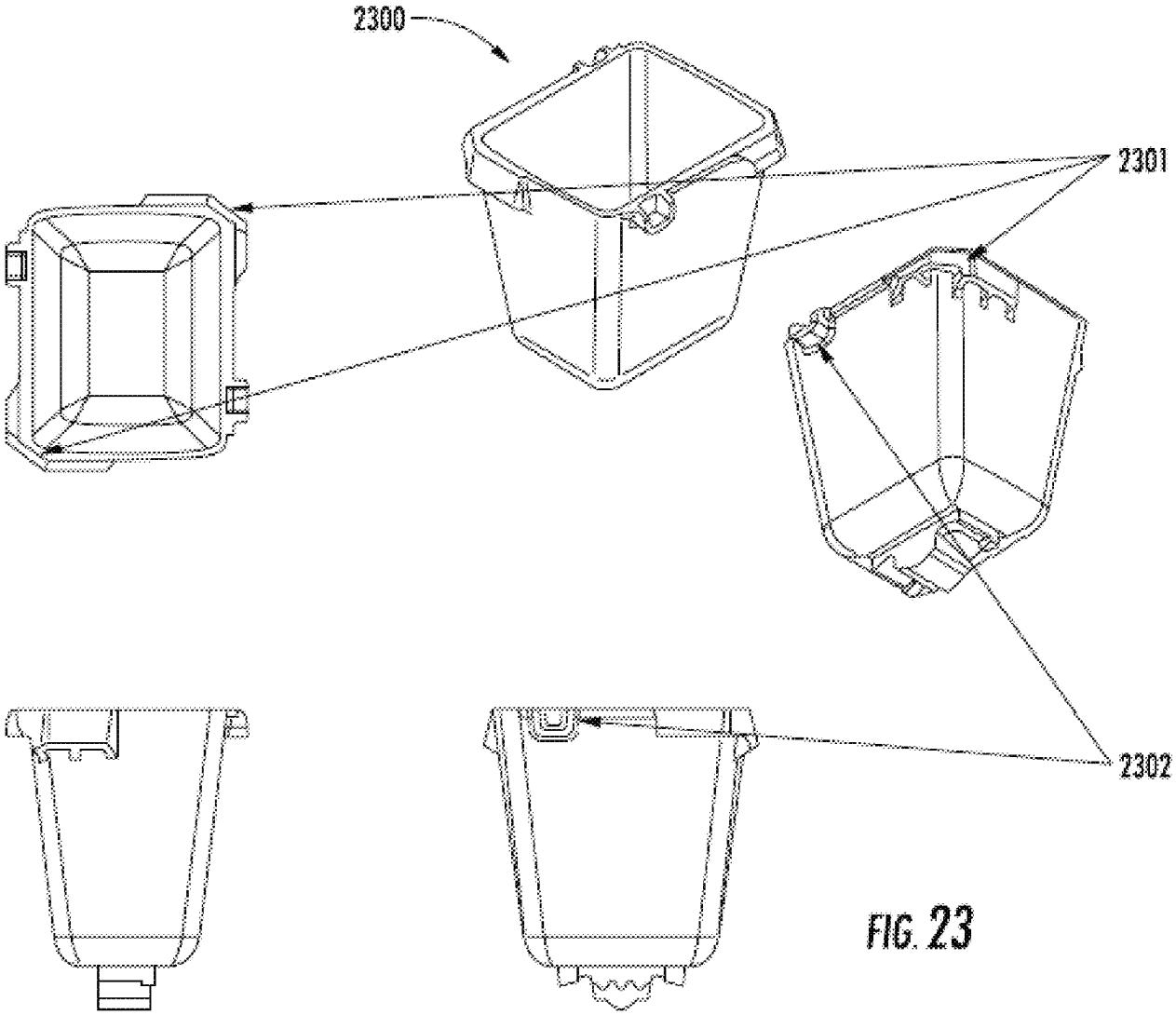
FIG. 23 illustrates different views of a fluid mold according to example implementations of the present disclosure.

FIG. 23 illustrates five different views of a fluid mold 2300 according to example implementations of the present disclosure. In one example, the fluid mold 2300 may correspond to one of the designs of fluid molds 2202, 2203 and 2204 in FIG. 22. The fluid mold illustrated in FIG. 23 may have one or more additional components to aid in solid ejection, solid dispense, and/or solid formation.

In one example implementation, the fluid mold 2300 may comprise one or more gripping surfaces 2301 arranged on diagonal corners of the fluid mold, with the gripping surfaces being deformable in response to the pressure exerted by a solid ejector in the first position so as to loosen the solid within the fluid mold. The solid ejector may be located proximate to the ejection position (e.g., P11 in FIG. 1) to slightly deform the fluid mold to break the bond between the formed solid and the fluid mold. That is, the solid ejector may slightly deform the fluid mold by squeezing the gripping surfaces on the fluid mold. In another example implementation, one or more wings or lips 2302 extending outwardly from the fluid mold can be added to the fluid mold to enable or enhance transport of the fluid mold along the track of a conveying mechanism arranged to index the one or more fluid molds in a machine direction into the ejection position.

As described above, when a fluid mold arrives at a solid-dispensing position (e.g., P28 in FIG. 1), a track door may be open to allow a loosened solid to be dispensed from the fluid mold though the open track door and out of the exit port of consumer solid-dispensing mechanism. A sensing mechanism may be located proximate to the solid-dispensing position to detect whether the solid is dispensed or provided to the user through the exit port. In one example implementation, the sensor may be an optical interrupt, as described below.

Figure 24:
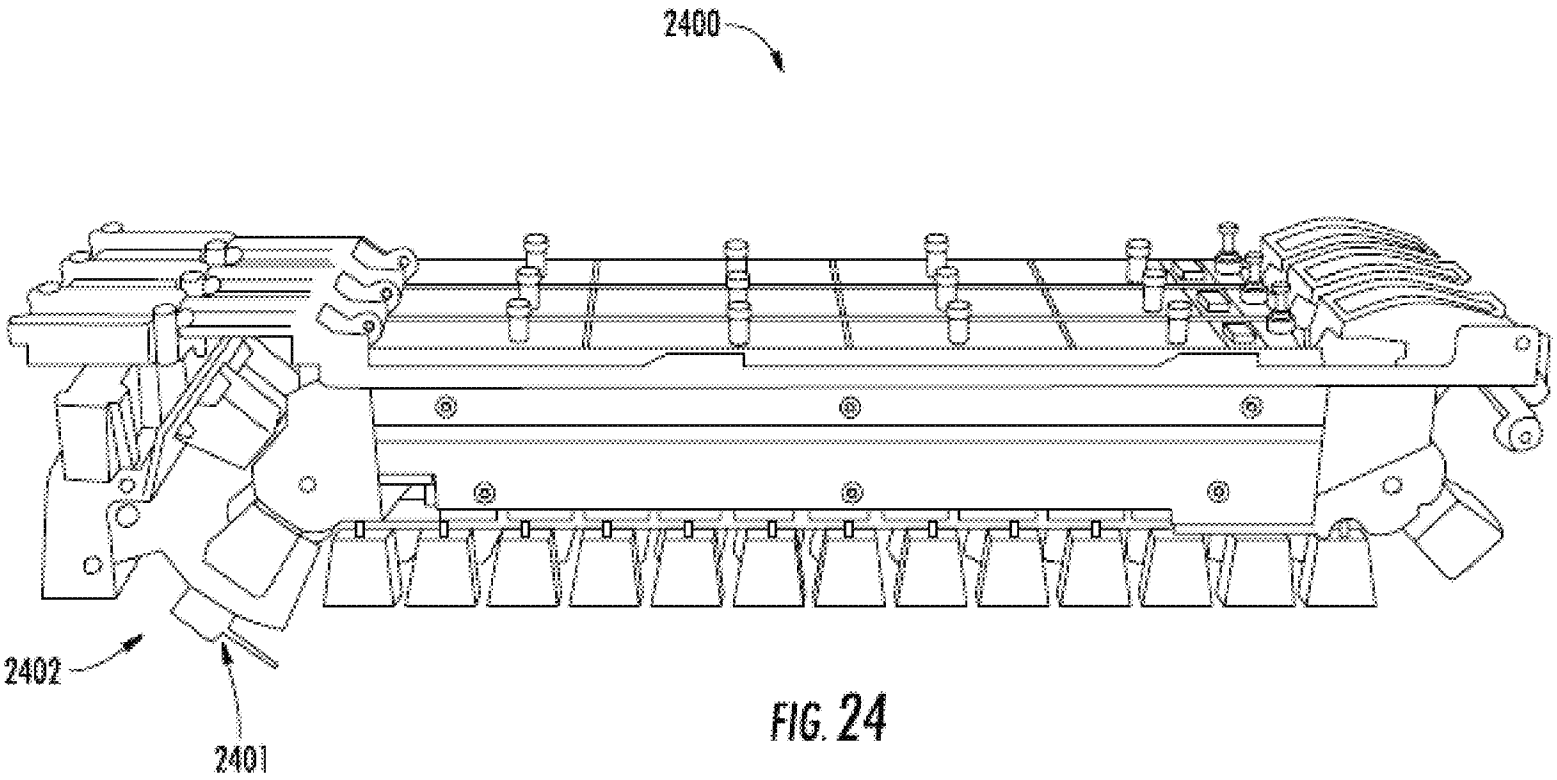
FIG. 24 illustrates a solid-production system with an indication of a location of a sensing mechanism of an example solid-detection mechanism according to example implementations of the present disclosure.

FIG. 24 illustrates a solid-production system 2400, which may be the same as or similar to the solid-production system 100 in FIG. 1 with an indication of a location of a sensing mechanism 2401 of an example solid-detection mechanism according to example implementations of the present disclosure. As shown, the sensing mechanism or sensor can be a part of a solid-dispensing mechanism 2402. In another example, the sensing mechanism can be separate but proximate to the solid-dispensing mechanism.

In one example implementation, the sensing mechanism 2401 may comprise an optical interrupt that can operate by utilizing an emitter/receiver pair that sends a constant optical beam of infrared radiation (IR). When a fluid mold arrives at the solid-dispensing position, one or more track doors may open or already be opened to allow the solid in the fluid mold to be dispensed to the user upon request from the user. The sensor may be installed proximate to the track doors or may be installed at other locations along a solid dispense path. When the solid such as an ice piece passes the path of the optical beam and breaks the optical beam, software logic of the solid-production system 100 may detect a presence of the ice piece that has been dispensed from the fluid mold to the user or consumer. If the optical beam is not broken, then the software logic (e.g., a solid-dispense mechanism slave state machine 205 in FIG. 2) may detect an absence of the ice piece and transmit a signal of the same to a master state machine (e.g., 201 in FIG. 2) indicating the state of the fluid mold as "SOLID". The master state machine may then send a command to a fluid-dispensing mechanism slave state machine (e.g., 202 in FIG. 2) to not cause arrangement of a fluid-dispensing mechanism to dispense fluid to that fluid mold. This fluid mold may pass through the solid-dispensing position again in a later attempt to dispense the solid. The sensor may also send an indication to the master state machine of the number of solids dispensed in response to a request from a user.

Figure 25A:
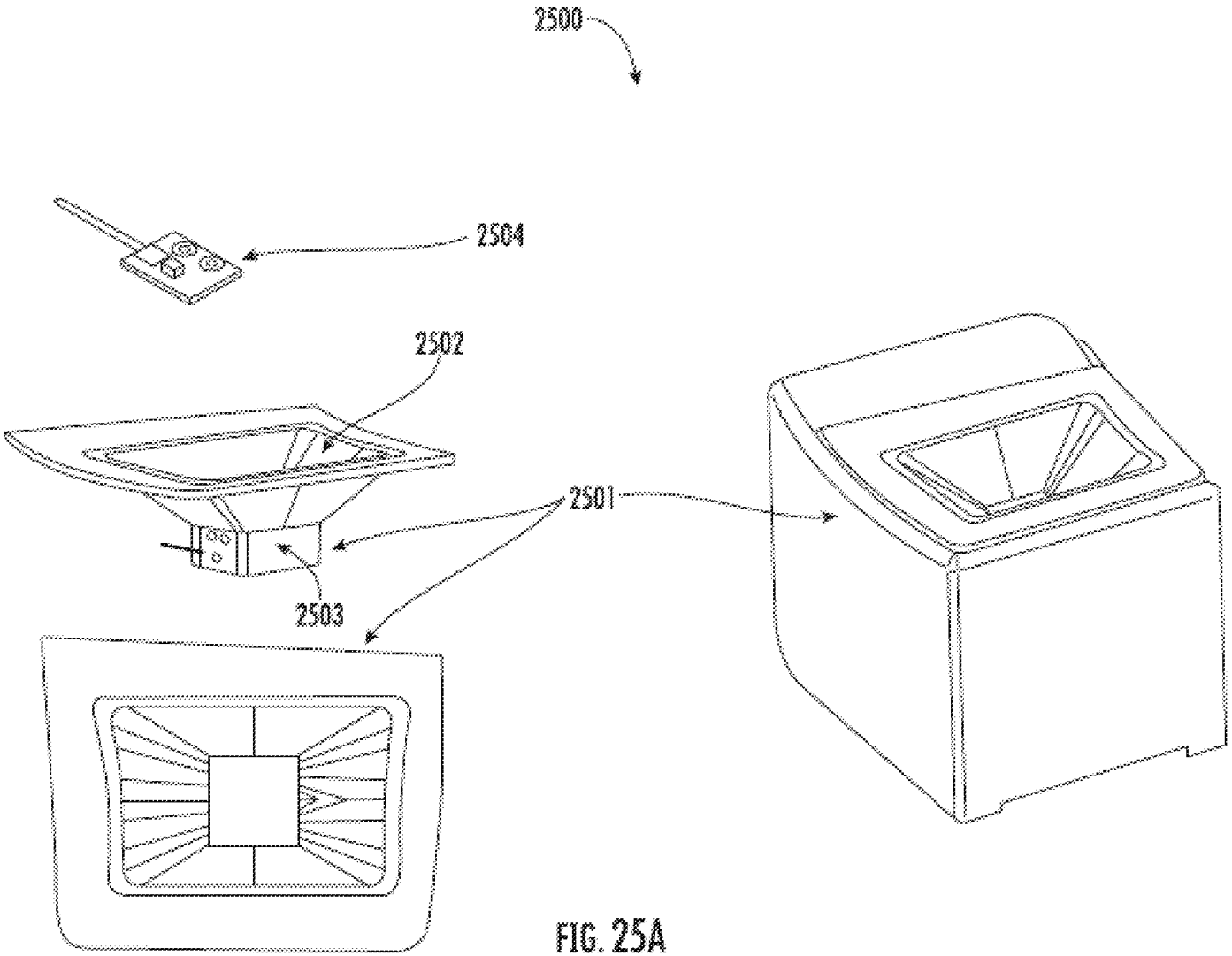
FIGS. 25A and 25B illustrate different arrangements of sensors on chute adapters for a solid-dispensing mechanism according to example implementations of the present disclosure.
Figure 25B:
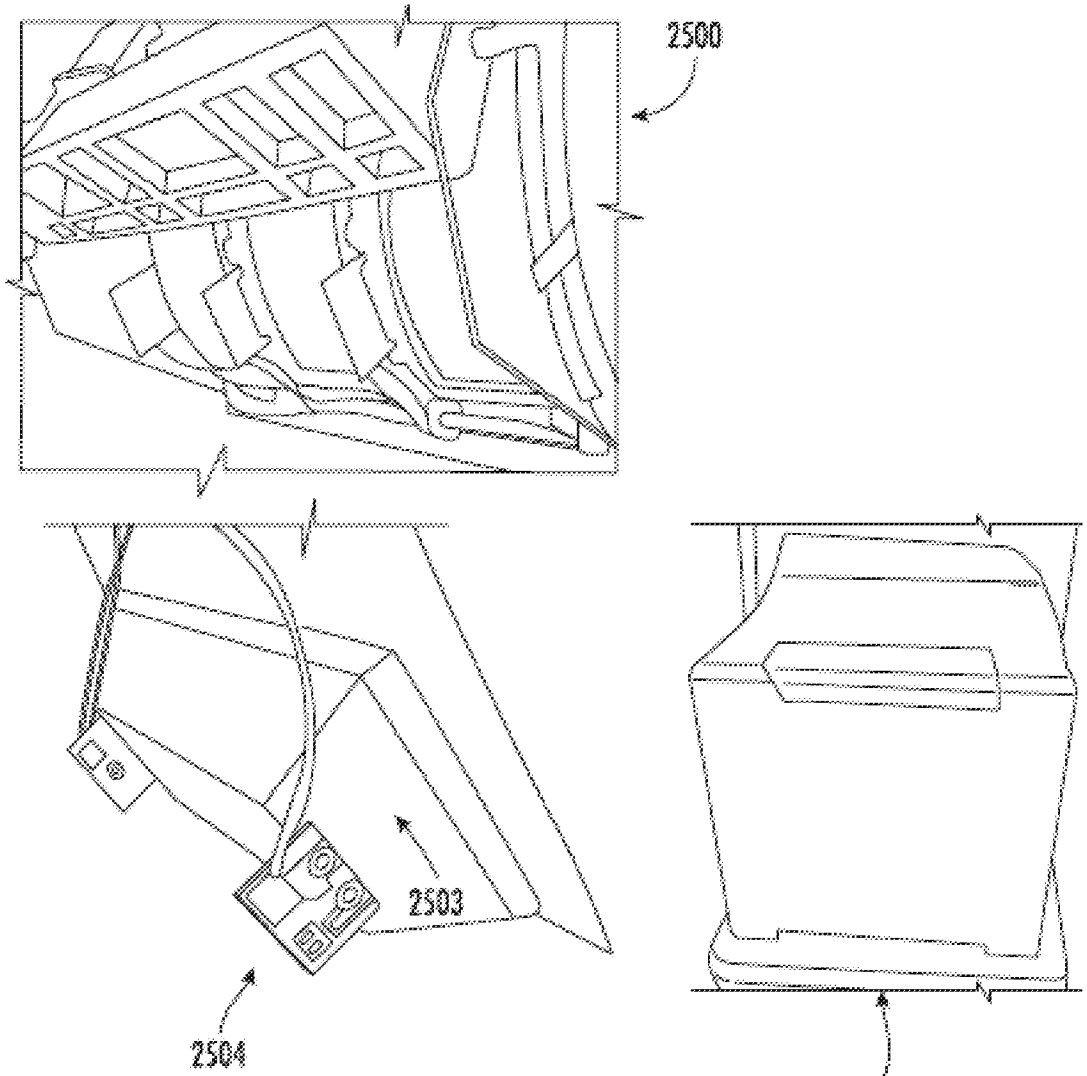

FIGS. 25A and 25B illustrate different arrangements of sensors on chute adapters for a solid-dispensing mechanism 2500 according to example implementations of the present disclosure. A chute adapter may be a hollow chute arranged to receive the loosened solid dispensed from each of the one or more fluid molds. As illustrated in FIGS. 25A and 25B, the sensor may be engaged with an exterior surface of the hollow chute and arranged to interact with an interior of the hollow chute so as to detect a presence or an absence of the dispensed solid in the interior of the hollow chute.

As illustrated in FIG. 25A, the chute adapter 2501 may comprise a mouth 2502 and a stem 2503, where the mouth may be wider than the stem. FIG. 25A illustrates one example implementation of a sensor 2504 installed on an external surface of the stem of the chute adapter to allow for more accurate detection of a solid dispensed through the chute adapter. However, the sensor may be installed on another location on the chute adapter, such as, for example, an interior surface of the stem of the chute adapter, an interior surface of the mouth of the chute adapter, an exterior surface of the mouth of the chute adapter, or a combination thereof.

By comparison, FIG. 25B illustrates multiple sensors 2504 installed on the stem 2503 of a chute adapter 2501 in another example implementation. As such, one, two, three, four, five, etc., sensors may be utilized in series or in parallel or in any combination for detecting a presence or an absence of a dispensed solid.

In other examples, instead of installing one or more sensors 2501 on the chute adapter, the one or more optical interrupts can be installed on the exit port or the track door of the solid-dispensing mechanism, or can be installed at other locations along a solid dispense path that may not be a part of the solid-production system 100.

Figure 26:
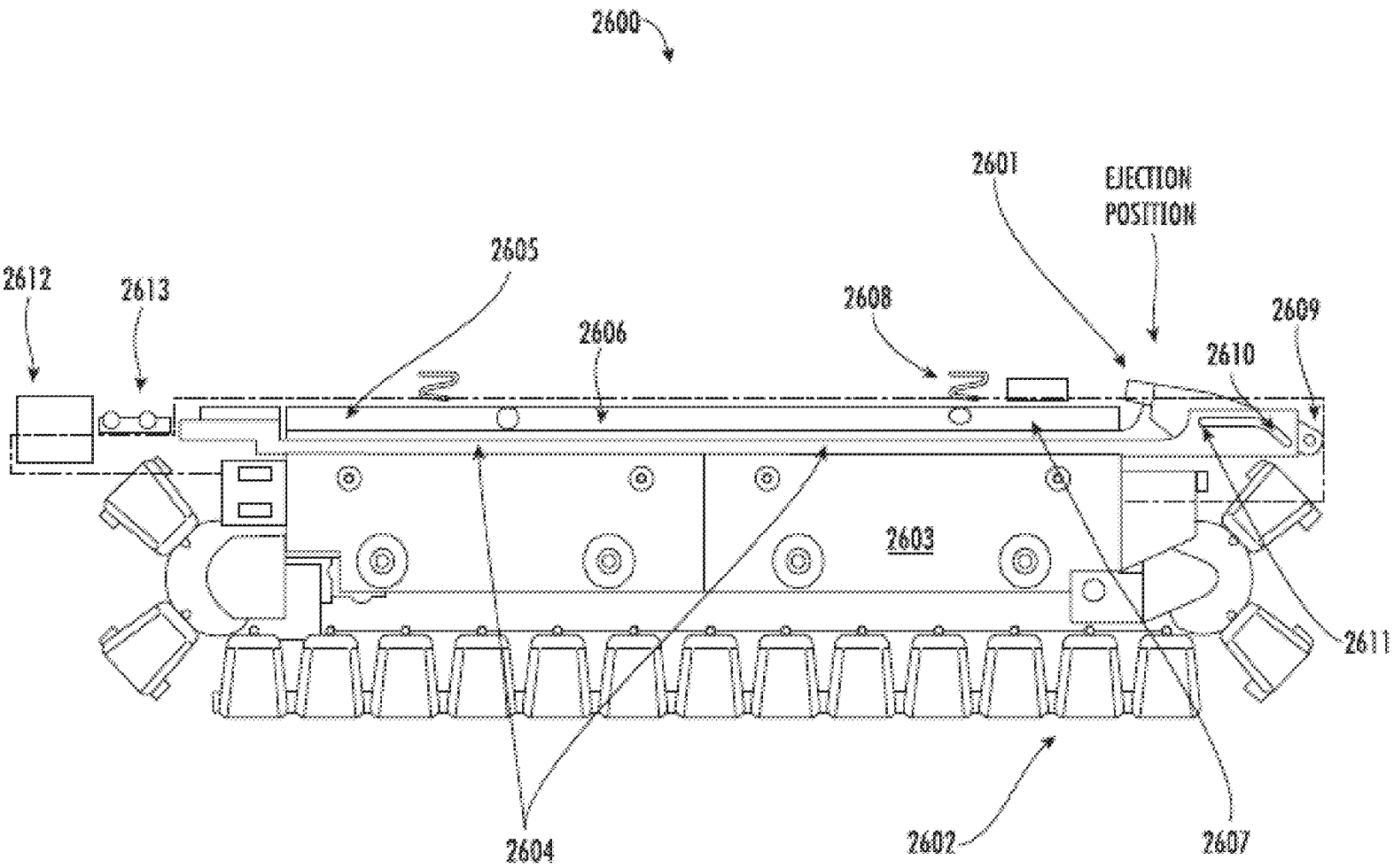
FIG. 26 illustrates a schematic of a solid-production system with an example solid ejector according to example implementations of the present disclosure.

FIG. 26 illustrates a schematic of a solid-production system 2600, being the same or similar to the solid-production system 100 in FIG. 1, with an example solid ejector 2601 according to example implementations of the present disclosure. In some example implementations, a solid ejector, such as that illustrated in FIG. 26, is arranged to loosen a solid in each of one or more fluid molds 2602 indexed into an ejection position relative to the solid ejector, the one or more fluid molds comprising a bottom surface and side surfaces extending therefrom. The solid ejector is actuatable so as to be urged into contact with and to apply pressure to at least one of the side surfaces of the fluid mold indexed into the ejection position so as to loosen the solid within the fluid mold in preparation for dispensing the solid from the fluid mold.

In some example implementations of the solid-production system 2600 illustrated in FIG. 26, a cooling block 2603 may be arranged to receive each of the one or more fluid molds 2602 having a fluid dispensed therein. The cooling block may be arranged to reduce a first temperature of the fluid dispensed into each of the one or more fluid molds to a second temperature to solidify the fluid in each of the one or more fluid molds such that the fluid in each of the one or more fluid molds forms the solid.

In some further example implementations, one or more actuation mechanisms may be arranged to urge the solid ejector 2601 into contact with and to apply pressure to the at least one of the side surfaces of the fluid mold 2602. For example, the one or more actuation mechanisms may comprise a sliding member 2604 arranged to engage the solid ejector. The sliding member may engage a pressure plate 2605 via a cam 2606 arranged about an outside edge of the sliding member, which can slidingly engage with a slot 2607 defined on the pressure plate. The cam may have a profile comprising two parts. The first part of the cam profile may be an incline and the second part of the cam profile may be a horizontal portion. When the cam profile is received within the slot and the sliding member moves the cam within the slot, the different parts of the cam profile may urge the pressure plate into different positions relative to the top surface of fluid in the fluid molds. The sliding member may be reciprocatingly movable so that movement of the sliding member in a machine direction impacts both arrangement of the pressure plate relative to a top surface of the fluid molds and arrangement of the solid ejector relative to the fluid molds.

As a result, in some example implementations, the sliding member 2604 may be movable in a reverse machine direction to urge the solid ejector 2601 into a first position in contact with and to apply pressure to the at least one of the side surfaces of the fluid mold 2602 indexed into the ejection position. The sliding member may also be movable in a machine direction to urge the solid ejector into a second position out of contact with the at least one of the side surfaces of the fluid mold indexed into the ejection position. By moving in a reverse machine direction, the sliding member can urge the pressure plate 2605 into a spaced apart arrangement relative to a top surface of the fluid in the fluid molds (i.e., into the up position or the ejection position) by exerting a normal force against a bottom surface of the pressure plate, against an opposing normal force exerted on a top surface of the pressure plate by a biasing mechanism 2608. Conversely, by moving in a machine direction, the pressure plate can be arranged into an initial position adjacent to a top surface of the fluid in the fluid molds, which can allow the biasing mechanism to exert the normal force on the top surface of the pressure plate without any opposing normal force exerted by the sliding mechanism.

In this manner, when the solid ejector 2601 is in the first position, a pressure plate 2605 may be arranged in an ejection position, where the pressure plate is arranged in a spaced apart relation relative to a top surface of fluid in the fluid molds. When the solid ejector is in the second position, the pressure plate may be arranged in an initial position, where the pressure plate is arranged adjacent to the top surface of the fluid in the fluid molds.

In some example implementations, the solid ejector 2601 may be movable between the first and second positions via a pivoting movement. For example, and as illustrated in FIG. 26, the solid ejector is pivotable about a pivot 2609 and the sliding member 2604 defines a slotted opening 2610 arranged to receive a protrusion 2611 extending from the sliding member. The sliding member may be movable in the reverse machine direction to bring the protrusion into contact with a first end of the slotted opening so as to pivot the solid ejector into the first position, and the solid ejector may be movable in the machine direction to bring the protrusion into contact with an opposing second end of the slotted opening so as to pivot the solid ejector into the second position.

The one or more actuation mechanisms may further comprise a motor 2612 and a reciprocating shaft 2613 engaged with the sliding member 2604, wherein actuation of the motor drives the reciprocating shaft to reciprocatingly move the sliding member in the reverse machine direction, to urge the solid ejector 2601 into the first position, and in the machine direction, to urge the solid ejector into the second position. The motor may interface with and be operably by a control mechanism, which may comprise a hardware processor and at least one memory. In some example implementations, the control mechanism may comprise a pressure plate slave state machine (e.g., 204 in FIG. 2), which may receive commands from a master state machine (e.g., 201 in FIG. 2) to actuate the motor in order to drive the reciprocating shaft to arrange the solid ejector in either a first position or a second position, and arrange a pressure plate in either the initial position, the second position, or an ejection position.

Figure 27:
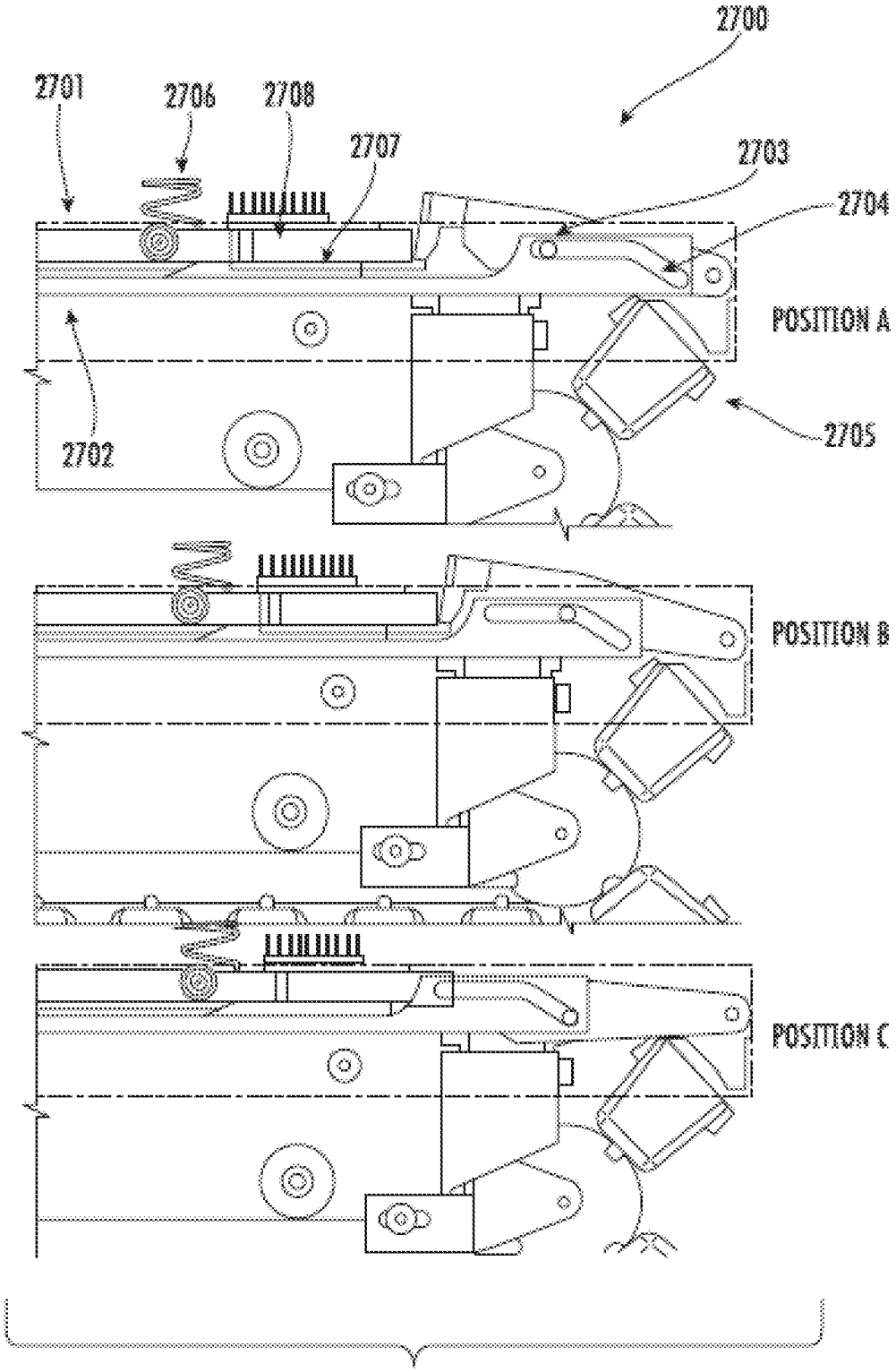
FIG. 27 illustrates different operational modes of a solid ejector according to example implementations of the present disclosure.

FIG. 27 illustrates different operational modes of a solid ejector 2700 according to example implementations of the present disclosure. As shown, there may be three operational modes of the solid ejector which may be indicated by different positions of the solid ejector and a pressure plate 2701.

In position A, a sliding member 2702 may be moved in a machine direction so that a protrusion 2703 extending from the solid ejector 2700 is into contact with a second end of a slotted opening 2704 defined by the sliding member. In this manner, the solid ejector is pivoted into the second position or out of contact with the at least one of the side surfaces of the fluid mold indexed into the ejection position. Likewise, the pressure plate is biased into an initial position or arranged adjacent to a top surface of a fluid in fluid molds 2705. When the pressure plate is in the initial position, a biasing member 2706 is able to exert a normal force on a top surface of the pressure plate without an opposing force being exerted onto the pressure plate by the sliding member.

In position B, the sliding member 2702 may be moved in a reverse machine direction so that the protrusion 2703 extending from the solid ejector 2700 is arranged between the second end and an opposing first end of the slotted opening 2704 defined by the sliding member. In this manner, the solid ejector is pivoted into a third position, which is between second position and the first position, and remains out of contact with the at least one of the side surfaces of the fluid mold indexed into the ejection position. The pressure plate 2701 is biased into a second position, or arranged in spaced apart relation relative to a top surface of a fluid in fluid molds 2705. When the pressure plate is in the second position, a cam 2707, arranged about an outside edge of the sliding member and engaged with a slot 2708 defined on the pressure plate 2701, exerts an opposing normal force on a bottom surface of the pressure plate which is greater than the normal force exerted by the biasing member 2706 on the top surface of the pressure plate so as to bias the pressure plate into spaced apart relation from a top surface of the fluid in the fluid molds.

In position C, the sliding member 2702 may continue being moved in a reverse machine direction so that the protrusion 2703 extending from the solid ejector 2700 is arranged in contact with the opposing first end of the slotted opening 2704 defined by the sliding member. In this manner, the solid ejector is pivoted into a first position, and is contact with the at least one of the side surfaces of the fluid mold indexed into the ejection position. In this way, the solid ejector can eject or loosen the solid in the fluid mold in the ejection position. The pressure plate 2701 is biased into an ejection position, or arranged in spaced apart relation relative to a top surface of a fluid in fluid molds 2705, at a greater spaced apart relation relative to the top surface of the fluid molds as compared to the pressure plate in the second position. When the pressure plate is in the ejection position, the cam 2707, arranged about an outside edge of the sliding member and engaged with the slot 2708 defined on the pressure plate, exerts an opposing normal force on a bottom surface of the pressure plate which is greater than the normal force exerted by the biasing member 2706 on the top surface of the pressure plate so as to bias the pressure plate into the spaced apart relation from a top surface of the fluid in the fluid molds.

Many modifications and other implementations of the disclosure set forth herein will come to mind to one skilled in the art to which these disclosure pertain having the benefit of the teachings presented in the foregoing descriptions and the associated drawings. Therefore, it is to be understood that the disclosure are not to be limited to the specific implementations disclosed and that modifications and other implementations are intended to be included within the scope of the appended claims. Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A solid-production system, comprising:

a conveyor arranged to engage and move a fluid mold through the solid-production system;

a fluid dispenser arranged to dispense fluid to the fluid mold;

a cooling block arranged to interact with the fluid mold moved through the cooling block via the conveyor so as to cool the fluid therein to form a solid;

a pressure plate arranged to urge the fluid mold into interaction with the cooling block;

a solid dispensor arranged to dispense the solid loosened by a solid ejector to a user through an exit port; and processing circuitry configured to implement a master state machine, and slave state machines for respective ones of the fluid dispenser, conveyor, pressure plate and solid dispenser, wherein the master state machine is configured to send commands to the slave state machines based on states of the slave state machines, and the slave state machines are configured to execute the commands to control the respective ones of the conveyor, fluid dispenser, pressure plate, and solid dispenser.

2. The solid-production system of claim 1, wherein the slave state machines include a conveying mechanism slave state machine and other slave state machines for the fluid dispenser, pressure plate, and solid dispenser, wherein the master state machine being configured to send commands to the slave state machines includes being configured to send first and second commands to the conveying mechanism slave state machine based on respectively first and second states of the conveying mechanism slave state machine, and wherein the first state is defined by the conveyor not moving the fluid mold through the solid-production system, and the second state is defined by the conveyor moving the fluid mold through the solid-production system.

3. The solid-production system of claim 2, wherein the conveying mechanism slave state machine is configured to:

execute the first command and cause the conveyor to move the fluid mold through the solid-production system; and execute the second command and cause the conveyor to stop movement of the fluid mold through the solid-production system.

4. The solid-production system of claim 1, wherein the slave state machines include a fluid-dispensing mechanism slave state machine and other slave state machines for the conveyor, pressure plate, and solid dispenser, wherein the master state machine being configured to send commands to the slave state machines includes being configured to send first and second commands to the fluid-dispensing mechanism slave state machine based on respectively first and second states of the fluid-dispensing mechanism slave state machine, and wherein the first state is defined by the fluid dispenser dispensing the fluid to the fluid mold, and the second state is defined by the fluid dispenser not dispensing the fluid to the fluid mold.

5. The solid-production system of claim 4, wherein the fluid-dispensing mechanism slave state machine is configured to:

execute the first command to cause the fluid dispenser to stop dispensing the fluid to the fluid mold; and execute the second command to cause the fluid dispenser to initiate dispensing the fluid to the fluid mold.

6. The solid-production system of claim 1, wherein the slave state machines include a pressure plate slave state machine and other slave state machines for the conveyor, fluid dispenser, and solid dispenser, wherein the master state machine being configured to send commands to the slave state machines includes being configured to send first and second commands to the pressure plate slave state machine based on respectively first and second states of the pressure plate slave state machine, and wherein the first state is defined by the pressure plate being arranged adjacent to a top surface of the fluid in the fluid mold so as to urge the fluid mold into interaction with the cooling block, and the second state is defined by the pressure plate being arranged in a spaced apart relation from the top surface of the fluid in the fluid mold so as not to urge the fluid mold into interaction with the cooling block.

7. The solid-production system of claim 6, wherein the pressure plate slave state machine is configured to:

execute the first command to cause arrangement of the pressure plate into the spaced apart relation from the top surface of the fluid in the fluid mold so as not to urge the fluid mold into interaction with the cooling block; and execute the second command to cause arrangement of the pressure plate to be adjacent to the top surface of the fluid in the fluid mold so as to urge the fluid mold into interaction with the cooling block.

8. The solid-production system of claim 1, wherein the slave state machines include a solid-dispensing mechanism slave state machine and other slave state machines for the conveyor, fluid dispenser, and pressure plate, wherein the master state machine being configured to send commands to the slave state machines includes being configured to send first and second commands to the solid-dispensing mechanism slave state machine based on respectively first and second states of the solid-dispensing mechanism slave state machine, and wherein the first state is defined by the solid dispenser being arranged to dispense the solid loosened by the solid ejector to the user through the exit port, and the second state is defined by the solid dispenser being arranged so as to not dispense the loosened solid.

9. The solid-production system of claim 8, wherein the solid-dispensing mechanism slave state machine is configured to:

execute the first command to cause arrangement of the solid dispenser so as not to cause the solid dispenser to dispense the loosened solid; and execute the second command to cause arrangement of the solid dispenser so as to cause the solid dispenser to dispense the solid loosened by the solid ejector to the user through the exit port.

10. The solid-production system of claim 1, wherein the master state machine is configured to detect variables associated with respective ones of the states of the slave state machines, and send the commands to the slave state machines based thereon.

11. The solid-production system of claim 10, wherein the variables associated with the states of the conveying mechanism slave state machine include a volume of the fluid or the solid in the fluid mold, a time period associated with a fluid or a solid in the fluid mold, sub-states of the conveyor, a track error state, a number of cycles that the conveyor moves through the solid-production system, an expiration of a time period associated with a cycle of the number of cycles, detection and update of a position of the fluid mold in the cycle, a temperature of the fluid or the solid in the fluid mold, an emptiness of the fluid mold, and an expiration of a time period associated with cooling the fluid in the fluid mold to form the solid.

12. The solid-production system of claim 10, wherein the variables associated with the states of the fluid-dispensing mechanism slave state machine include a fill level and a fill time of the fluid dispensed to the fluid mold, an emptiness of the fluid mold, detection of the fluid mold in a fluid-dispensing position aligned with the fluid dispenser, a volume of the solid in the fluid mold, and a temperature of the fluid or the solid in the fluid mold and an expiration of a time period associated with dispensing the fluid to the fluid mold.

13. The solid-production system of claim 10, wherein the variables associated with the states of the pressure plate slave state machine include an arrangement of the pressure plate from a top surface of the fluid in the fluid mold, detection of the fluid mold in an ejection position aligned with the solid ejector, an emptiness of the fluid mold, a temperature of the fluid or the solid in the fluid mold, and an arrangement of the solid ejector relative to the fluid mold in the ejection position.

14. The solid-production system of claim 10, wherein the variables associated with the states of the solid-dispensing mechanism slave state machine include detection of the fluid mold in a solid-dispensing position aligned with the solid dispenser, an emptiness of the fluid mold, a temperature of the fluid or the solid in the fluid mold, a status of the exit port, expiration of a time period associated with dispensing the solid from the fluid mold, and a volume of the solid in the fluid mold.

* * * * *